US006746985B2

(12) United States Patent
Higashi

(10) Patent No.: US 6,746,985 B2
(45) Date of Patent: Jun. 8, 2004

(54) HEAT-SENSITIVE RECORDING MATERIAL

(75) Inventor: Shunsaku Higashi, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 217 days.

(21) Appl. No.: 10/132,316

(22) Filed: Apr. 26, 2002

(65) Prior Publication Data

US 2003/0104939 A1 Jun. 5, 2003

(30) Foreign Application Priority Data

Apr. 27, 2001 (JP) ..... 2001-132123

(51) Int. Cl.[7] ..... G03C 5/18; B41M 5/20

(52) U.S. Cl. ..... 503/217; 430/138; 430/170; 430/171

(58) Field of Search ..... 503/217; 430/138, 430/170, 171

(56) References Cited

U.S. PATENT DOCUMENTS 4,957,847 A 9/1990 Adam et al.
5,773,186 A 6/1998 Takashima
5,925,489 A 7/1999 Kawabuchi et al.

FOREIGN PATENT DOCUMENTS

| | | |
|---|---|---|
| GB | 2 217 865 | 11/1989 |
| JP | 11-109554 | 4/1999 |
| JP | 2001-130144 | 5/2001 |
| JP | 2002-3738 | 1/2002 |

OTHER PUBLICATIONS

Japanese Abstract No. 2001113840, dated Apr. 24, 2001.

*Primary Examiner*—N. Edwards
(74) *Attorney, Agent, or Firm*—Sughrue Mion, PLLC

(57) ABSTRACT

A full-color heat-sensitive recording material. At least a heat-sensitive recording layer that color-develops to yellow color; a heat-sensitive recording layer that color-develops to cyan color and a heat-sensitive recording layer that color-develops to magenta color are sequentially provided on a support in this order from the support side. All of the above-mentioned heat-sensitive recording layers contain a diazo compound and/or diazonium salt, and a coupler compound that reacts with the diazo compound and/or diazonium salt for color development.

19 Claims, No Drawings

HEAT-SENSITIVE RECORDING MATERIAL

BACKGROUND OF THE INVENTION

1. Field of the Invention

The present invention relates to a heat-sensitive recording material, more particularly, to a heat-sensitive recording material of full-color including a support and at least three heat-sensitive recording layers on the support, the heat-sensitive recording material being excellent in image stability, handling property, color development and fixing speed.

2. Description of the Related Art

Heat-sensitive recording progressed recently since the recording apparatus thereof is simple, reliability is high and maintenance is not necessary. As materials thereof, there are conventionally widely known those utilizing a reaction of an electron-donating colorless dye with an electron-accepting compound which allows the dye to develop color, those utilizing a reaction of a diazo compound or diazonium salt (hereinafter, simply referred to as diazo compound or the like, in some cases) with a coupler which allows this to develop color, and other materials.

Recently, progress of full-color heat-sensitive recording materials is remarkable, and such full-color heat-sensitive recording materials have a structure in which layers that develops yellow, magenta and cyan colors respectively are provided, and full-color images can be formed by heating the layers to cause color development.

As the above-mentioned full-color heat-sensitive recording material, general are materials including a combination of a color-development layer (heat-sensitive recording layer) composed of an electron-donating colorless dye and an electron-accepting compound with a color-development layer composed of a diazo compound or the like and a coupler, in which a yellow layer, magenta layer and cyan layer are provided in this order from the upper layer side.

With the full-color heat-sensitive recording material having the above-mentioned structure, an image is formed. Then the image is fixed by irradiation with light to enhance the stability of the image, by utilizing a photodecomposition property of the diazo compound or the like. In such a light-fixing type full-color heat-sensitive recording material, a layer composed of an electron-donating colorless dye that develops cyan color and an electron-accepting compound is often provided at the lowest layer (layer nearest to a support), for effecting the above-mentioned light-fixation efficiently. However, even in the full-color heat-sensitive recording material of light-fixation type having such a structure, there is a requirement for further improvement in image stability.

Further, improvement in color-developing property is also a great object for the above-mentioned full-color heat-sensitive recording material. However, the above-mentioned full-color heat-sensitive recording material utilizing a reaction of an electron-donating colorless dye with an electron-accepting compound has a problem in image stability since the reaction is an equilibrium reaction, and additionally, there is a necessity to make the content of an electron-accepting compound higher than that of an electron-donating colorless dye. Consequently, a color-development layer containing the above-mentioned electron-donating colorless dye or the like becomes thicker as compared with a color-development layer containing the above-mentioned diazo compound or the like. The thickness of such a color-development layer leads to increased thickness of a full-color heat-sensitive recording material, influencing the color-developing property.

Moreover, since the above-mentioned electron-donating colorless dye and electron-accepting compound is solid-dispersed in a color-development layer, a heat-sensitive recording material is curled by phase transition of them caused by heating, leading to decrease in handling property.

Furthermore, a full-color heat-sensitive recording material including a layer that develops yellow color placed as the uppermost layer has poor fixing speed since the transmittance of light necessary for light-fixation of a diazo compound or the like decreases due to the influence of yellow.

SUMMARY OF THE INVENTION

An object of the present invention is to provide a full-color heat-sensitive recording material excellent in image stability, handling property, color development and fixing speed, in view of the above-mentioned problems.

A means for attaining the above-mentioned object is as described below. Namely, the present invention provides a full-color heat-sensitive recording material including a support, and at least a heat-sensitive recording layer that color-develops to yellow color; a heat-sensitive recording layer that color-develops to cyan color and a heat-sensitive recording layer that color-develops to magenta color, sequentially provided on the support in this order from the support side, wherein all of the above-mentioned heat-sensitive recording layers contain a diazo compound and/or diazonium salt; and a coupler compound that reacts with the above-mentioned diazo compound and/or diazonium salt to cause color development.

One aspect of the present invention provides the above-mentioned full-color heat-sensitive recording material, wherein the above-mentioned heat-sensitive recording layer that color-develops to yellow color contains a diazo compound of the following general formula (I):

General Formula (I)

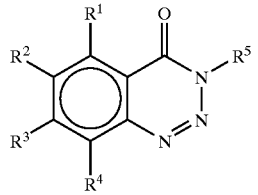

In the general formula (I), $R^1$, $R^2$, $R^3$ and $R^4$ each independently represent any group selected from the group consisting of a hydrogen atom, halogen atoms, alkyl groups, aryl groups, $—OR^{51}$, $—SR^{51}$, $—COOR^{51}$, $—CONR^{51}R^{52}$, $—SO_2R^{51}$, $—SO_2NR^{51}$, $R^{52}$, $—COR^{51}$, $—NR^{51}R^{52}$, nitro group and cyano group. $R^{51}$ and $R^{52}$ each independently represent any group selected from the group consisting of a hydrogen atom, alkyl groups, aryl groups and acyl group. $R^5$ represents any group selected from the group consisting of a hydrogen atom, alkyl groups, aryl groups, $—COOR^{53}$, $—CONR^{53}R^{54}$, $—SO_2NR^{53}$, $—SO_2NR^{53}R^{54}$ and $—COR^{53}$. $R^{53}$ and $R^{54}$ each independently represent any group selected from the group consisting of a hydrogen atom, alkyl groups, aryl groups and acyl group.

Another aspect of the present invention provides the above-mentioned full-color heat-sensitive recording material, wherein the above-mentioned heat-sensitive recording layer that color-develops to cyan color contains at least one of diazonium salts of the following general formulae (A) to (C):

General formula (A)

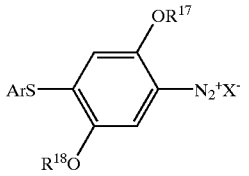

General formula (B)

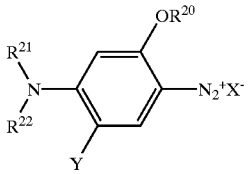

General formula (C)

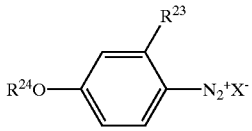

In the general formula (A), Ar represents a substituted or unsubstituted aryl group. $R^{17}$ and $R^{18}$ each independently represent a substituted or unsubstituted alkyl group or a substituted or unsubstituted aryl group and may be the same and may be different from each other. In the general formula (B), $R^{20}$, $R^{21}$ and $R^{22}$ each independently represent a substituted or unsubstituted alkyl group or a substituted or unsubstituted aryl group and may be the same and may be different from each other. Y represents a hydrogen atom or $OR^{19}$. $R^{19}$ represents a substituted or unsubstituted alkyl group or a substituted or unsubstituted aryl group. In the general formula (C), $R^{23}$ and $R^{24}$ each independently represent a substituted or unsubstituted alkyl group or a substituted or unsubstituted aryl group and may be the same and may be different from each other.

Another aspect of the present invention provides the above-mentioned full-color heat-sensitive recording material, wherein the above-mentioned heat-sensitive recording layer that color-develops to magenta color contains a diazonium salt of the following general formula (1):

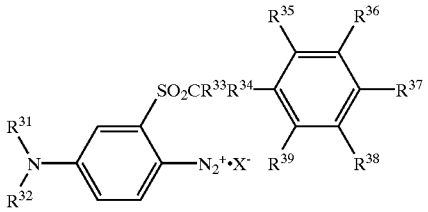

In the general formula (1), $R^{31}$ and $R^{32}$ each independently represent a hydrogen atom, alkyl group or aryl group. $R^{33}$ and $R^{34}$ each independently represent a hydrogen atom, alkyl group, aryl group or halogen atom. $R^{35}$, $R^{36}$, $R^{37}$, $R^{38}$ and $R^{39}$ each independently represent a hydrogen atom, alkyl group, aryl group, halogen atom, alkoxy group, aryloxy group, alkoxycarbonyl group, acyloxy group, carbamoyl group, amide group, cyano group, alkylthio group, arylthio group, alkylsulfonyl group, or arylsulfonyl group. At least one of $R^{35}$, $R^{36}$, $R^{37}$, $R^{38}$ and $R^{39}$ represents a halogen atom. $X^-$ represents an anion.

Further, another aspect of the present invention provides the above-mentioned full-color heat-sensitive recording material, wherein the above-mentioned heat-sensitive recording layer that color-develops to yellow color contains a diazo compound of the above-described general formula (I), the above-mentioned heat-sensitive recording layer that color-develops to cyan color contains at least one of diazonium salts of the above-described general formulae (A) to (C), and the above-mentioned heat-sensitive recording layer that color-develops to magenta color contains a diazonium salt of the above-described general formula (I).

DETAILED DESCRIPTION OF THE INVENTION

The heat-sensitive recording material of the present invention is characterized in that it includes a support, and at least a heat-sensitive recording layer that color-develops to yellow color, a heat-sensitive recording layer that color-develops to cyan color and a heat-sensitive recording layer that color-develops to magenta color, on the support in this order from the support side. All of the above-mentioned heat-sensitive recording layers contain a diazo compound and/or diazonium salt and a coupler compound that reacts with the above-mentioned diazo compound and/or diazonium salt to cause color development.

In the heat-sensitive recording material of the present invention, since all of the heat-sensitive recording layer that color-develops to yellow color (yellow heat-sensitive recording layer), the heat-sensitive recording layer that color-develops to cyan color (cyan heat-sensitive recording layer) and the heat-sensitive recording layer that color-develops to magenta color (magenta heat-sensitive recording layer) are constituted of a layer composed of a diazo compound or the like and a coupler, a decrease in thickness of all the color-development layers and a decrease in thickness of the full-color heat-sensitive recording material itself are possible, and color development of an image can be enhanced. Further, since a diazo compound and a coupler are emulsion-dispersed in a heat-sensitive recording layer or capsulated in microcapsules, curl of a full-color heat-sensitive recording material due to phase transition of contents can be decreased, and handling property can be improved. Further, since the reaction of a diazo compound or the like with a coupler is an irreversible reaction, the stability of an image is further improved as compared with the case of use of an electron-donating colorless dye and the like.

Since the full-color heat-sensitive recording material of the present invention has a structure in which a yellow heat-sensitive recording layer, a cyan heat-sensitive recording layer and a magenta heat-sensitive recording layer are provided in this order from the support side, decrease in the transmittance of light necessary for light-fixation of a diazo compound or the like due to the influence of yellow can be suppressed, and image fixing speed can be improved.

First, the layer constitution of the full-color heat-sensitive recording material of the present invention is described. The full-color heat-sensitive recording material of the present invention is a diazo color-developing system which has a layer structure in which a yellow heat-sensitive recording layer, a cyan heat-sensitive recording layer and a magenta heat-sensitive recording layer are placed in this order from the support side, and in which the color-developing mechanism of each layer is composed of a diazo compound or the like, and a coupler. Specifically, suitable is for example a constitution including a heat-sensitive recording layer containing a diazo compound or the like having a maximum absorption wavelength of 350 nm or less and a coupler reacting with the diazo compound or the like to cause development of yellow color, a light-fixation type heat-sensitive recording layer containing a diazo compound or the like having a maximum absorption wavelength of 370±30 nm and a coupler reacting with the diazo compound or the like to cause development of cyan color, and a light-fixation type heat-sensitive recording layer containing a diazonium salt compound having a maximum absorption wavelength of 430±30 nm and a coupler reacting with the diazonium salt compound to cause development of magenta color, from the support side. In the above-mentioned constitution, the heat-sensitive recording layer that color-develops to yellow color can be used in non-fixation mode, and further improvement of image stability may be performed by using this yellow heat-sensitive recording layer as a light-fixation type heat-sensitive recording layer.

In the heat-sensitive recording material of the present invention, it is preferable to provide a light transmittance-controlling layer and an outermost protective layer on a heat-sensitive recording layer, particularly, a magenta heat-sensitive recording material, and particularly, it is preferable to provide a light transmittance-controlling layer having a constitution in which light transmittance in the wavelength range of light used for light-fixation decreases after fixation, between the light-fixation type magenta heat-sensitive recording layer and the protective layer. In the case of such as heat-sensitive recording material, it is preferable that the light transmittance after the above-mentioned fixation and light irradiation is 10% or less at 350 nm. In this case, the light irradiation means irradiation with light of 13 kJ/$m^2$ at a wavelength of 420 nm conducted by a xenon lamp compulsive tester. Specifically, it means light irradiation at 0.9 W/$m^2$ for 4.0 hours by Weather O meter Ci65 (trade name: manufactured by Atlas Electric Co.).

As the color development component composed of a diazo compound or the like and a coupler contained in each heat-sensitive recording layer in the present invention, those conventionally known can be used. This heat-sensitive recording material may contain a basic substance, sensitizer and the like promoting the reaction of a diazo compound or the like with a coupler. As described above, in the heat-sensitive recording material of the present invention, a known diazo compound or the like and a coupler can be used in combination appropriately. However, for sufficient manifestation of the effect of the present invention, there are combinations of diazo compounds and the like with couplers suitable for a yellow heat-sensitive recording layer, a cyan heat-sensitive recording layer and a magenta heat-sensitive recording layer, and optimum examples of these color development components and combinations thereof are described below.

Heat-sensitive Recording Layer

Yellow Heat-sensitive Recording Layer

A maximum absorption wavelength λmax of a diazo compound or the like used in a yellow heat-sensitive recording layer is preferably 350 nm or less, more preferably 340 nm or less from the standpoint of its effect. If a diazo compound or the like has λmax at a longer wavelength than the above-mentioned wavelength range, the diazo compound or the like in a yellow heat-sensitive recording layer may be deactivated in some cases by light irradiation in fixing an upper layer.

As the diazo compound or the like in a yellow heat-sensitive recording layer placed at a position nearest to a support in the heat-sensitive recording material of the present invention, a diazo compound of the following general formula (I) is preferable:

General Formula (I)

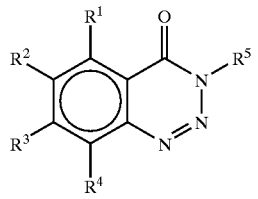

In the general formula (I), $R^1$, $R^2$, $R^3$ and $R^4$ each independently represent any group selected from the group consisting of a hydrogen atom, halogen atoms, alkyl groups, aryl groups, —$OR^{51}$, —$SR^{51}$, —$COOR^{51}$, —$CONR^{51}R^{52}$, —$SO_2R^{51}$, —$SO_2NR^{51}R^{52}$, —$COR^{51}$, —$NR^{51}R^{52}$, nitro group and cyano group. $R^{51}$ and $R^{52}$ each independently represent any group selected from the group consisting of a hydrogen atom, alkyl groups, aryl groups and acyl group. $R^5$ represents any group selected from the group consisting of a hydrogen atom, alkyl groups, aryl groups, —$COOR^{53}$, —$CONR^{53}R^{54}$, —$SO_2R^{53}$, —$SO_2NR^{53}R^{54}$ and —$COR^{53}$. $R^{53}$ and $R^{54}$ each independently represent any group selected from the group consisting of a hydrogen atom, alkyl groups, aryl groups and acyl group.

In the above-mentioned general formula (I), $R^1$, $R^2$, $R^3$ and $R^4$ each independently represent any group selected from the group consisting of a hydrogen atom, halogen atoms, alkyl groups, aryl groups, —$OR^{51}$, —$SR^{51}$, —$COOR^{51}$, —$CONR^{51}R^{52}$, —$SO_2R^{51}$, —$SO_2NR^{51}R^{52}$, —$COR^{51}$, —$NR^{51}R^{52}$, nitro group and cyano group.

In the general formula (I), the halogen atom represented by $R^1$ and $R^4$ is preferably fluorine, chlorine, bromine or iodine, and of them, fluorine and chlorine are preferable.

In the general formula (I), when $R^1$ and $R^4$ represent an alkyl group, unsubstituted alkyl groups and alkyl groups having a substituent are included, and the alkyl group may be linear or branched, and may have an unsaturated bond.

In the general formula (I), the alkyl group represented by $R^1$ and $R^4$ is preferably an alkyl group having 1 to 20 carbon atoms, more preferably an alkyl group having 1 to 10 carbon atoms. Specifically, methyl, ethyl, n-propyl, i-propyl, n-butyl, t-butyl, n-hexyl, n-octyl, 2-ethylhexyl, 3,5,5-trimethylhexyl, dodecyl, 2-chloroethyl, 2-methanesulfonylethyl, 2-methoxyethyl, 2-benzoyloxyethyl, N,N-dibutylcarbamoylmethyl, 2-ethoxycarbonylethyl, butoxycarbonylmethyl, 2-isopropyloxyethyl, 2-(2,5-di-t-amylphenoxy)ethyl, 2-phenoxyethyl, 1-(4-methoxyphenoxy)-2-propyl, 1-(2,5-di-t-amylphenoxy)-2-propyl, benzyl, α-methylbenzyl, trichloromethyl, trifluoromethyl, 2,2,2-trifluoroethyl and the like are preferable.

In the general formula (I), when $R^1$ and $R^4$ represent an aryl group, unsubstituted aryl groups and aryl groups having a substituent are included. As the aryl group represented by $R^1$ and $R^4$, aryl groups having 6 to 30 carbon atoms are preferable. Specifically, phenyl, 4-methylphenyl, 2-chlorophenyl and the like are preferable.

In the general formula (I), when $R^1$and $R^4$ represent —$OR^{51}$, —$SR^{51}$, —$COOR^{51}$, —$CONR^{51}R^{52}$, —$SO_2R^{51}$, —$SO_2NR^{51}R^{52}$, —$COR^{51}$ or —$NR^{51}R^{52}$, $R^{52}$ and $R^{52}$ each independently represent any group selected from the group consisting of a hydrogen atom, alkyl groups, aryl groups and acyl group.

In the general formula (I), the alkyl group represented by $R^{51}$ and $R^{52}$ includes unsubstituted alkyl groups and alkyl groups having a substituent. As the alkyl group represented by $R^{51}$ and $R^{52}$, alkyl groups having 1 to 30 carbon atoms are preferable, and alkyl groups having 1 to 10 carbon atoms are more preferable. Specifically, methyl, ethyl, i-propyl, s-butyl, t-butyl, t-amyl and the like are preferable.

In the general formula (I), the aryl group represented by $R^{51}$ and $R^{52}$ includes unsubstituted aryl groups and aryl groups having a substituent. As the aryl group represented by $R^{51}$ and $R^{52}$, aryl groups having 6 to 30 carbon atoms are preferable. Specifically, phenyl, 2-methylphenyl, 3-methylphenyl, 4-methylphenyl, 2-chlorophenyl, 2,5-t-amylphenyl and the like are preferable.

In the general formula (I), the acyl group represented by $R^{51}$ and $R^{52}$ includes unsubstituted acyl groups and acyl groups having a substituent. As the acyl group represented by $R^{51}$ and $R^{52}$, acyl groups having 1 to 30 carbon atoms are preferable, acyl groups having 1 to 10 carbon atoms are more preferable. Specifically, acetyl, propanoyl, butanoyl, benzonoyl and the like are preferable.

In the general formula (I), $R^5$ represents any group selected from the group consisting of a hydrogen atom, alkyl groups, aryl groups, —$COOR^{53}$, —$CONR^{53}R^{54}$, —$SO_2R^{53}$—$SO_2NR^{53}R^{54}$ and —$COR^{53}$.

In the general formula (I), the alkyl group represented by $R^5$ include unsubstituted alkyl groups and alkyl groups having a substituent, and the alkyl group may be linear or branched, and may have an unsaturated bond. As the alkyl group represented by $R^5$, alkyl groups having 1 to 30 carbon atoms are preferable. Specifically, methyl, ethyl, n-propyl, i-propyl, n-butyl, i-butyl, 2-butyl, t-butyl, n-hexyl, n-octyl, 2-ethylhexyl, 3,5,5-trimethylhexyl, dodecyl, 2-chloroethyl, 2-methanesulfonylethyl, 2-methoxyethyl, 2-methoxypropyl, 2-benzoyloxyethyl, N,N-dibutylcarbamoylmethyl, 2-ethoxycarbonylethyl, butoxyxarbonylmethyl, octyloxycarbonylmethyl, cyclohexyl, 2-isopropyloxyethyl, 2-(2,5-di-t-amylphenoxy)ethyl, 2-phenoxyethyl, 1-(4-methoxyphenoxy)-2-propyl, 1-(2,5-di-t-amylphenoxy)-2-propyl, benzyl, α-methylbenzyl, phenetyl, 3-phenylpropyl, allyl, methallyl, trichloromethyl, trifluoromethyl, 2,2,2-trifluoroethyl and the like are preferable.

In the general formula (I), when $R^5$ represents an aryl group, unsubstituted aryl groups and aryl groups having a substituent are included. As the aryl group represented by $R^5$, aryl groups having 6 to 30 carbon atoms are preferable. Specifically, phenyl, 2-methylphenyl, 3-methylphenyl, 4-methylphenyl, 4-ethylphenyl, 4-isopropylphenyl and the like are preferable.

In the general formula (I), when $R^5$ represents —$COOR^{53}$, —$CONR^{53}R^{54}$, $SO_2R^{53}$, —$SO_2NR^{53}R^{54}$ or $COR^{53}$, $R^{53}$ and $R^{54}$ each independently represent any group selected from the group consisting of a hydrogen atom, alkyl groups, aryl groups and acyl group.

In the general formula (I), the alkyl group represented by $R^{53}$ and $R^{54}$ includes unsubstituted alkyl groups and alkyl groups having a substituent. As the alkyl group represented by $R^{53}$ and $R^{54}$, alkyl groups having 1 to 30 carbon atoms are preferable, and alkyl groups having 1 to 10 carbon atoms are more preferable. Specifically, methyl, ethyl, i-propyl, s-butyl, t-butyl, t-amyl and the like are preferable.

In the general formula (I), the aryl group represented by $R^{53}$ and $R^{54}$ includes unsubstituted aryl groups and aryl groups having a substituent. As the aryl group represented by $R^{53}$ and $R^{54}$, aryl groups having 6 to 30 carbon atoms are preferable. Specifically, phenyl, 2-methylphenyl, 3-methylphenyl, 4-methylphenyl, 2-chlorophenyl, 2,5-t-amylphenyl and the like are preferable.

In the general formula (I), the acyl group represented by $R^{53}$ and $R^{14}$ includes unsubstituted acyl groups and acyl groups having a substituent. As the acyl group represented by $R^{51}$ and $R^{52}$, acyl groups having 1 to 30 carbon atoms are preferable, acyl groups having 1 to 10 carbon atoms are more preferable. Specifically, acetyl, propanoyl, butanoyl, benzonoyl and the like are preferable.

As the specific examples of the diazo compound of the above-described general formula (I), specific examples 1 to 28 are listed below including exemplary compounds (A-1 to A-42) and combination of substituents $R^1$ to $R^5$ in the general formula (I), and the diazo compound used in a yellow heat-sensitive recording layer is not limited to the following compounds.

A-1

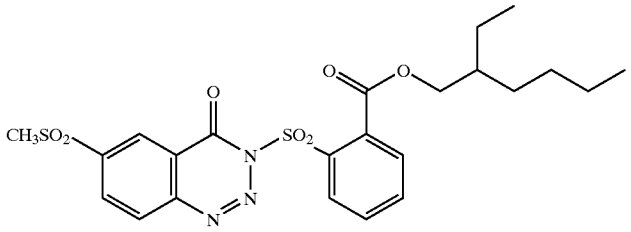

A-2

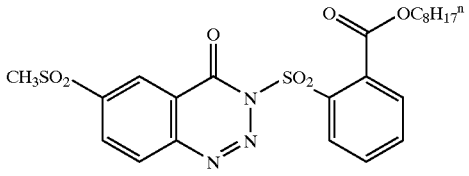

A-3

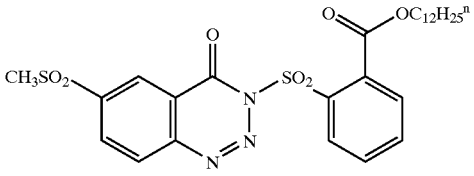

-continued
A-4
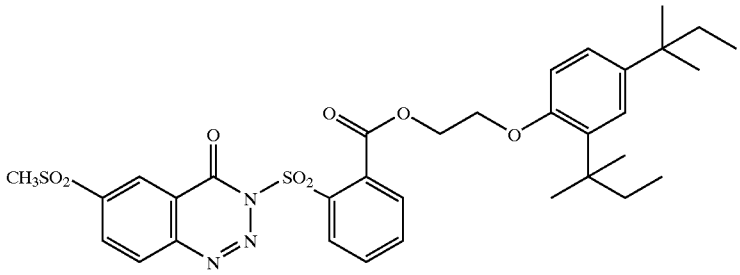
A-5
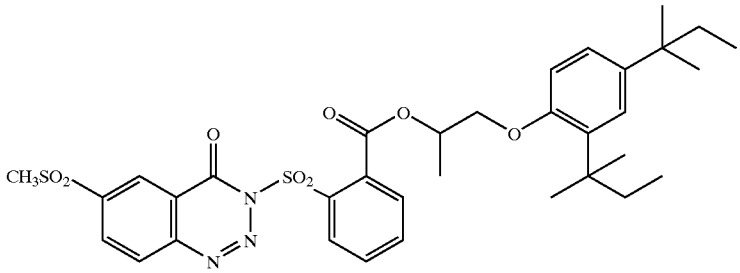
A-6
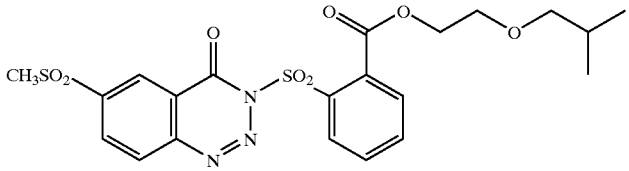
A-7
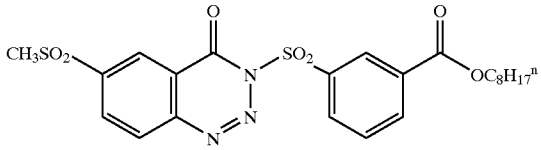
A-8
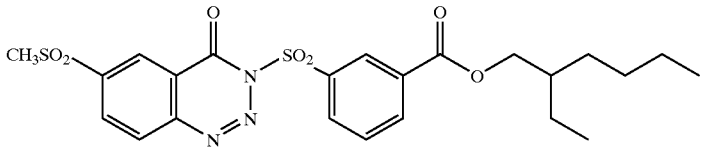
A-9
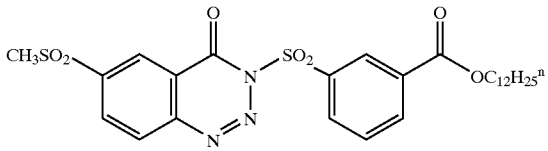
A-10
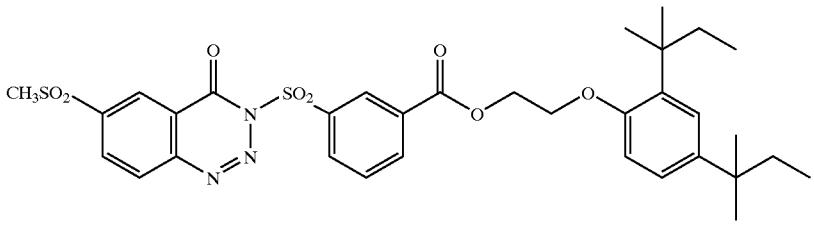
A-11
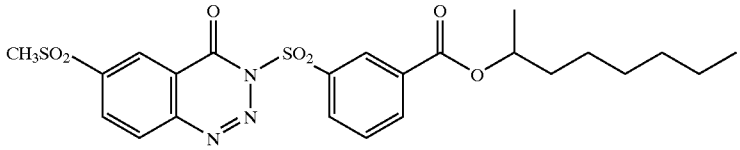

-continued
A-12
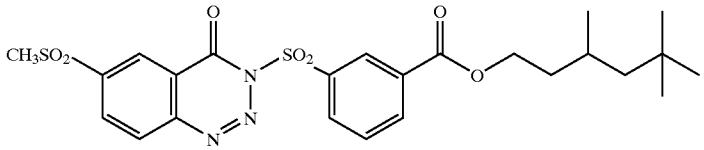
A-13
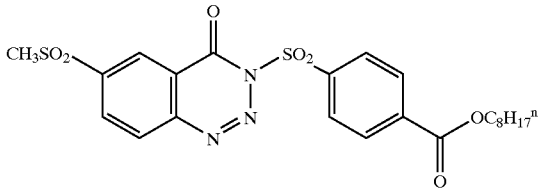
A-14
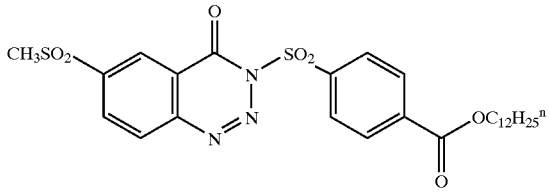
A-15
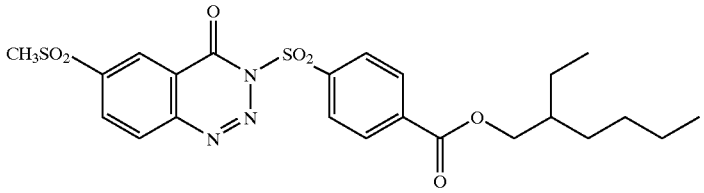
A-16
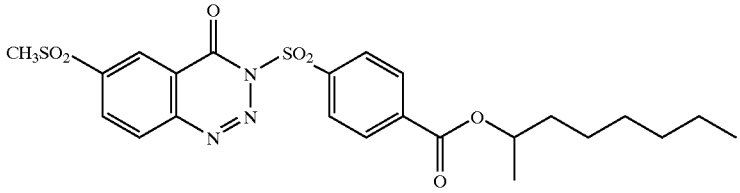
A-17
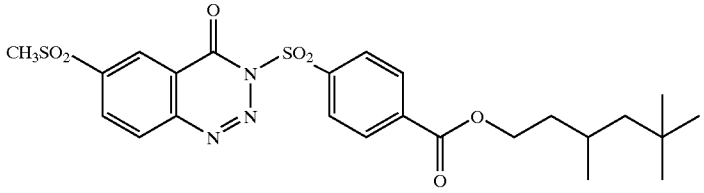
A-18
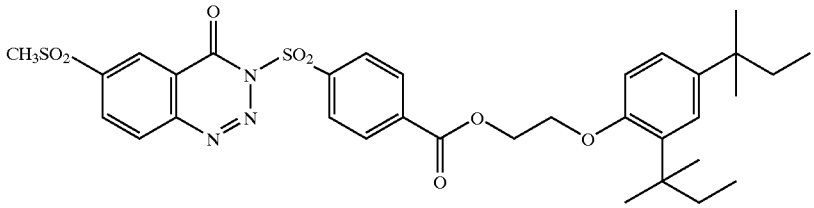
A-19
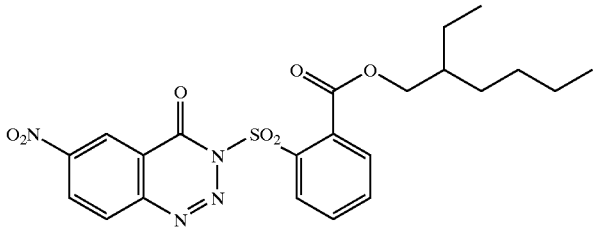
A-20
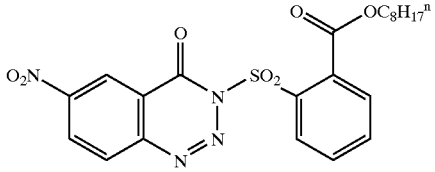
A-21
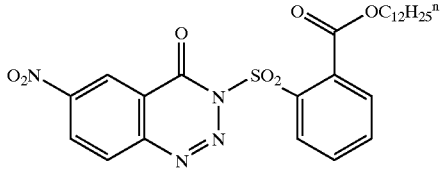

-continued
A-22
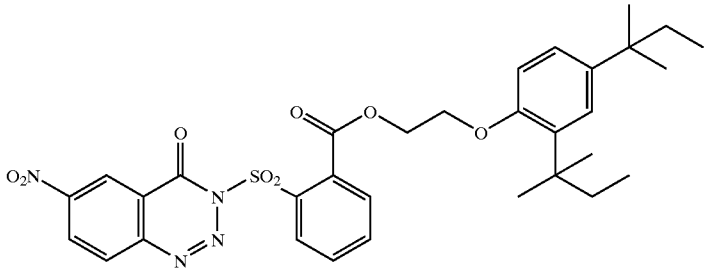
A-23
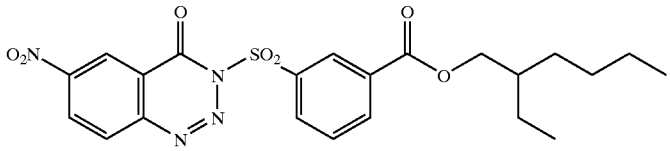
A-24
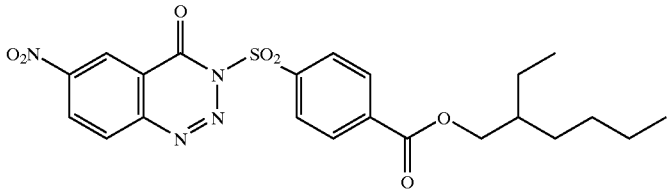
A-25
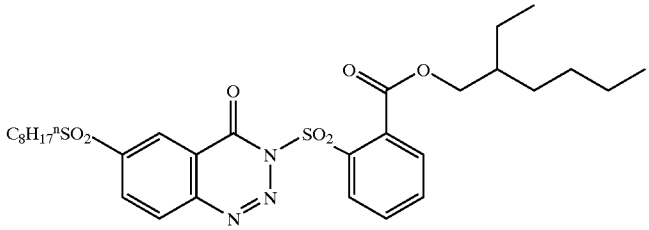
A-26
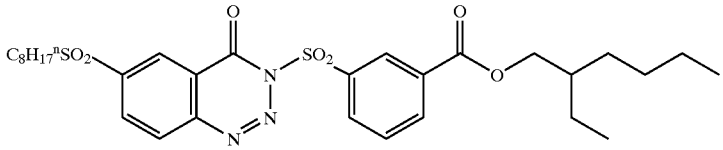
A-27
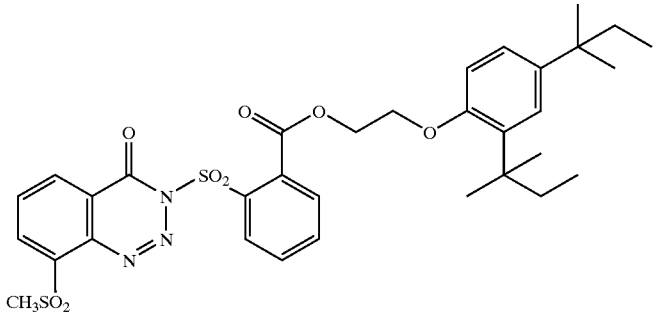
A-28
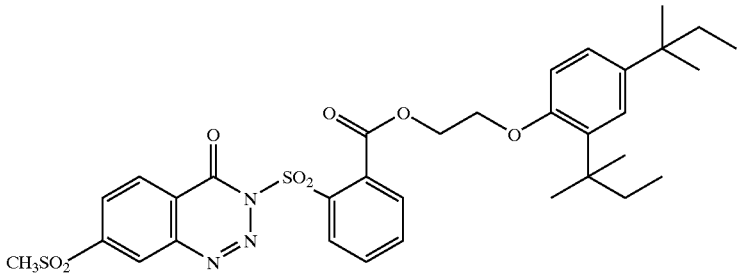

-continued
A-29
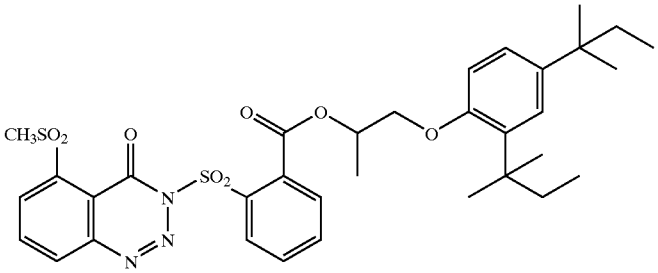
A-30
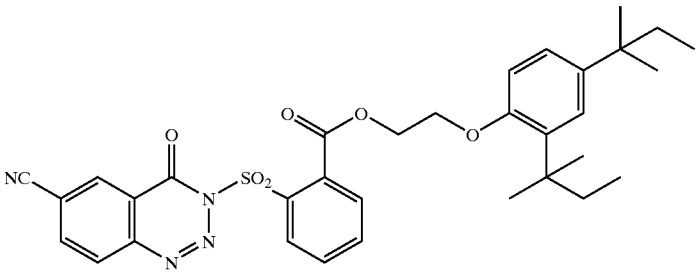
A-31
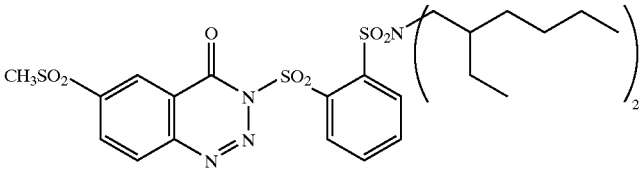
A-32
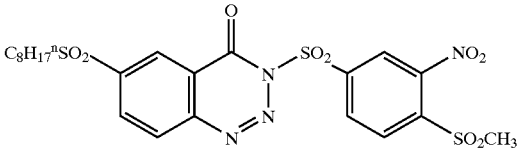
A-33
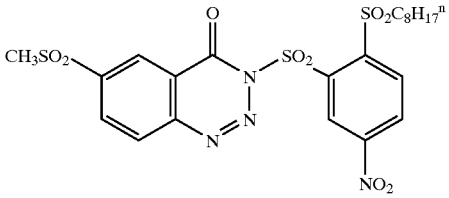
A-34
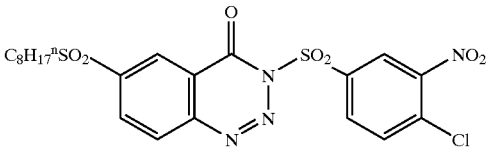
A-35
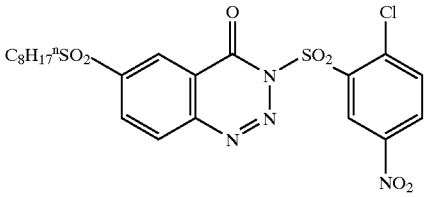
A-36
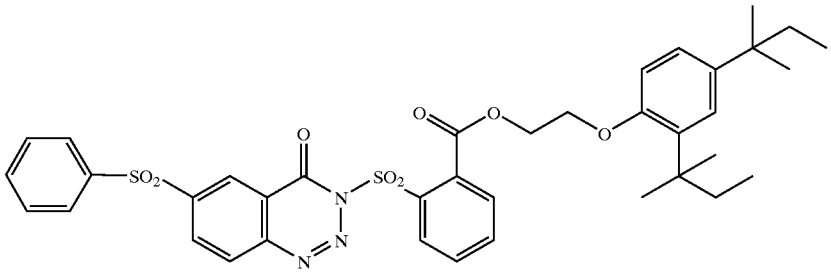

-continued
A-37
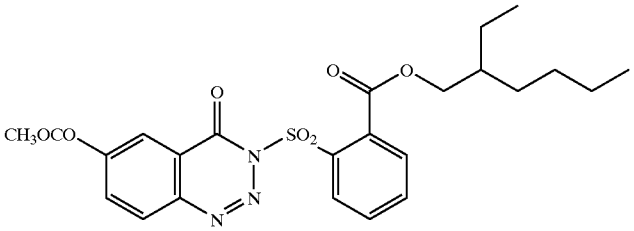
A-38
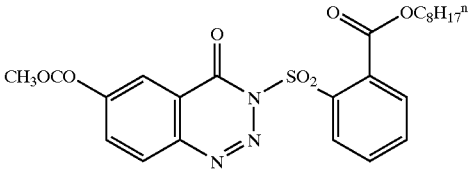
A-39
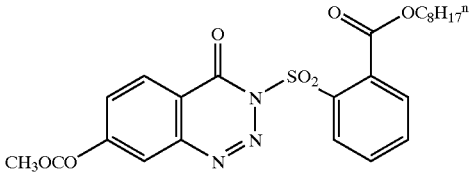
A-40
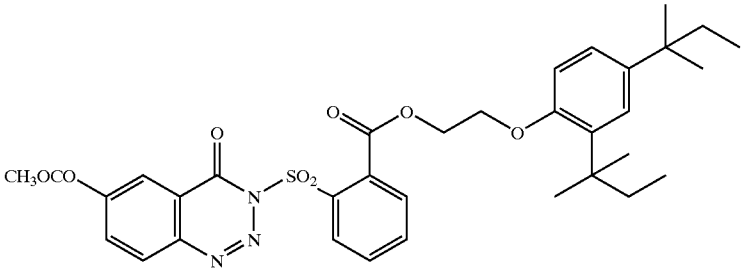
A-41
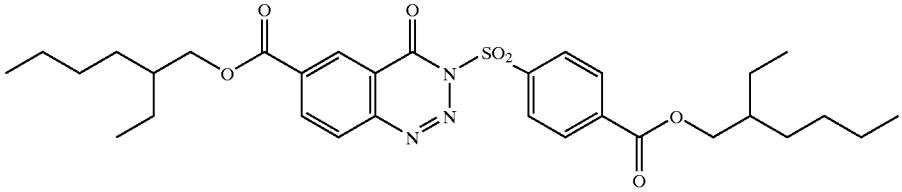
A-42
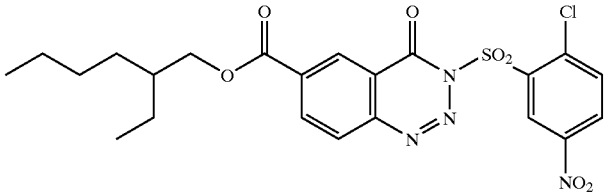
General formula (I)
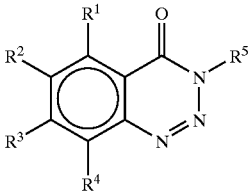
| | $R^1$ | $R^2$ | $R^3$ | $R^4$ | $R^5$ |
|---|---|---|---|---|---|
| 1 | —H | 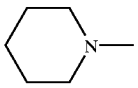 | H— | —H | 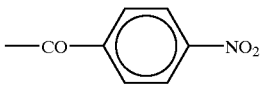 |

-continued
General formula (I)
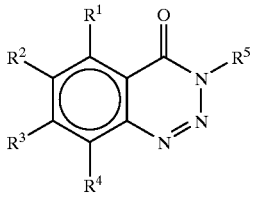
| | $R^1$ | $R^2$ | $R^3$ | $R^4$ | $R^5$ |
|---|---|---|---|---|---|
| 2 | —H | 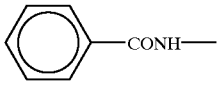 | H— | —H | 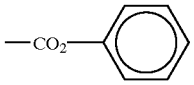 |
| 3 | —H | 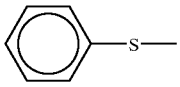 | $C_4H_9O$— | —H | 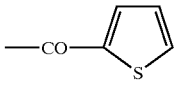 |
| 4 | —H | 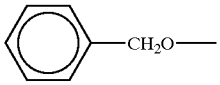 | 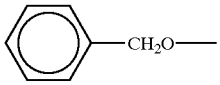 | —H | 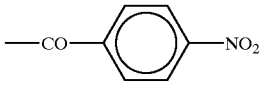 |
| 5 | —H | 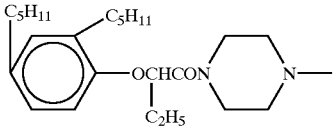 | H— | —H | 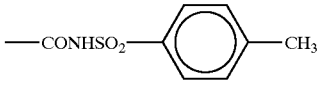 |
| 6 | —H | $C_6H_{13}$ O— | $C_6H_{13}$ O— | —$OC_6H_{13}$ | 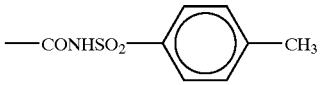 |
| 7 | —H | 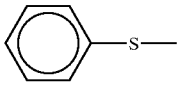 | H— | —H | 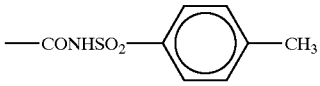 |
| 8 | —H | 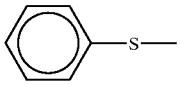 | $C_8H_{17}O$— | —H | 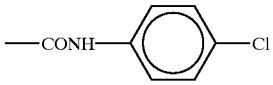 |
| 9 | —H | 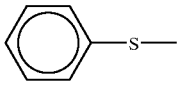 | H— | —H | 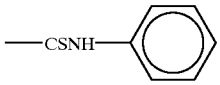 |
| 10 | —H | H— | H— | —H | 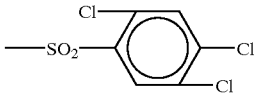 |
| 11 | —H | 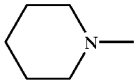 | H— | —H | 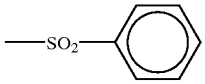 |
| 12 | —H | 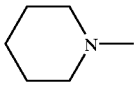 | H— | —H | 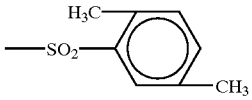 |
| 13 | —H | $(C_8H_{17})_2N$— | H— | —H | —$SO_2CH_3$ |

-continued
General formula (I)
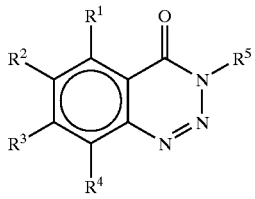
| | $R^1$ | $R^2$ | $R^3$ | $R^4$ | $R^5$ |
|---|---|---|---|---|---|
| 14 | —H | 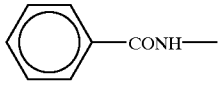 | H— | —H | $—SO_2C_8H_{17}$ |
| 15 | —H | $CH_3CONH—$ | H— | —H | 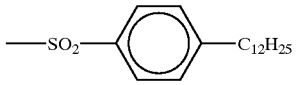 |
| 16 | —H | 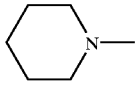 | $C_4H_9O—$ | —H | 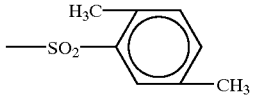 |
| 17 | —H | 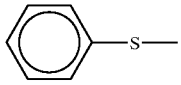 | H— | —H | 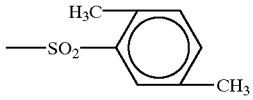 |
| 18 | —H | 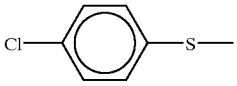 | H— | —H | 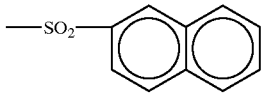 |
| 19 | —H | 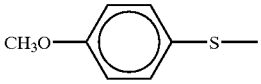 | H— | —H | 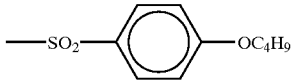 |
| 20 | —H | 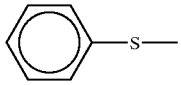 | $C_4H_9O—$ | —H | 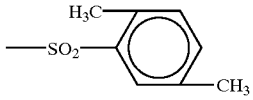 |
| 21 | —H | 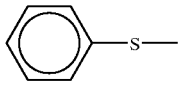 | $CH_2{=}CHCH_2O—$ | —H | 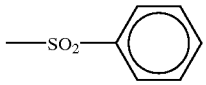 |
| 22 | —H | 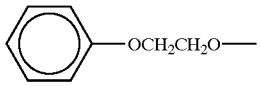 | H— | —H | 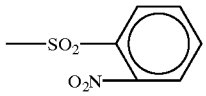 |
| 23 | —H | $C_4H_9O—$ | $C_4H_9O—$ | —H | 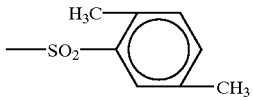 |
| 24 | —H | $C_6H_{13}O—$ | $C_6H_{13}O—$ | $—OC_6H_{13}$ | 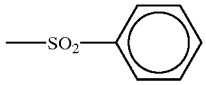 |
| 25 | —H | $C_8H_{17}O—$ | H— | $—OC_8H_{17}$ | 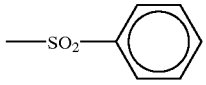 |

-continued

General formula (I)

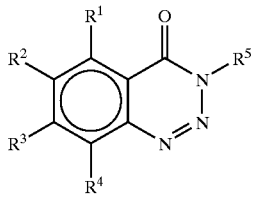

| | $R^1$ | $R^2$ | $R^3$ | $R^4$ | $R^5$ |
|---|---|---|---|---|---|
| 26 | —H | Cl— | $C_8H_{17}$—O— | —H | —PO(O—)$_2$ |
| 27 | —H | $C_8H_{17}O$— | $CH_3$— | —$OC_8H_{17}$ | —$SO_2$—$CH_3$ |
| 28 | —$CONH_2$ | H— | $C_{12}H_{25}O$— | —H | —$SO_2$— |

The above-mentioned yellow heat-sensitive recording layer may advantageously contain at least one diazo compound of the above-mentioned general formula (I), and two or more compounds may be combined. Further, these compounds may be used together with other diazo compounds. The diazo compound of the above-mentioned general formula (I) is contained in the above-mentioned heat-sensitive recording layer in an amount preferably of 0.02 to 3 g/m$^2$, more preferably of 0.1 to 2 g/m$^2$. When the content is less than 0.02 g/m$^2$, color development is not preferable, and when over 3 g/m$^2$, applied thickness is not preferable.

The compound of the above-mentioned general formula (I) is preferably used together with an aromatic hydrocarbon. As the above-mentioned aromatic hydrocarbon, those having 12 to 50 carbon atoms, preferably 12 to 25 carbon atoms are preferably used from the standpoints of solubility, handling in use form, and the like. As the above-mentioned aromatic hydrocarbon, those of the following general formula (II) are preferable:

General Formula (II)

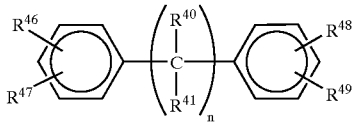

In the general formula (II), $R^{40}$ to $R^{49}$ each independently represent a hydrogen atom or alkyl group, and n represents an integer of from 0 to 3. $R^{46}$ and $R^{47}$, $F^{48}$ and $R^{49}$, and $R^{40}$ and $R^{41}$ may be mutually connected to form rings. When $R^{40}$ to $R^{49}$ represent an alkyl group, the above-mentioned alkyl groups may be linear or branched, and may have an unsaturated bond. Further, substitution positions of $R^{40}$ to $R^{49}$ are not particularly restricted.

In the general formula (II), as $R^{46}$ to $R^{49}$, a hydrogen atom and alkyl groups having 1 to 9 carbon atoms are preferable and as $R^{40}$ and $R^{41}$, a hydrogen atom and a methyl group are preferable. n represents preferably 0 or 1.

Examples of the above-mentioned aromatic hydrocarbon include, but are not limited to, the following compounds.

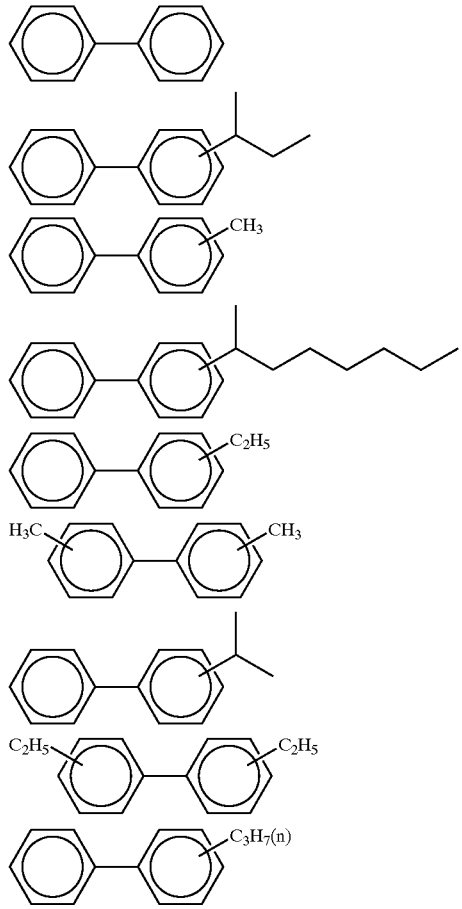

-continued

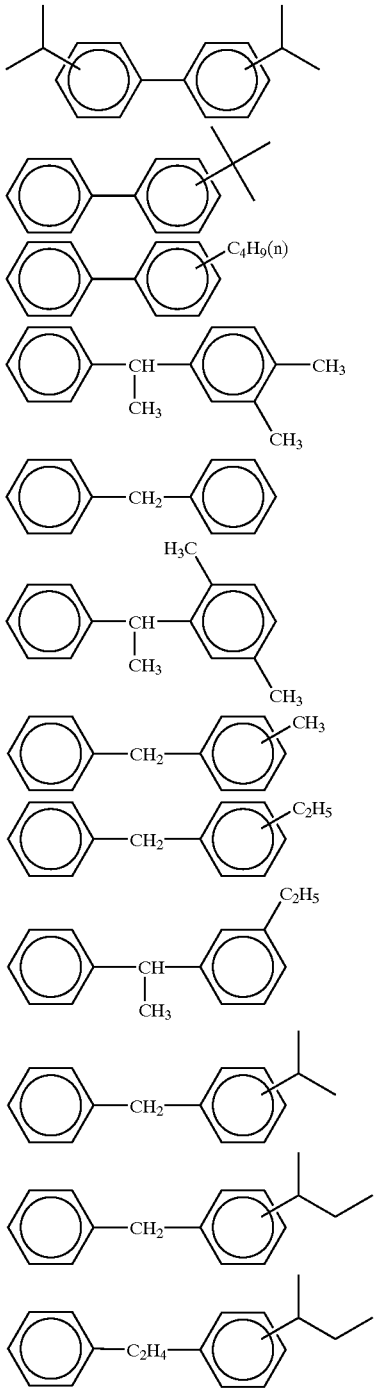

The above-mentioned aromatic hydrocarbon can be used alone or in combination of two or more.

Next, the coupler to be reacted with the above-mentioned diazo compound to develop color will be described.

As the coupler which can be used in a yellow heat-sensitive recording layer, any compound can be used providing it couples with a diazo compound in a basic atmosphere to form a coloring matter. So-called tetra-equivalent couplers known in the field of a halogenated silver photography photosensitive material can all be used as a coupler in a yellow heat-sensitive recording layer, and can be selected depending on the intended yellow hue.

As the known coupler which can be used in a yellow heat-sensitive recording layer, so-called methylene compounds having a methylene group adjacent to a carbonyl group, phenol derivatives, naphthol derivatives and the like are mentioned for example, and specifically, the following compounds are listed and used in a range corresponding to the object of the invention.

Specific examples of the above-mentioned known coupler include resorcin, phloroglucin, sodium 2,3-dihydroxynaphthalene-6-sulfonate, sodium 2-hydroxy-3-naphthalenesulfonate, 2-hydroxy-3-naphthalenesulfonic anilide, 1-hydroxy-2-naphthoic morpholinopropylamide, 2-hydroxy-3-naphthalenesulfonic morpholinopropylamide, 2-hydroxy-3-naphthalenesulfonic 2-ethylhexyloxypropylamide, 2-hydroxy-3-naphthalenesulfonic 2-ethylhexylamide, 5-acetamide-1-naphthol, sodium 1-hydroxy-8-acetamidenaphthalene-3,6-disulfonate, 1-hydroxy-8-acetamidenaphthalene-3,6-disulfonic dianilide, 1,5-dihydroxynaphthalene, 2,3-dihydroxynaphthalene, 2-hydroxy-3-naphthoic morpholinopropylamide, 2-hydroxy-3-naphthoic octylamide, 2-hydroxy-3-naphtholic anilide, 5,5-dimethyl-1,3-cyclohexanedione, 1,3-cyclopentanedione, 5-(2-n-tetradecyloxyphenyl)-1,3-cyclohexanedione, 5-phenyl-4-methoxycarbonyl-1,3-cyclohexanedione, 5-(2,5-di-n-octyloxyphenyl) -1,3-cyclohexanedione, 1,3-dicyclohexylbarbituric acid, 1,3-di-n-dodecylbarbituric acid, 1-n-octyl-3-n-octadecylbarbituric acid, 1-phenyl-3-(2,5-di-n-octyloxyphenyl)barbituric acid, 1,3-bis(octadecyloxycarbonylmethyl)barbituric acid, 1-phenyl-3-methyl-5-pyrazolone, 1-(2,4,6-trichlorophenyl)-3-anilino-5-pyrazolone, 1-(2,4,6-trichlorophenyl)-3-benzamide-5-pyrazolone, 6-hydroxy-4-methyl-3-cyano-1-(2-ethylhexyl)-2-pyridone, 2-[3-[a-(2,4-di-tert-alumiphenoxy)butaneamide]benzamide]phenol, 2,4-bis-(benzoylacetamide)toluene, 1,3-bis-(pivaloylacetaminomethyl)benzene, benzoylacetonitrile, thenoylacetonitrile, acetacetanilide, benzoylacetanilide, pyvaloylacetanilide, 2-chloro-5-(N-n-butylsulfamoyl)-1-pivaloylacetamidebenzene, 1-(2-ethylhexyloxypropyl)-3-cyano-4-methyl-6-hydroxy-1,2-dihydropyridin-2-one, 1-(dodecyloxypropyl)-3-acetyl-4-methyl-6-hydroxy-1,2-dihydropyridin-2-one, 1-(4-n-octyloxyphenyl)-3-tert-butyl-5-aminopyrazole, trifluoroacetacetanilide, 4-hydroxycoumarin, pyrazolo[1,5-a]pyrimidinedione, 3-ethyl-6-ethoxyuracil and the like.

Details of the coupler are described in JP-A Nos. 4-201483, 7-125446, 7-96671, 7-223367, 7-223368 and the like.

Further, as the coupler which can be used in a yellow heat-sensitive recording layer, compounds of the following general formula (III) are particularly preferable. Couplers of the general formula (III) are described in detail below.

$$E^1—CH_2—E^2 \qquad \text{General formula (III)}$$

In the general formula (III), the electron-attractive groups $E^1$, $E^2$ represent a substituent having positive Hammett's $\sigma_p$ value and they may be the same and may be different from each other, and preferable are acyl groups such as an acetyl group, propionyl group, pivaloyl group, chloroacetyl group, trifluoroacetyl group, 1-methylcyclopropylcarbonyl group, 1-ethylcyclopropylcarbonyl group, 1-benzylcylopropylcarbonyl group, benzoyl group, 4-methoxybenzoyl group, a thenoyl group and the like, oxycarbonyl groups such as a methoxycarbonyl group, ethoxycarbonyl group, 2-methoxyethoxycarbonyl group, 4-methoxyphenoxycarbonyl group and the like, carbamoyl groups such as a carbamoyl group, N,N-dimethylcarbamoyl group, N,N-diethylcarbamoyl group, N-phenylcarbamoyl group, N-2,4-bis(pentyloxy)phenylcarbamoyl group, N-2,4-bis(octyloxy)phenylcarbamoyl group, morpholinocarbonyl group and the like, cyano group, sulfonyl groups such as a methanesulfonyl group, benzenesulfonyl group, toluenesulfonyl group and the like, phosphono groups such as a diethylphosphono group and the like, and heterocyclic groups such as benzooxazol-2-yl group, benzothiazol-2-yl group, 3,4-dihydroquinazolin-4-on-2-yl group, 3,4-dihydroquinazolin-4-sulfon-2-yl group and the like.

In the general formula (III), electron-attractive groups $E^1$, $E^2$ may be bonded to form a ring. As the ring formed by $E^1$, $E^2$, 5- to 6-membered carbon rings or heterocyclic rings are preferable.

Specific examples of the coupling component of the general formula (III) of the present invention include, but are not limited to, the following compounds.

C-1

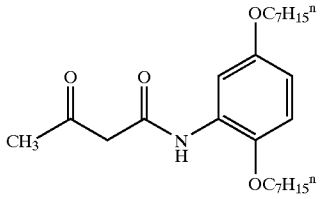

C-2

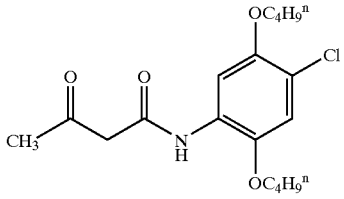

C-3

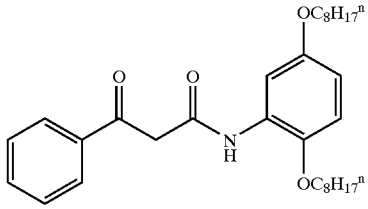

C-4

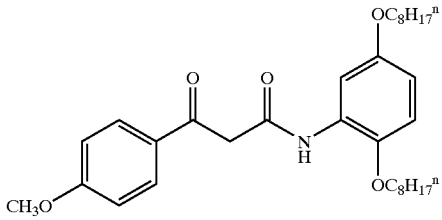

-continued

C-5

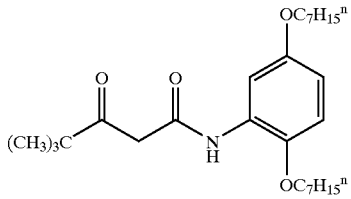

C-6

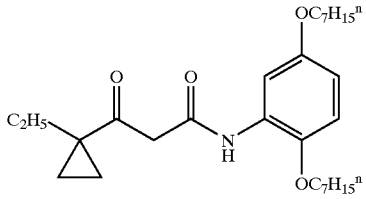

C-7

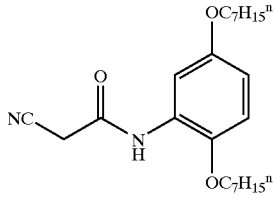

C-8

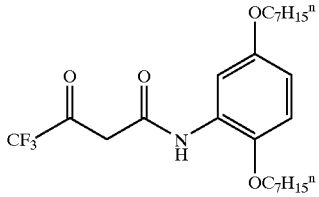

C-9

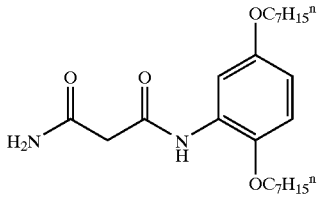

C-10

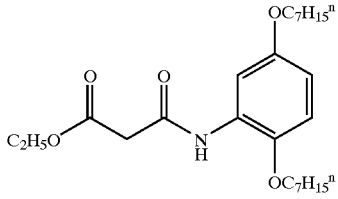

C-11

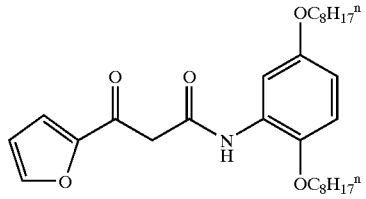

-continued
C-12
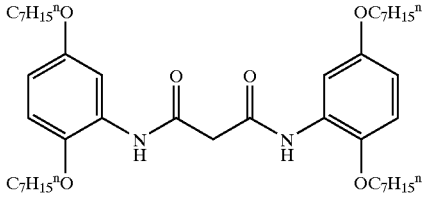
C-13
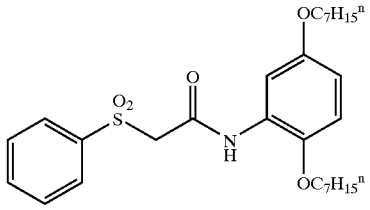
C-14
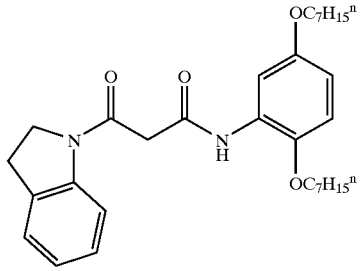
C-15
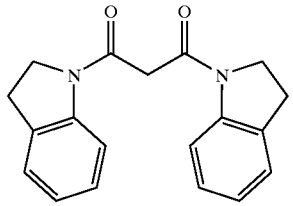
C-16
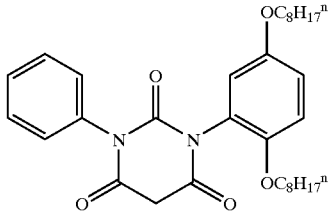
C-17
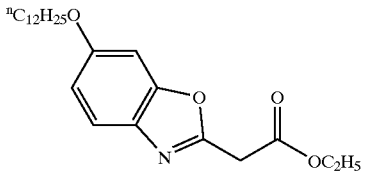
C-18
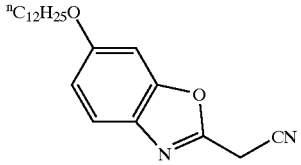
-continued
C-19
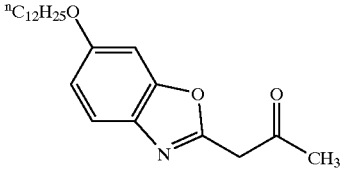
C-20
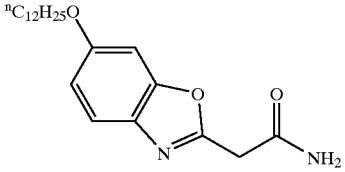
C-21
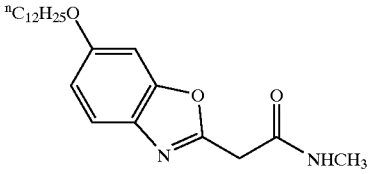
C-22
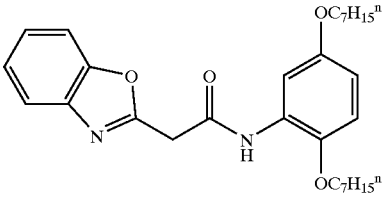
C-23
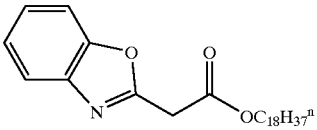
C-24
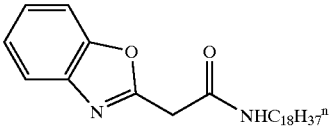
C-25
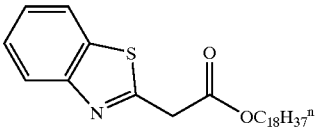
C-26
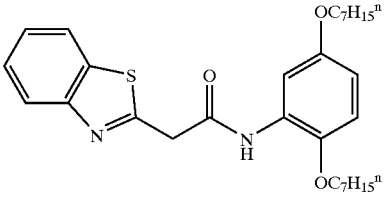
C-27
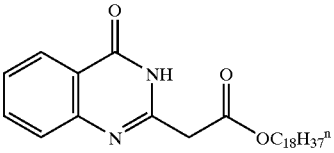

-continued
C-28
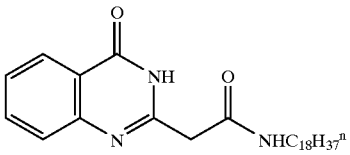
C-29
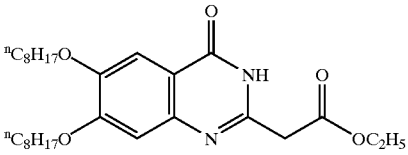
C-30
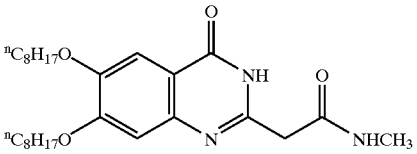
C-31
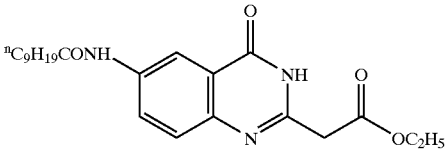
C-32
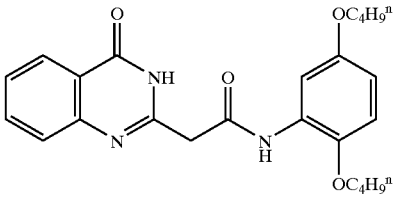
C-33
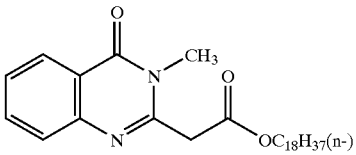
C-34
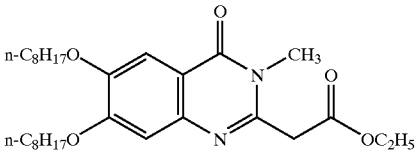
C-35
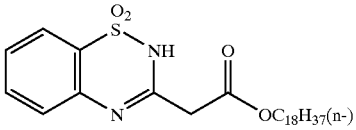
C-36
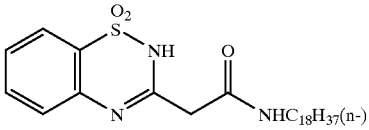
-continued
C-37
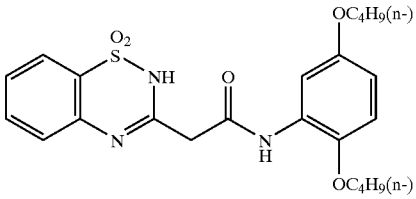
C-38
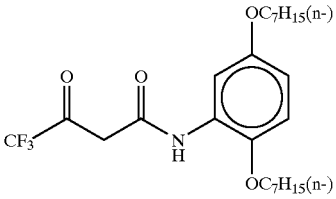
C-39
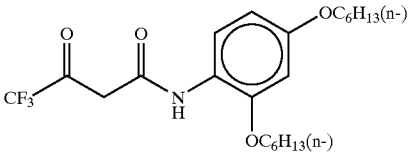
C-40
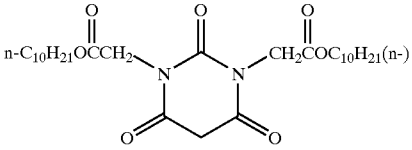
C-41
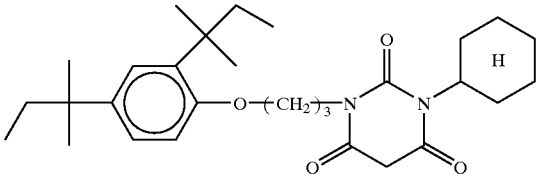
C-42
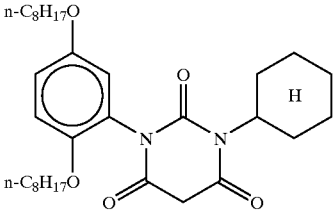
C-43
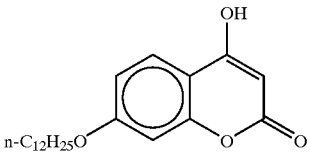
C-44
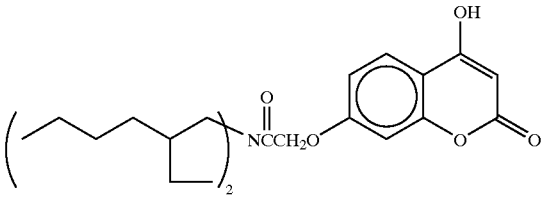

-continued
C-45
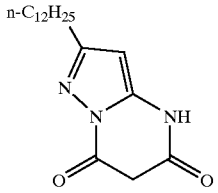
C-46
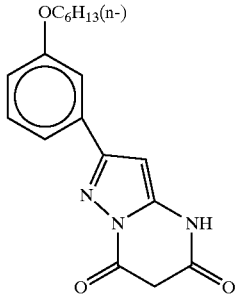
C-47
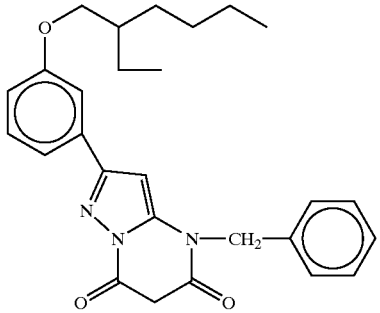
C-48
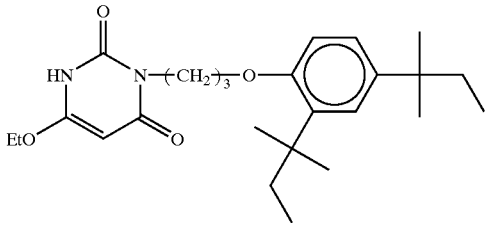
C-49
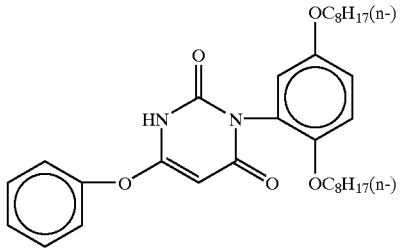
(C-50)
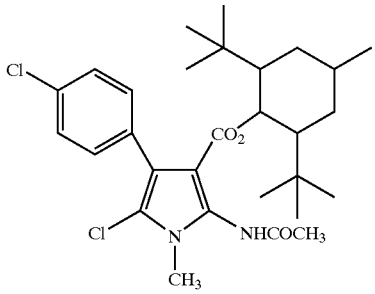
-continued
(C-51)
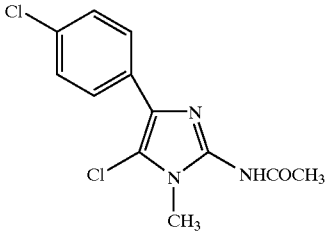
(C-52)
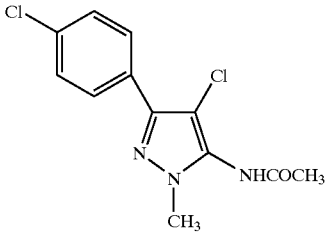
(C-53)
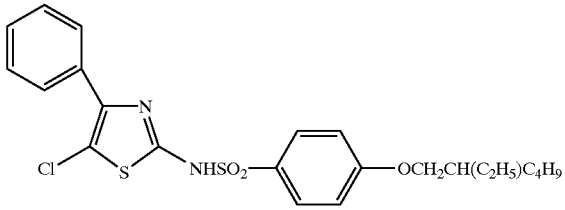
(C-54)
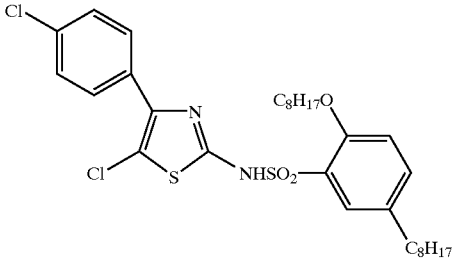
(C-55)
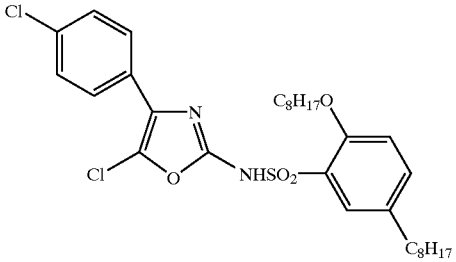
(C-56)
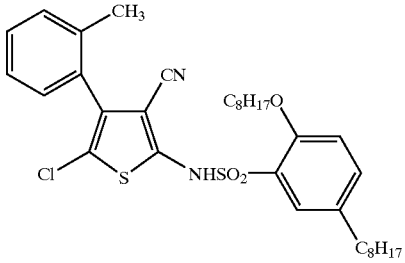

-continued
(C-57)
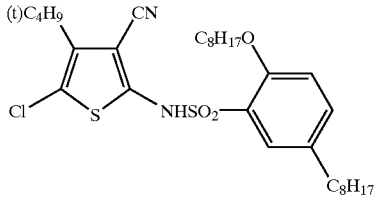
(C-58)
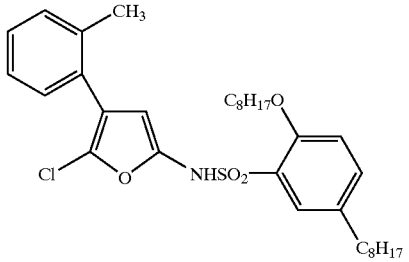
(C-59)
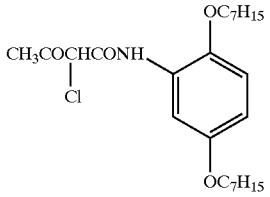
(C-60)
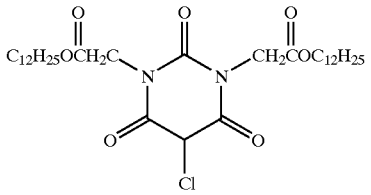
(C-61)
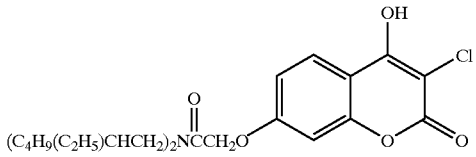
(C-62)
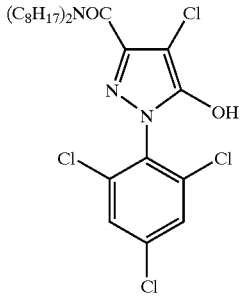
(C-63)
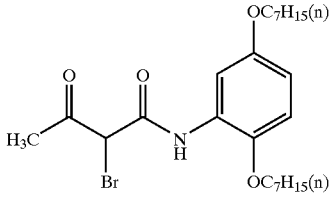
-continued
(C-64)
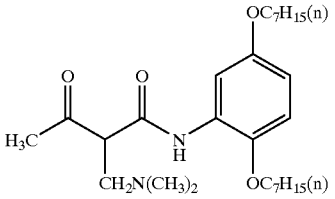
(C-65)
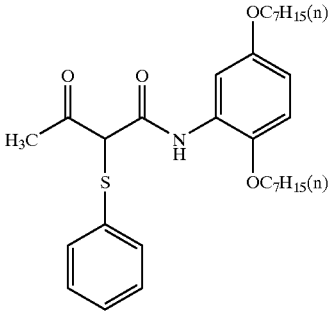
(C-66)
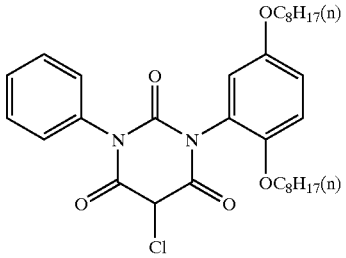
(C-67)
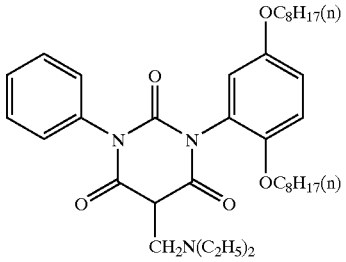
(C-68)
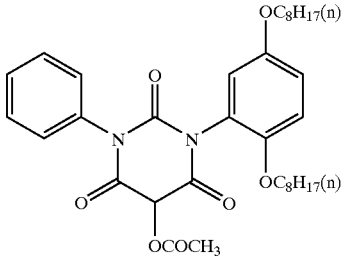
(C-69)
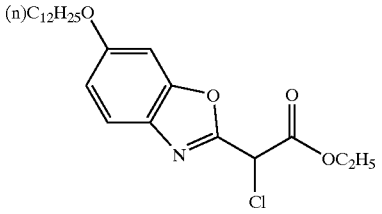

-continued (C-70)

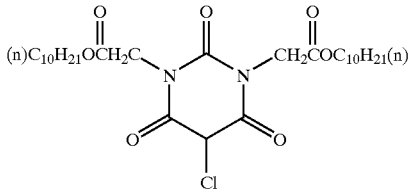

(C-71)

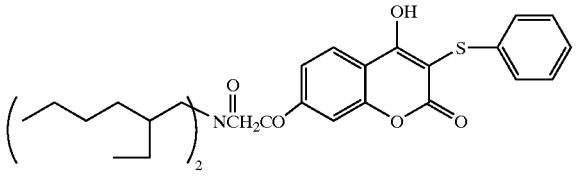

(C-72)

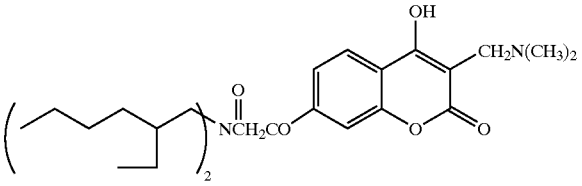

(C-73)

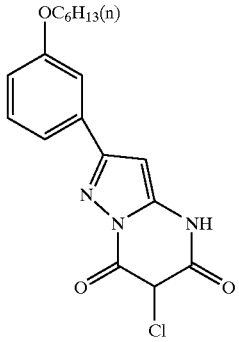

In the yellow heat-sensitive recording layer, the addition amount of all couplers is preferably from 1 to 10 mol per mol of the addition amount of diazo compounds in the yellow heat-sensitive recording layer, and preferably from 2 to 5 mol per mol from the standpoint of effect.

When the above-mentioned addition amount is less than 1 mol per mol based on the addition amount of diazo compounds, sufficient color development may not be obtained, and when over 10 mol per mol, color development may likewise decrease, further, applied thickness is also not preferable.

Cyan Heat-sensitive Recording Layer

In the heat-sensitive recording material of the present invention, the cyan heat-sensitive recording layer is provided between the yellow heat-sensitive recording layer and the magenta heat-sensitive recording layer. The maximum absorption wavelength λmax of a diazo compound or the like used in a cyan heat-sensitive recording layer is preferably from 340 to 400 nm, more preferably from 360 to 390 nm from the standpoint of the effect. If the diazo compound or the like has λmax at a longer wavelength than the above-mentioned wavelength range, a diazo compound or the like may be deactivated in some cases by light irradiation in fixing an upper layer, and if the diazo compound or the like has λmax at a shorter wavelength than the above-mentioned wavelength range, image fixing property, image storage property, and violet-to-cyan developing hue may deteriorate depending on combination with a coupler.

As the diazonium salt which can be used in the cyan heat-sensitive recording layer, compounds of:

$$Ar—N_2^+.X^-$$

in which Ar represents an aromatic moiety, and $X^-$ represents an acid anion are preferable. A coupling reaction with a coupler is caused by heating to develop color, and decomposition and deactivation are caused by light. The maximum absorption wavelength of them can be controlled by the position and kind of a substituent at the Ar part.

Specific examples of the diazonium forming a salt include 4-(p-tolylthio)-2,5-dibutoxybenzenediazonium, 4-(4-chlorophenylthio)-2,5-dibutoxybenzenediazonium, 4-(N,N-dimethylamino)benzenediazonium, 4-(N,N-diethylamino)benzenediazonium, 4-(N,N-dipropylamino)benzenediazonium, 4-(N-methyl-N-benzylamino)benzenediazonium, 4-(N,N-dibenzylamino)benzenediazonium, 4-(N-ethyl-N-hydroxyethylamino)benzenediazonium, 4-(N,N-diethylamino)-3-methoxybenzenediazonium, 4-(N,N-dimethylamino)-2-methoxybenzenediazonium, 4-(N-benzoylamino)-2,5-diethoxybenzenediazonium, 4-morpholino-2,5-dibutoxybezenediazonium, 4-anilinobenzenediazonium, 4-[N-(4-methoxybenzyl)amino]-2,5-diethoxybenzenediazonium, 4-pyrrolidino-3-ethylbenzenediazonium, 4-[N-(1-methyl-2-(4-methoxyphenoxy)ethyl)-N-hexylamino]-2-hexyloxybenzenediazonium, 4-[N-(2-(4-methoxyphenoxy)ethyl)-N-hexylamino]-2-hexyloxybenzenediazonium, 2-(1-ethylpropyloxy)-4-[di-(d-n-butylaminocarbonylmethyl)amino]benzenediazonium and the like.

Among the above-mentioned diazonium salts, diazonium salts of the following general formula (A), general formula (B) and general formula (C) are preferable from the standpoints of the hue of a coloring matter, image storage property and image fixing property:

General formula (A)

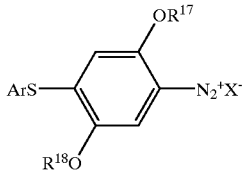

General formula (B)

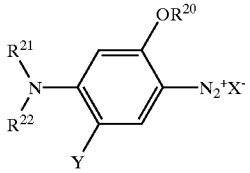

General formula (C)

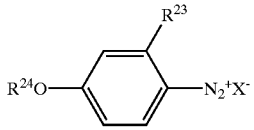

In the above-mentioned general formula (A), Ar represents a substituted or unsubstituted aryl group. $R^{17}$ and $R^{18}$ each independently represent a substituted or unsubstituted alkyl group, or a substituted or unsubstituted aryl group, and may be the same and may be different from each other.

As the substituent, alkyl groups, alkoxy groups, alkylthio groups, aryl groups, aryloxy groups, arylthio groups, acyl groups, alkoxycarbonyl groups, carbamoyl groups, carboamide groups, sulfonyl groups, sulfamoyl groups, sulfoneamide groups, ureide groups, halogen groups, amino groups, hetero ring groups and the like are listed, and these substituents may be further substituted.

In the above-mentioned general formula (B), $R^{20}$, $R^{21}$ and $R^{22}$ each independently represent a substituted or unsubstituted alkyl group or a substituted or unsubstituted aryl group and may be the same and may be different from each other. Y represents a hydrogen atom or $OR^{19}$ group. Here, $R^{19}$ represents a substituted or unsubstituted alkyl group or a substituted or unsubstituted aryl group.

As the substituent, alkyl groups, alkoxy groups, alkylthio groups, aryl groups, aryloxy groups, arylthio groups, acyl groups, alkoxycarbonyl groups, carbamoyl groups, carboamide groups, sulfonyl groups, sulfamoyl groups, sulfoneamide groups, ureide groups, halogen groups, amino groups, hetero ring groups and the like are listed.

Of them, Y preferably represents a hydrogen atom or an alkyloxy group in which $R^{19}$ is an alkyl group, from the standpoint of hue controlling.

In the above-mentioned general formula (C), $R^{23}$ and $R^{24}$ each independently represent a substituted or unsubstituted alkyl group or a substituted or unsubstituted aryl group. $R^{23}$ and $R^{24}$ may be the same and may be different from each other.

As the substituent, alkyl groups, alkoxy groups, alkylthio groups, aryl groups, aryloxy groups, arylthio groups, acyl groups, alkoxycarbonyl groups, carbamoyl groups, carboamide groups, sulfonyl gropes, sulfamoyl groups, sulfoneamide groups, ureide groups, halogen groups, amino groups, hetero ring groups and the like are listed.

In the above-mentioned general formulae (A) to (C), $X^-$ represent an acid anion, and as the acid anion, polyfluoroalkylcarboxylic acids having 1 to 9 carbon atoms, polyfluoroalkylsulfonic acids having 1 to 9 carbon atoms, boron tetrafluoride, tetraphenylboric acid, hexafluorophosphoric acid, aromatic carboxylic acids, aromatic sulfonic acids and the like are listed. Hexafluorophosphoric acid is preferable from the standpoint of crystallinity.

Specific examples of the diazonium salt of the general formula (A), general formula (B) and general formula (C) include, but are not limited to, the following compounds.

(A)-1

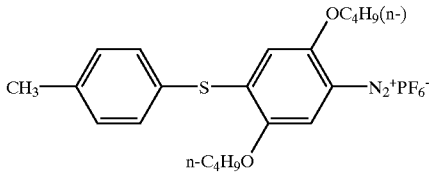

(A)-2

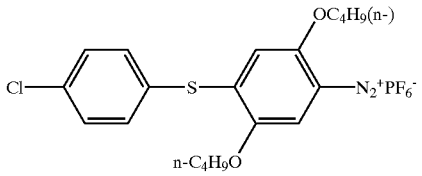

(A)-3

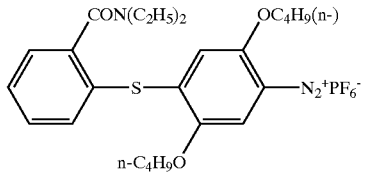

-continued (A)-4

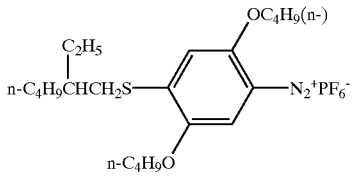

(B)-1

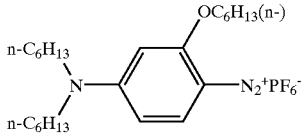

(B)-2

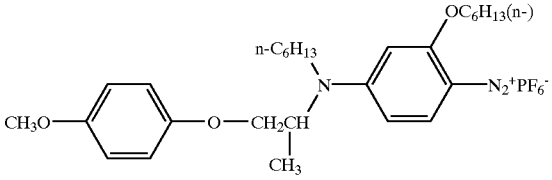

(B)-3

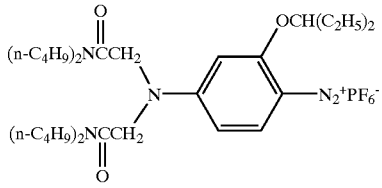

(B)-4

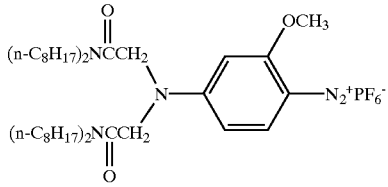

(B)-5

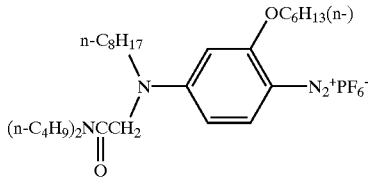

(B)-6

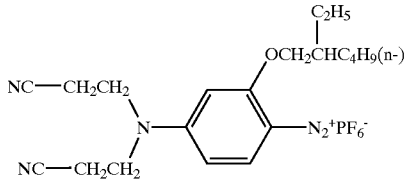

(B)-7

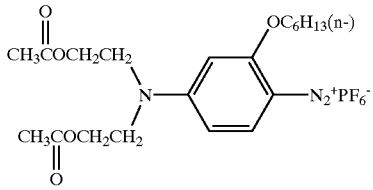

-continued (B)-8

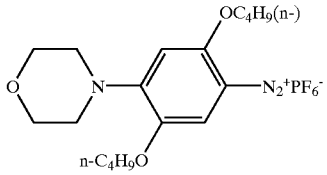

(B)-9

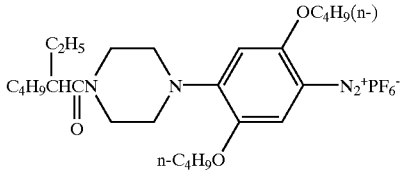

(B)-10

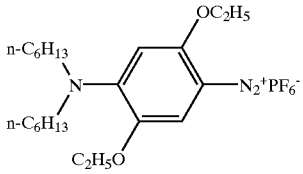

(C)-1

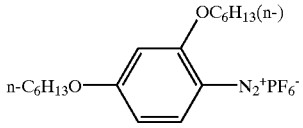

In the present invention, the diazonium salt of the above-mentioned general formulae (A) to (C) may be used alone or in combination of two or more. Further, the diazonium salt of the above-mentioned general formulae (A) to (C) and existent diazonium salts may be used together depending on various objects such as hue control and the like.

The content of a diazonium salt in the heat-sensitive recording material of the present invention is preferably from 0.02 to 3 g/m$^2$, more preferably from 0.1 to 2 g/m$^2$ in a heat-sensitive recording layer.

The cyan heat-sensitive recording layer preferably contains as a coupler at least one of compounds of the following general formula (D), compounds of the following general formula (E) and compounds of the following general formula (F). These couplers have a feature that when coupled with a diazonium salt, excellent cyan hue and sufficient color developed concentration are imparted and image storage property against light and heat is improved. Further, effects are found that a color-developing reaction occurs efficiently, Dmax is obtained with a small amount of a diazonium salt, and fixing sensitivity, stain and the like can also be reduced since the diazonium salt quantity can be decreased, and the like.

General formula (D)

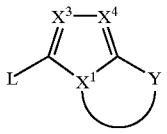

-continued

General formula (E)

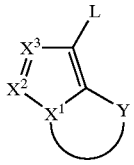

General formula (F)

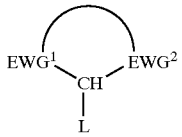

In the above-mentioned general formulae (D) to (F), $X^1$, $X^2$, $X^3$ and $X^4$ each independently represent an atomic group necessary for forming a 5-membered aromatic hetero ring. Y represents an amino group, substituted amino group, hydroxyl group, alkoxy group, or alkyl group optionally having a substituent. L represents a substituent which can leave upon coupling with a diazonium salt. $EWG^1$ and $EWG^2$ each independently represent an electron-attractive group. $X^1$ and Y, and $EWG^1$ and $EWG^2$ may be mutually connected to form a hetero ring.

Among compounds of the above-mentioned general formulae (D) to (F), a pyrrolopyrimidione compound of the following general formula (G) and a pyrrolotriazineone compound are particularly preferably listed.

General formula (G)

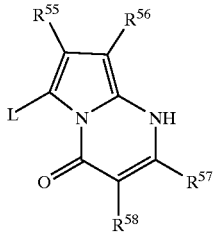

General formula (H)

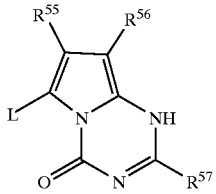

In the above-mentioned general formulae (G) and (H), $R^{55}$ and $R^{56}$ each independently represent a hydrogen atom, halogen atom, aryl group, alkyl group, cyano group, acyl group, carbamoyl group, alkoxycarbonyl group, aryloxycarbonyl group, alkylsulfonyl group or arylsulfonyl group. $R^{57}$ represents an amino group, substituted amino group, hydroxyl group, acyloxy group, arylcarboxyl group, alkoxy group, aryloxy group, alkylthio group or arylthio group. $R^{58}$ represent a hydrogen atom, halogen atom, or electron-attractive group having a Hammett's substituent constant $\sigma_p$ value of 0.2 or more. L represents a substituent which can leave upon reaction of this compound with a diazonium salt.

Of them, as the substituents represented by $R^{55}$ and $R^{56}$, at least one of $R^{55}$ and $R^{56}$ is preferably an electron-attractive group having a Hammett's substituent constant $\sigma_p$ value of 0.2 or more, and at least one of $R^{55}$ and $R^{56}$ is more preferably an electron-attractive group having a $\sigma_p$ value of 0.35 or more.

Examples of the electron-attractive group having a $\sigma_p$ value of 0.20 or more include, but are not limited to, a cyano group ($\sigma_p$ value: 0.66), perfluoroalkyl group (for example, trifluoromethyl group $\sigma_p$ value: 0.54), acyl group (for example, acetyl group $\sigma_p$ value: 0.50, benzoyl group $\sigma_p$ value: 0.43), carbamoyl group ($\sigma_p$ value: 0.36), alkoxycarbonyl group (for example, ethoxycarbonyl group up value: 0.45) and the like are preferably listed.

As the halogen atom, a fluorine atom, chlorine atom, bromine atom and the like are listed, and a fluorine atom and chlorine atom are more preferable.

In the general formula (G), examples of the electron-attractive group having a Hammett's substituent constant $\sigma_p$ of 0.2 or more preferably include, but are not limited to, aryl groups, cyano groups, acyl groups, carbamoyl groups, alkoxycarbonyl groups, aryloxycarbonyl groups, alkylsulfonyl groups, arylsulfonyl groups, alkylphosphoryl groups, arylphosphoryl groups, perfluoroalkyl groups and the like.

The details of the pyrrolopyrimidineone compound and pyrrolotriazineone compound are described in JP-A Nos. 11-101546, 11-114929 and 11-317792, and the present invention can suitably use all compounds described in these literatures.

Specific typical examples of the couplers of the above-mentioned general formulae (D) to (F) include, but are not limited to, the following compounds.

(C-1)

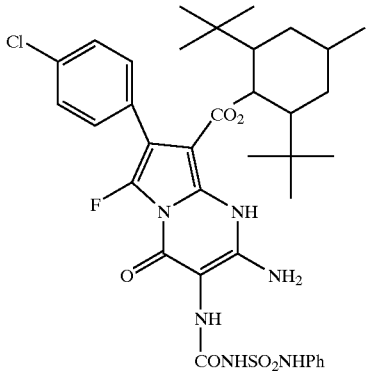

(C-2)

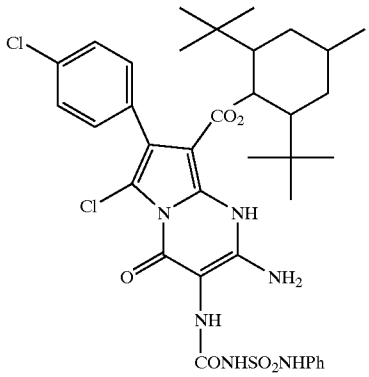

-continued (C-3)

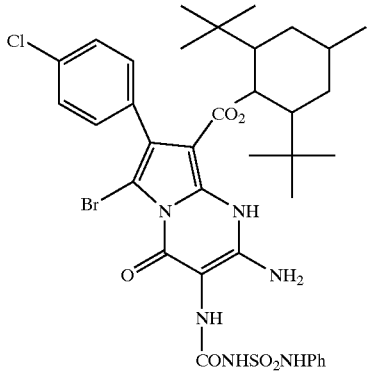

(C-4)

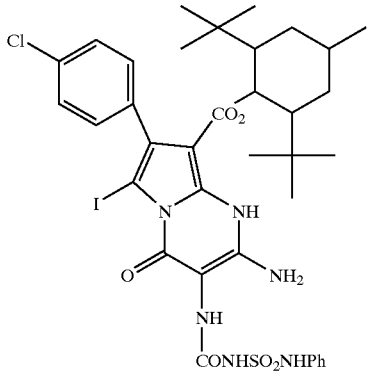

(C-5)

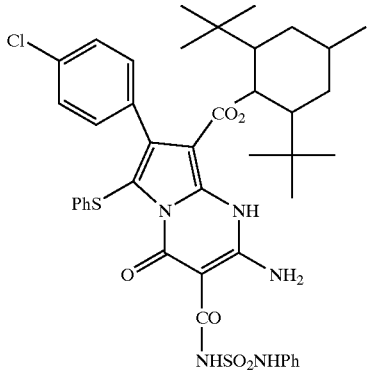

(C-6)

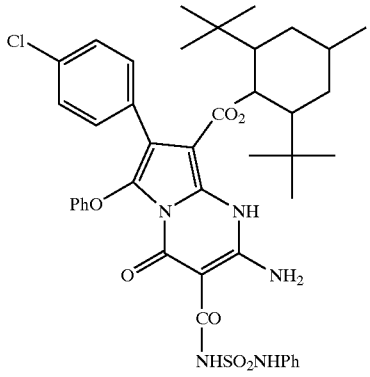

-continued
(C-7)
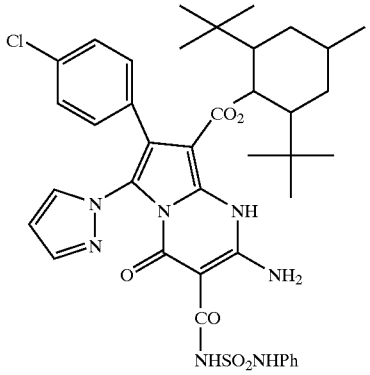
(C-8)
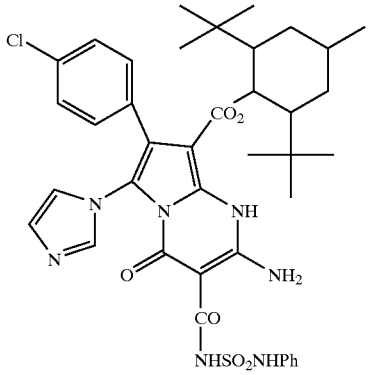
(C-9)
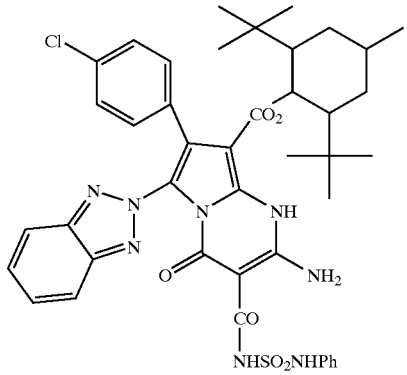
(C-10)
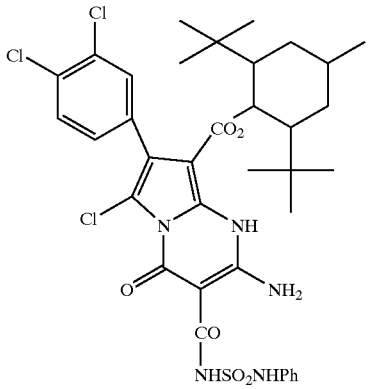
-continued
(C-11)
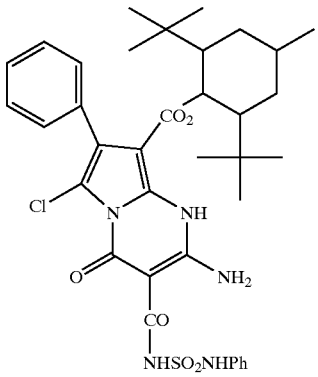
(C-12)
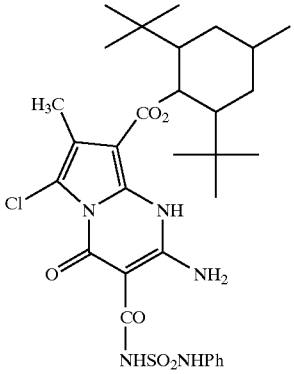
(C-13)
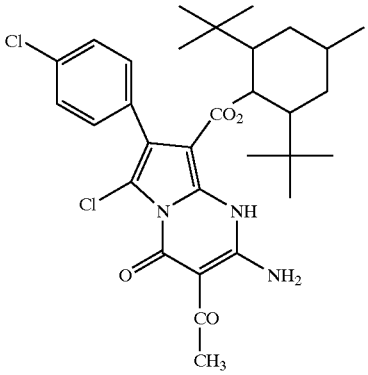
(C-14)
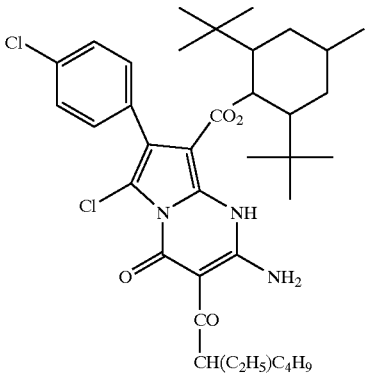

-continued
(C-15)
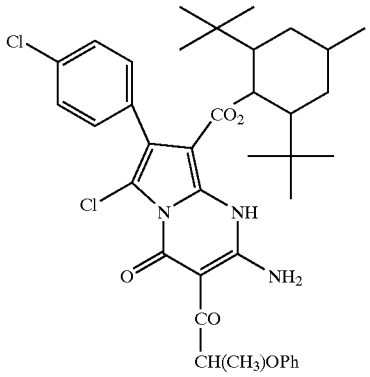
(C-16)
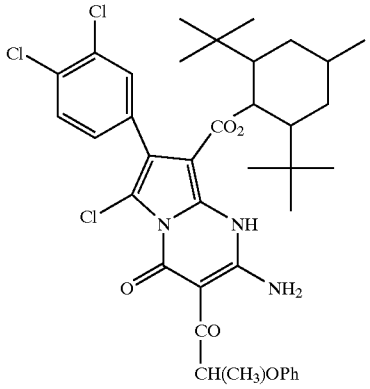
(C-17)
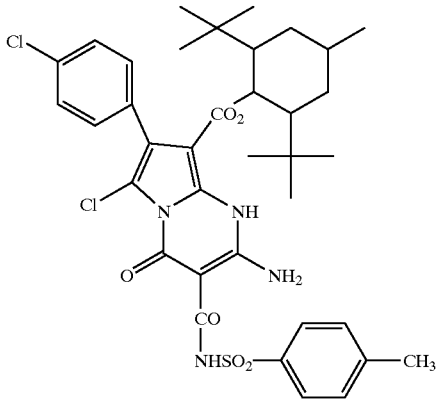
(C-18)
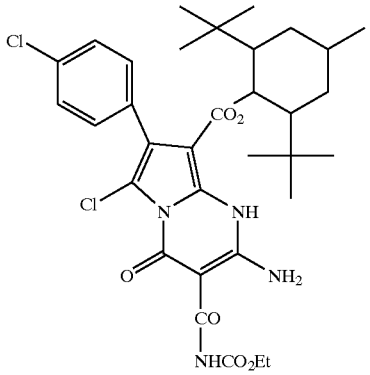
-continued
(C-19)
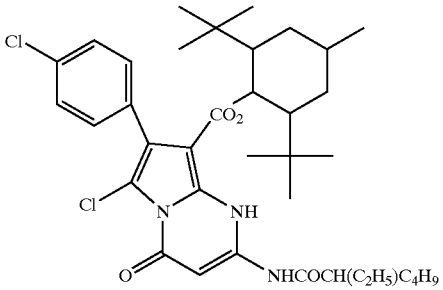
(C-20)
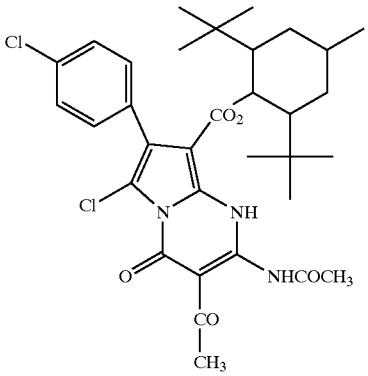
(C-21)
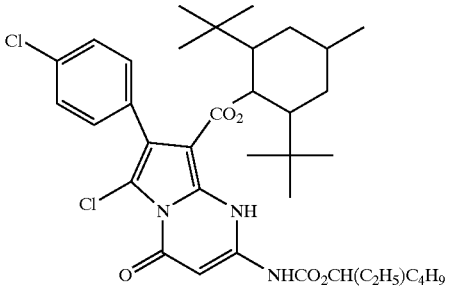
(C-22)
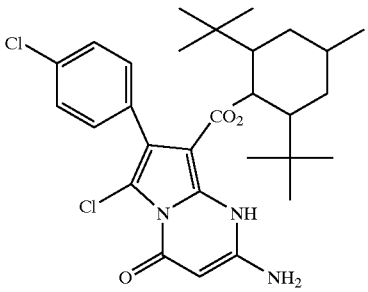
(C-23)
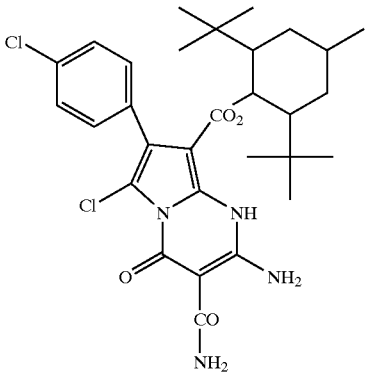

-continued
(C-24)
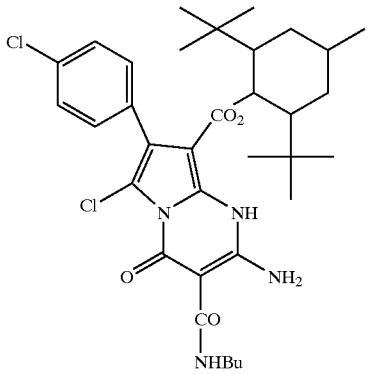
(C-25)
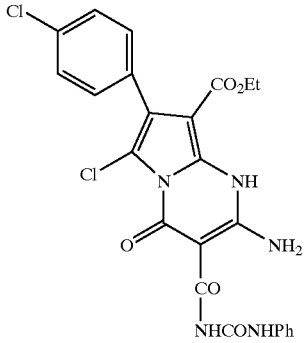
(C-26)
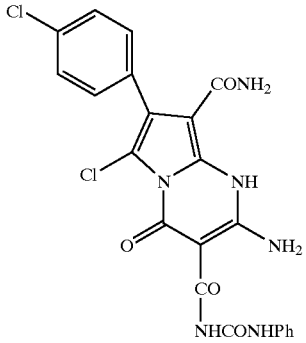
(C-27)
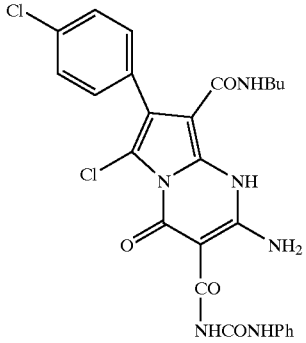
-continued
(C-28)
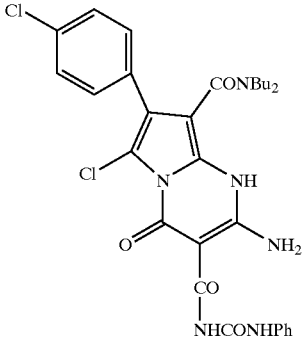
(C-29)
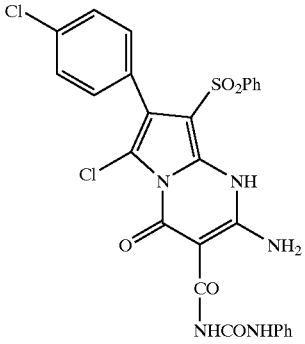
(C-30)
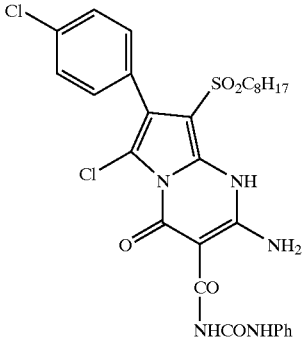
(C-31)
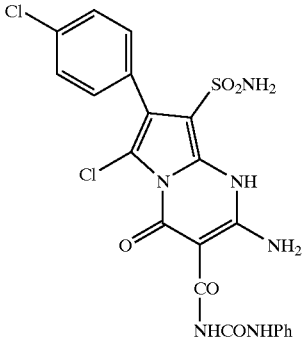

-continued
(C-32)
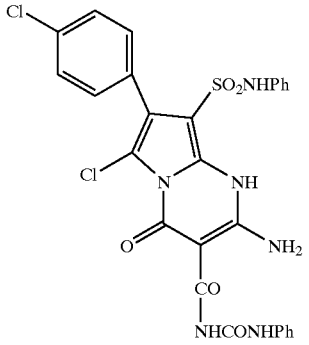
(C-33)
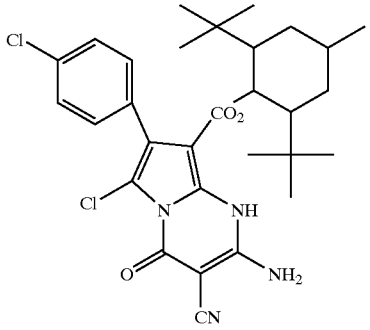
(C-34)
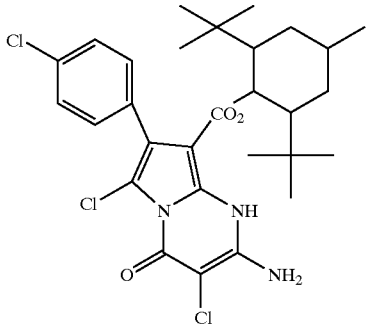
(C-35)
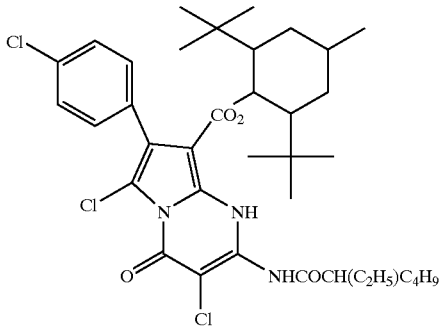
-continued
(C-36)
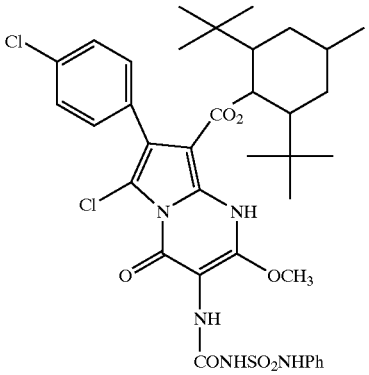
(C-37)
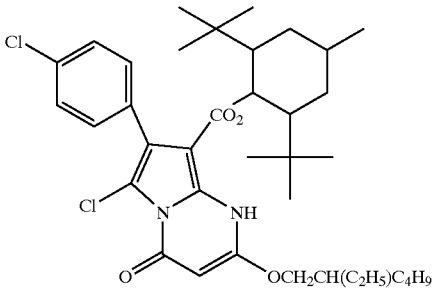
(C-38)
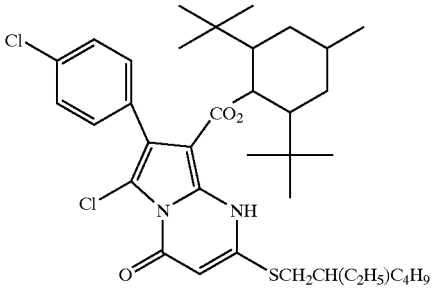
(C-39)
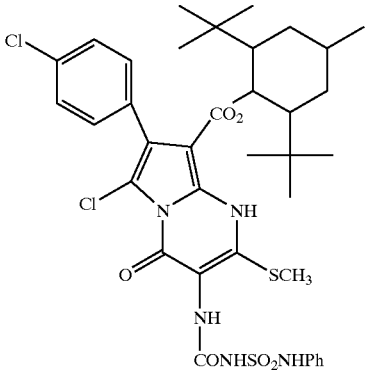

-continued
(C-40)
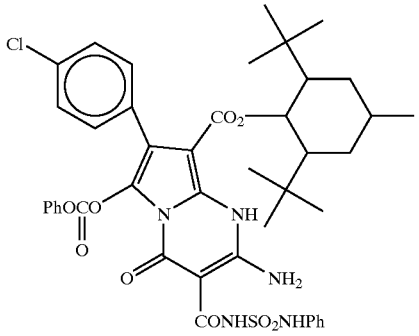
(C-41)
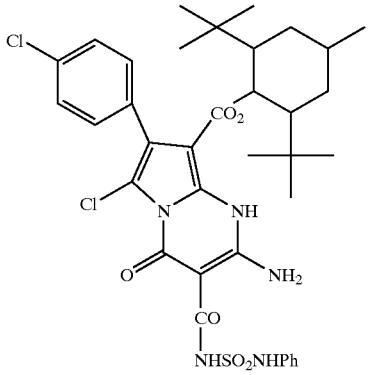
(C-42)
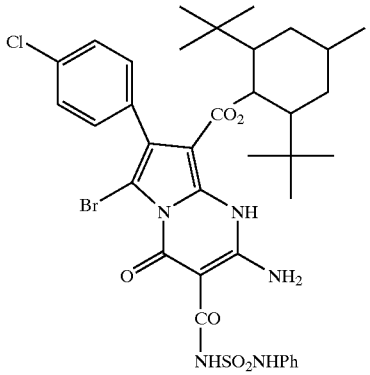
(C-43)
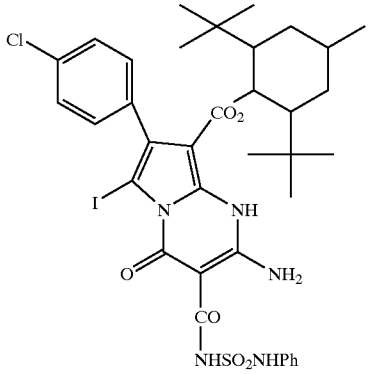
-continued
(C-44)
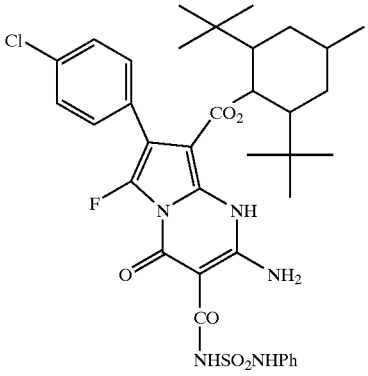
(C-45)
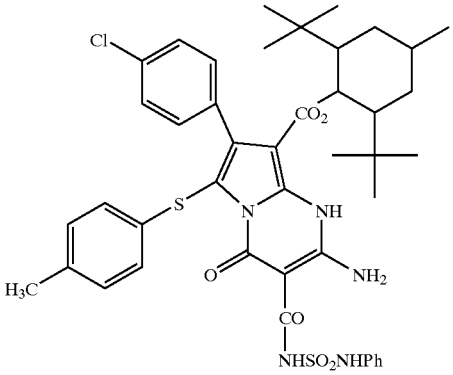
(C-46)
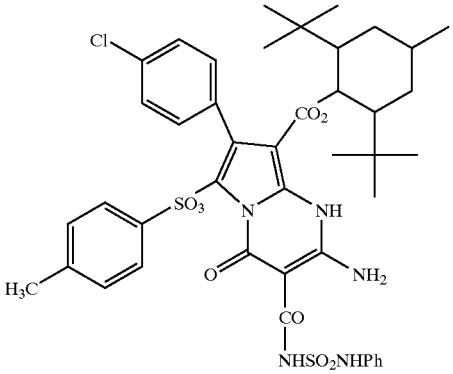
(C-47)
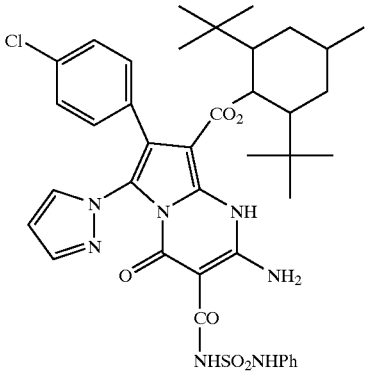

-continued
(C-48)
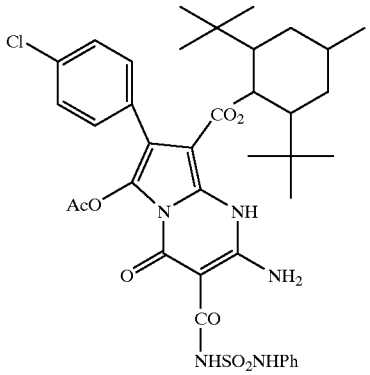
(C-49)
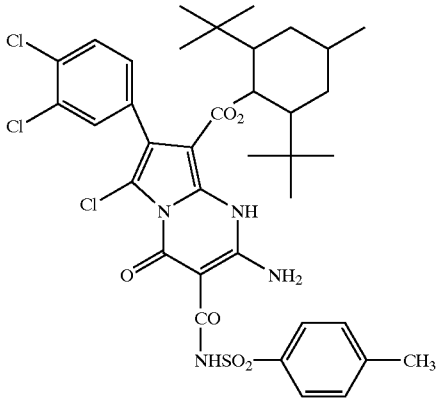
(C-50)
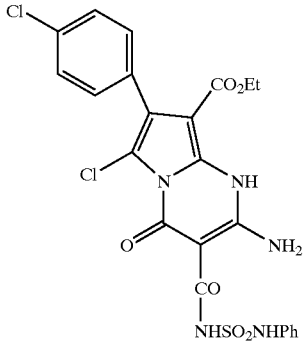
(C-51)
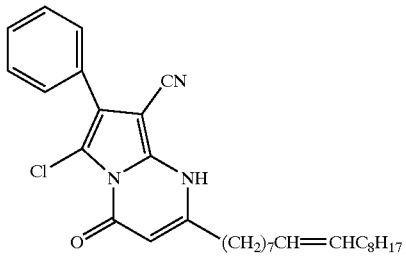
-continued
(C-52)
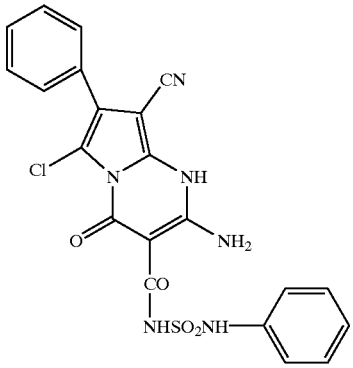
(C-53)
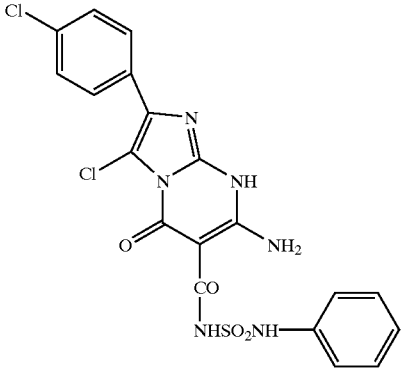
(C-54)
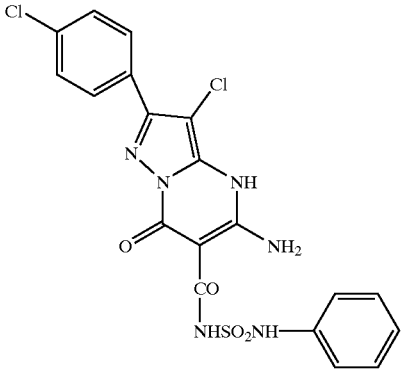
(C-55)
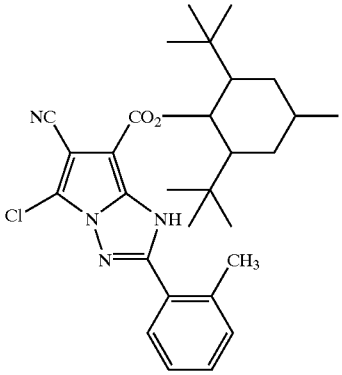

-continued
(C-69)
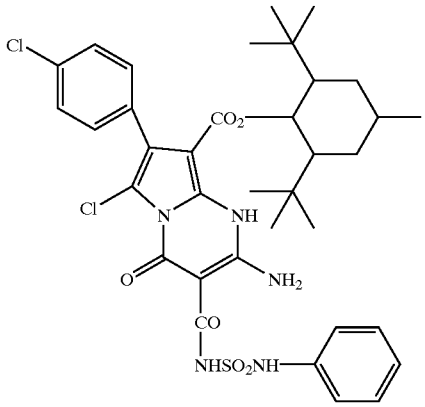
(C-70)
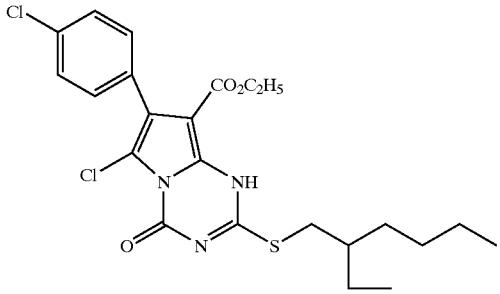
(C-71)
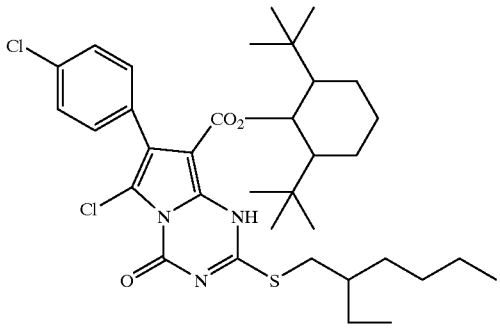
(C-72)
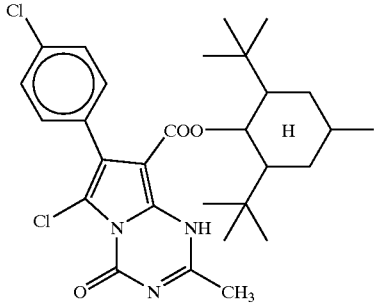
-continued
(C-73)
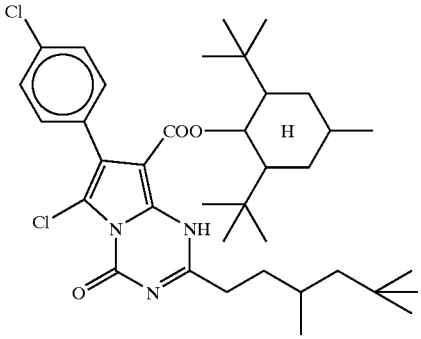
(C-74)
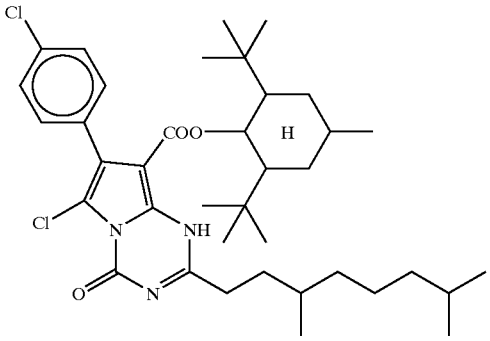
(C-75)
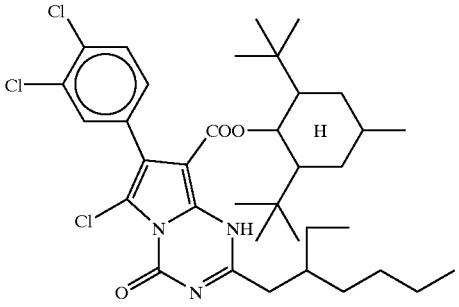
(C-76)
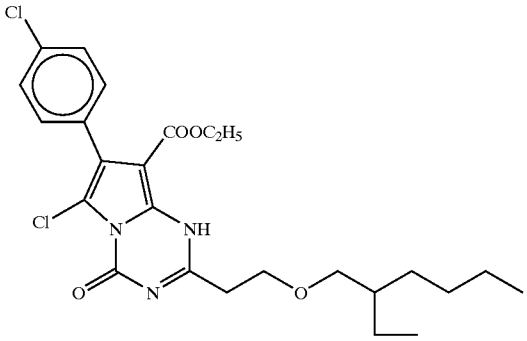
(C-77)
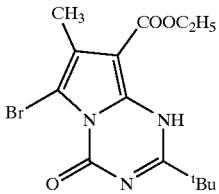

-continued
(C-78)
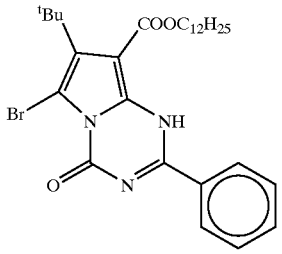
(C-79)
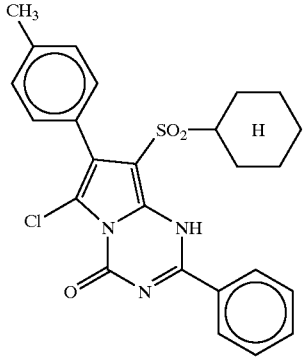
(C-80)
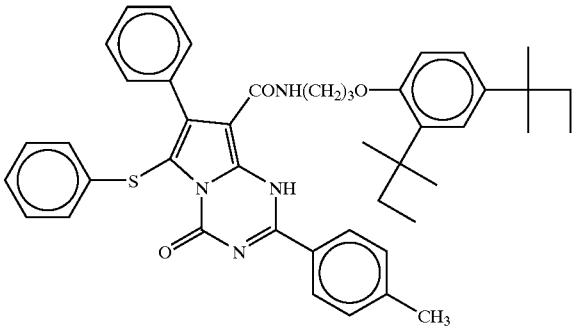
(C-81)
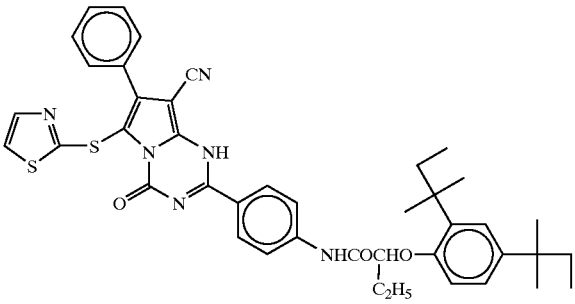
(C-82)
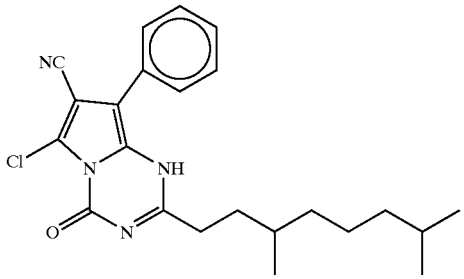
-continued
(C-83)
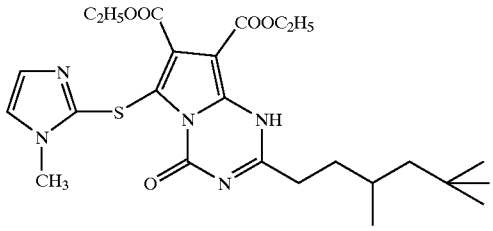
(C-84)
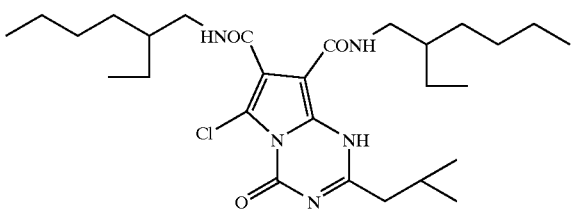
(C-85)
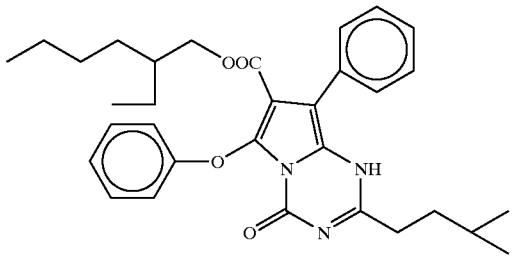
(C-86)
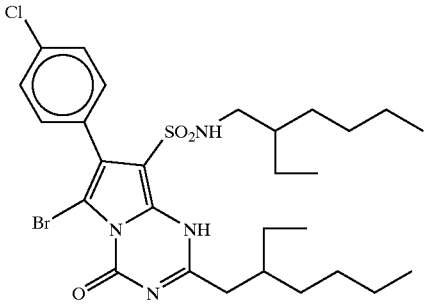
(C-87)
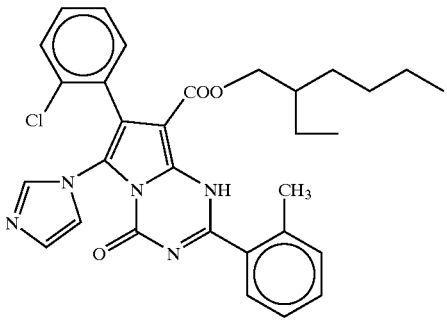

(C-88)
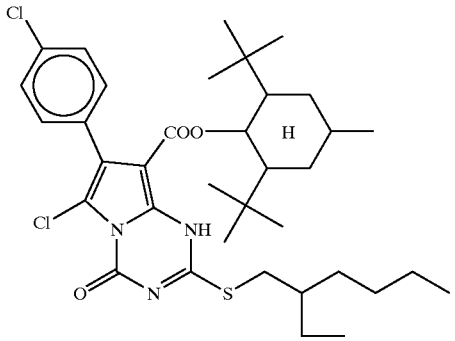
(C-89)
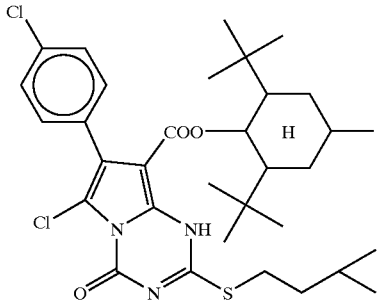
(C-90)
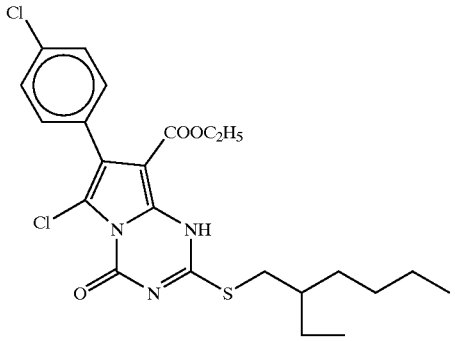
(C-91)
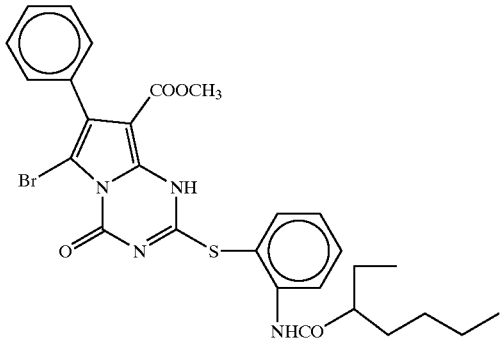
(C-92)
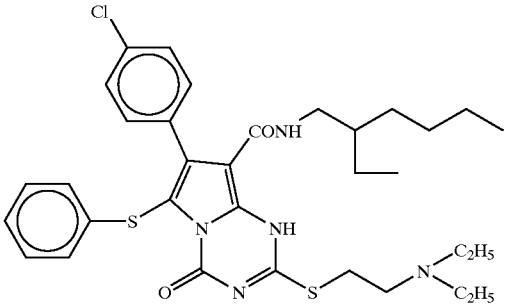
(C-93)
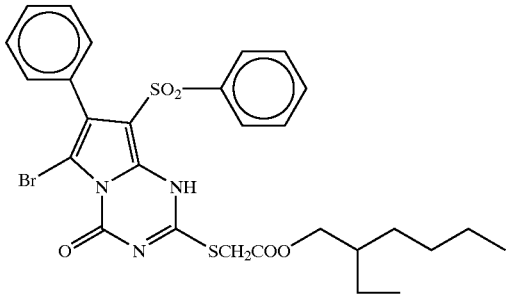
(C-94)
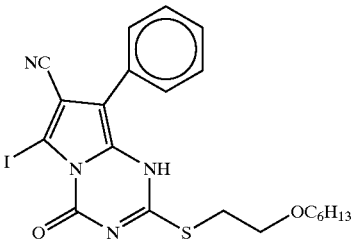
(C-95)
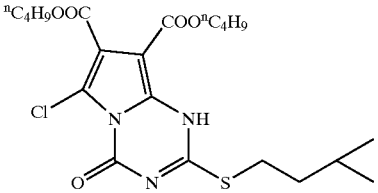
(C-96)
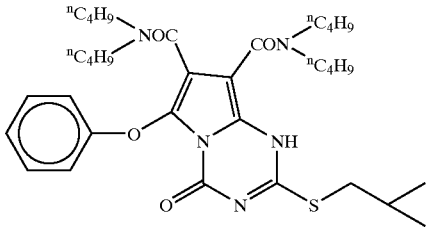

-continued
(C-97)
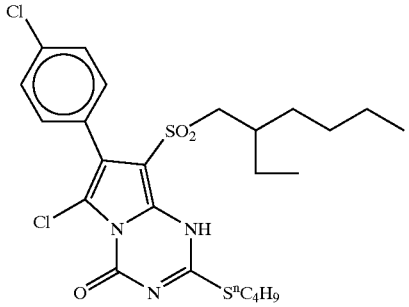
(C-98)
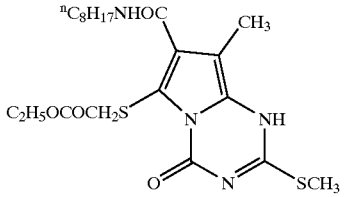
(C-99)
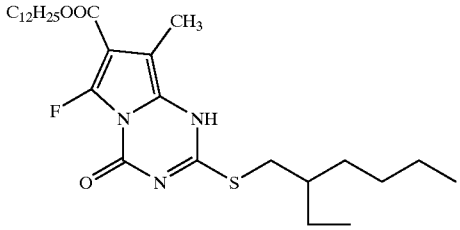
(C-100)
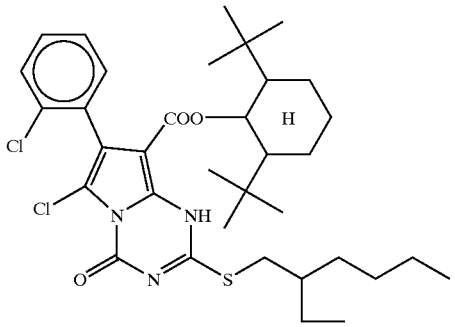
(C-101)
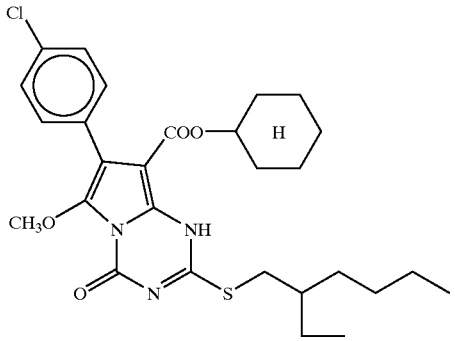
-continued
(C-102)
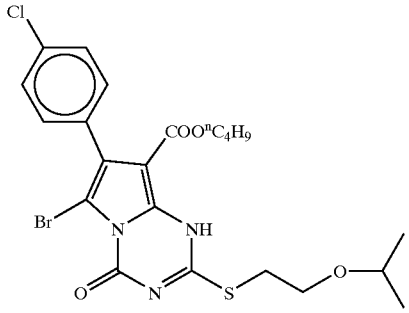
(C-103)
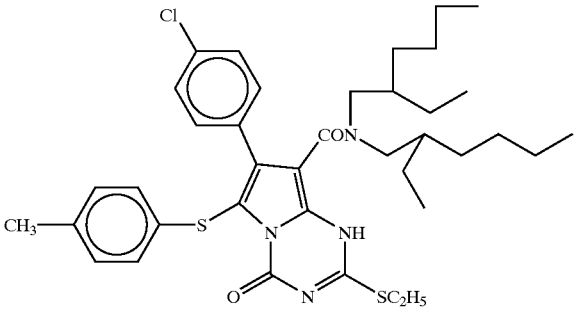
(C-104)
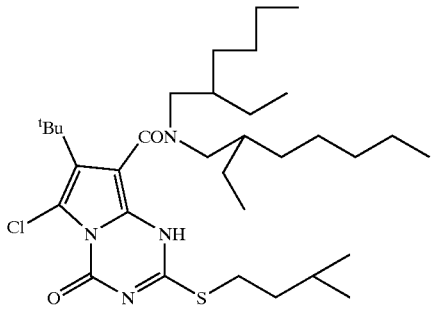
(C-105)
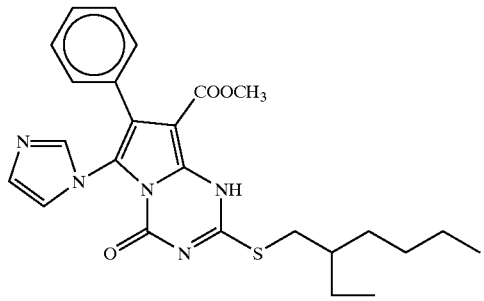
(C-106)
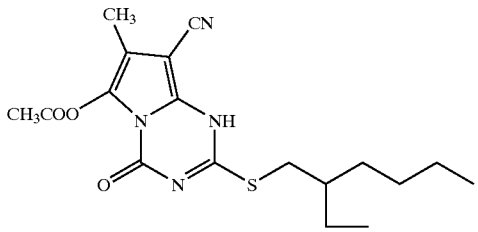

-continued
(C-107)
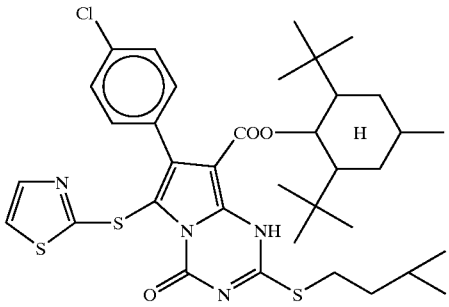
(C-108)
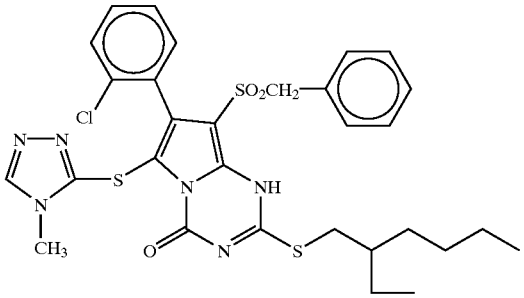
(C-109)
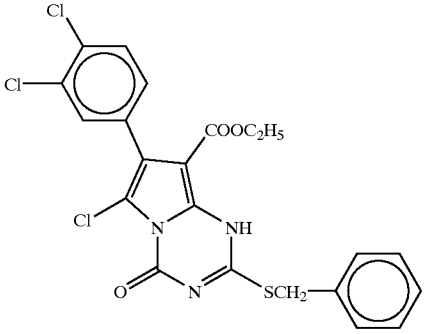
(C-110)
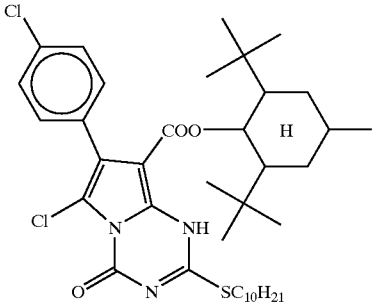
(C-111)
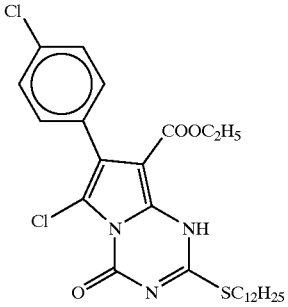
-continued
(C-112)
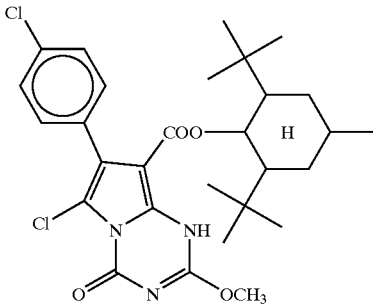
(C-113)
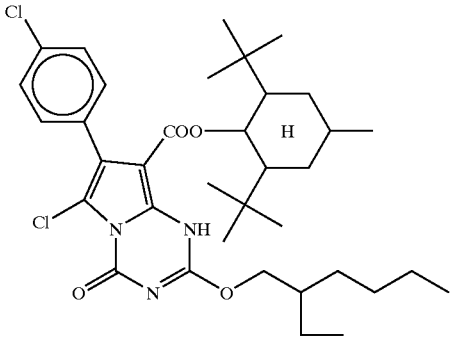
(C-114)
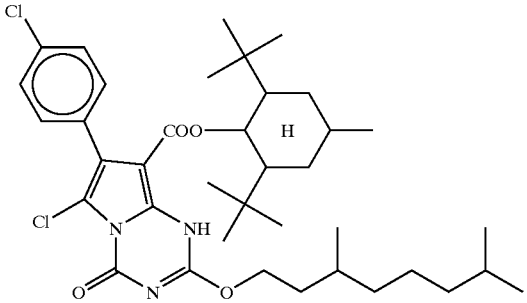
(C-115)
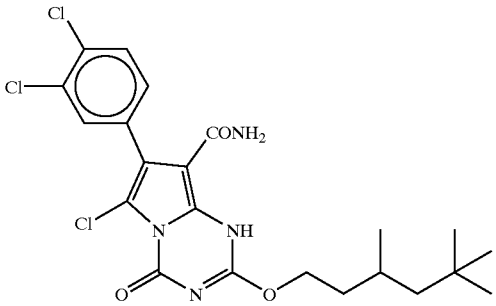
(C-116)
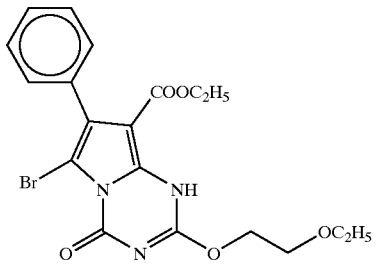

-continued
(C-117)
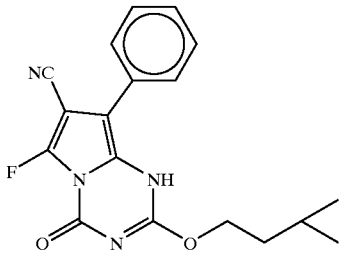
(C-118)
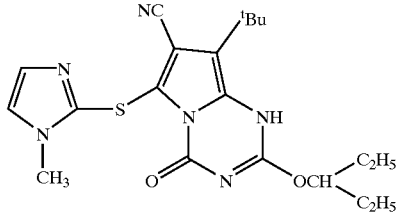
(C-119)
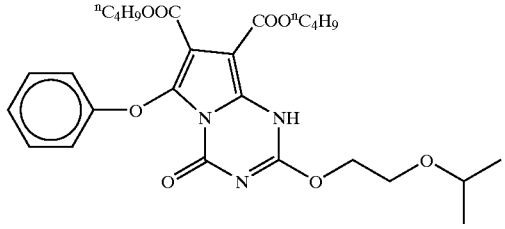
(C-120)
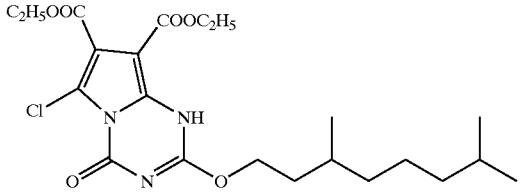
(C-121)
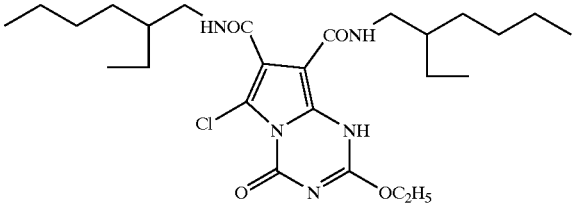
(C-122)
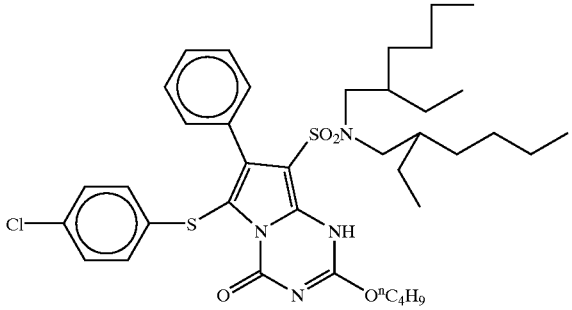
-continued
(C-123)
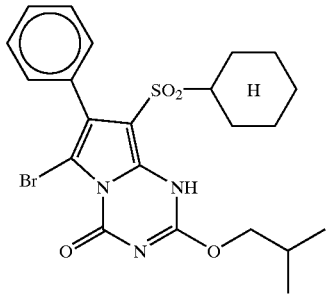
(C-124)
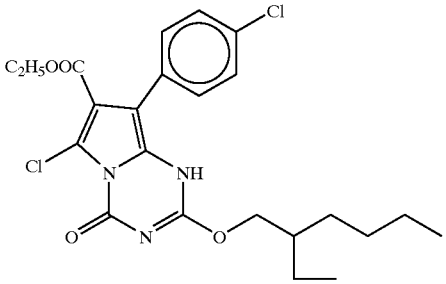
(C-125)
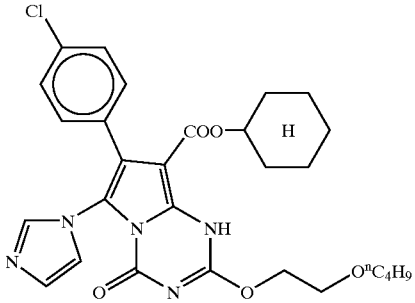
(C-126)
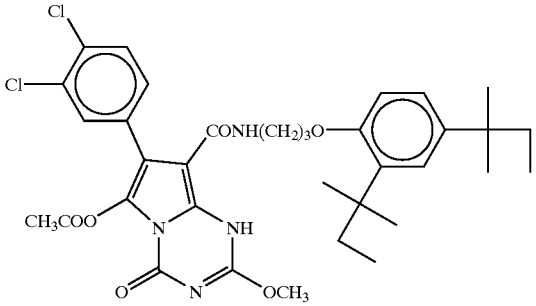
(C-127)
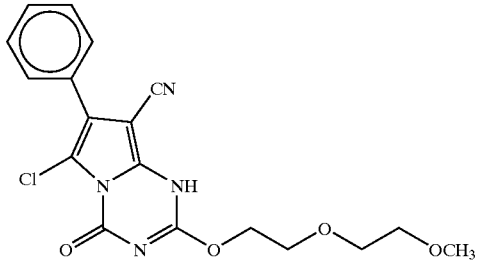

-continued
(C-128)
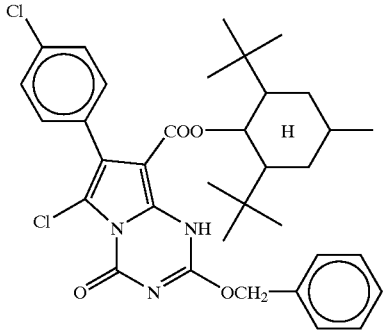
(C-129)
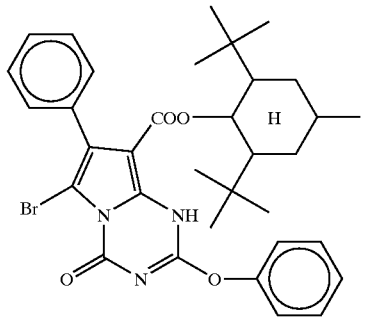
(C-130)
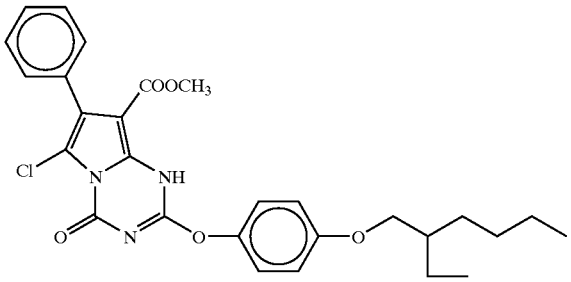
(C-131)
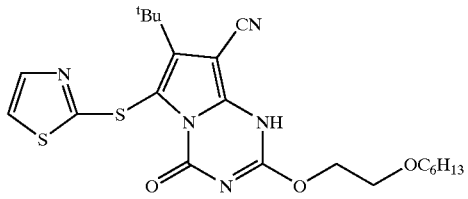
(C-132)
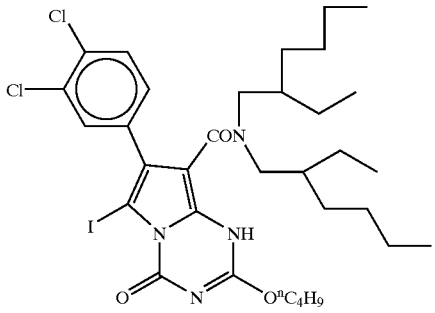
-continued
(C-133)
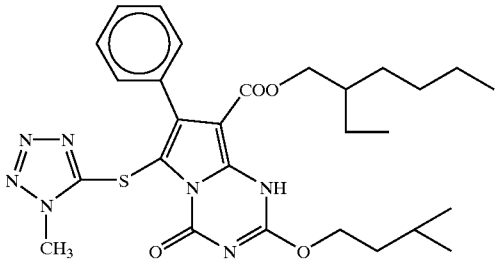
(C-134)
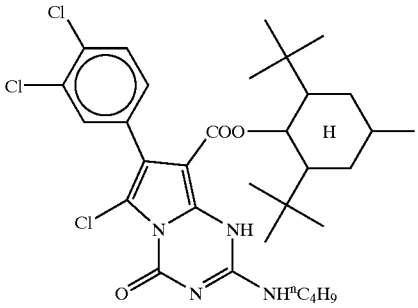
(C-135)
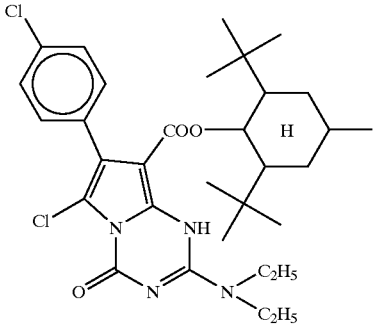
(C-136)
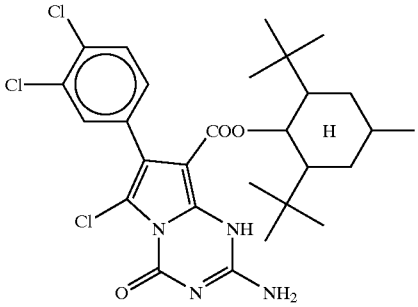
(C-137)
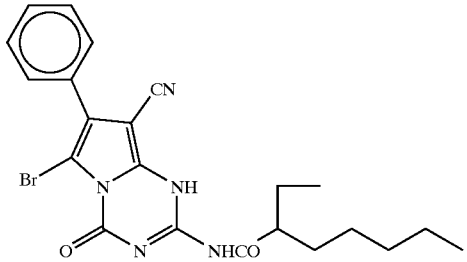

-continued
(C-138)
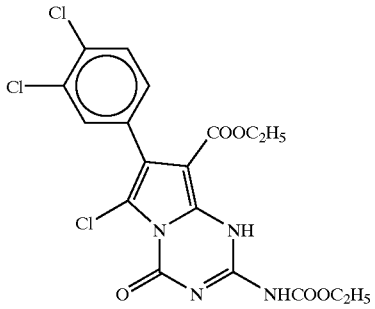
(C-139)
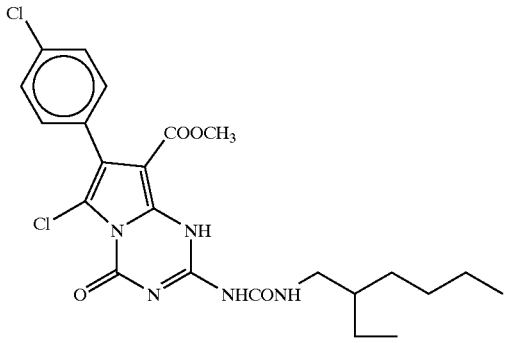
(C-140)
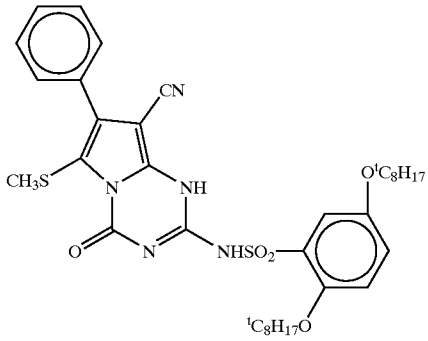
(C-141)
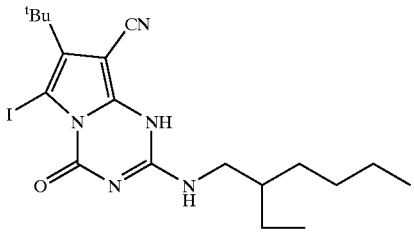
(C-142)
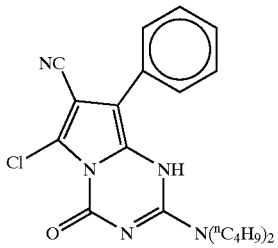
-continued
(C-143)
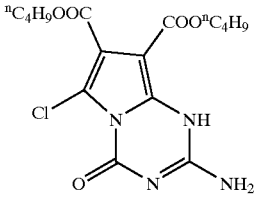
(C-144)
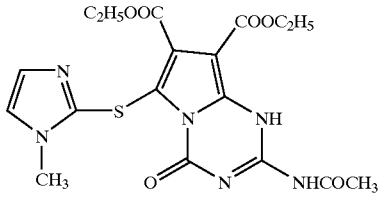
(C-145)
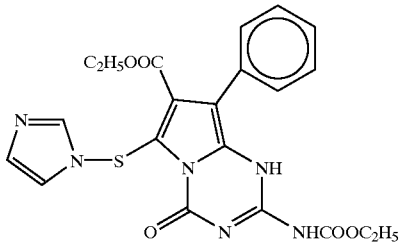
(C-146)
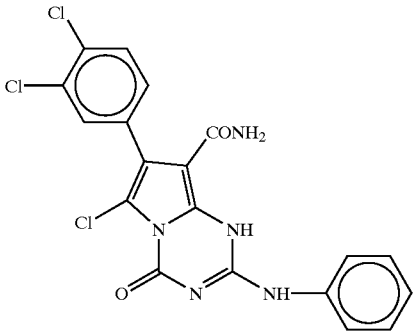
(C-147)
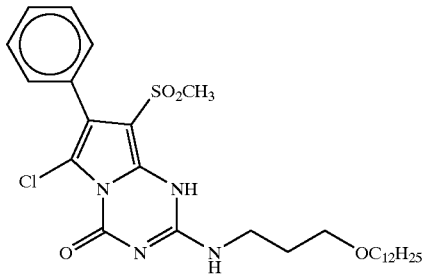
(C-148)
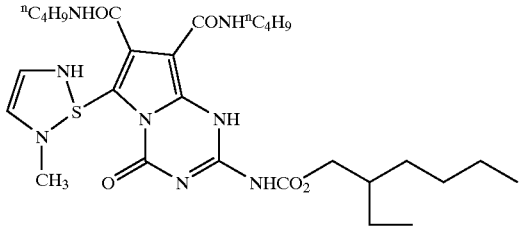

-continued (C-149)

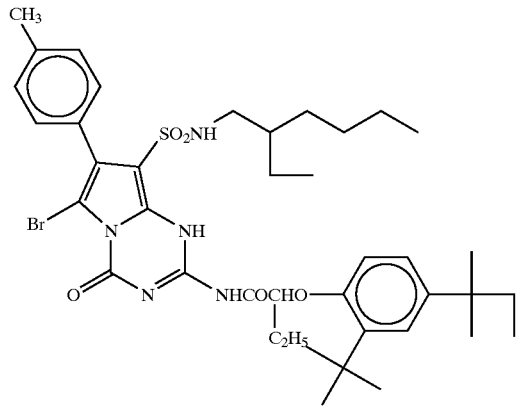

The above-mentioned coupler which can be used in a cyan heat-sensitive recording layer can be used together with known couplers depending on various objects such as hue control and the like. As the known coupler used together, so-called methylene compounds having a methylene group adjacent to a carbonyl group, phenol derivatives, naphthol derivatives and the like are mentioned, and specifically, the following compounds are listed and used in a range corresponding to the object of the invention. As the known coupler, known couplers exemplified for the above-mentioned yellow heat-sensitive recording layer are mentioned.

In the heat-sensitive recording material of the present invention, it is preferable to add a reducing agent such as aminophenols, phenols, catechols, hydroquinones, amines, hydroxyamines, alcohols, thiols, sulfides, alkali metals, alkaline earth metals, metal hydroxides, hydrazines, phenidones, anilines, phenyl ethers, L-ascorbic acids and the like, into a heat-sensitive recording layer, for the purpose of promoting a coupling reaction. Specific examples of these reducing agents include, but are not limited to, exemplary compounds (R-1) to (R-55) described in paragraph Nos. [0067] to [0070] in the specification of Japanese Patent Application No. 2000-116580.

These reducing agents may be solid-dispersed in the form of fine particles into a recording layer, or singly dissolved in oil to give an emulsified substance, and further, may be added into an oil phase of a coupler emulsified substance. When a diazo compound or coupler is microcapsulated, both adding inside the microcapsules and adding inside and outside the microcapsules are also possible.

The content of the above-mentioned reducing agent is preferably from 1 to 10 mol per mol, more preferably from 1 to 4 mol per mol of the diazo compound. When less than 1 mol per mol of the content of the diazo compound, an effect of improving color development and an effect of improving image storage property may not be obtained sufficiently. On the other hand, when over 10 mol per mol, an effect of improving color development may unexpectedly decrease, and further, raw-preservability may deteriorate.

In the cyan heat-sensitive recording layer, the addition amount of all couplers is preferably from 0.2 to 8 mol per mol based on the addition amount of the diazonium salt in a cyan heat-sensitive recording layer, and more preferably from 1 to 5 mol per mol from the standpoint of effect.

When the above-mentioned addition amount is less than 0.2 mol per mol based on the addition amount of the diazonium salt, sufficient color development may not be obtained, and when over 8 mol per mol, application suitability may deteriorate.

Though the coupler in the present invention can be solid-dispersed by a sand mill and the like, with a water-soluble polymer added together with other components added, the coupler is preferably used as an emulsified substance with a suitable emulsification aid. The solid-dispersion method and emulsification method are not particularly restricted, and conventionally known methods can be used. Details of these methods are described in JP-A Nos. 59-190886, 2-141279 and 7-17145.

Magenta Heat-sensitive Recording Layer

The magenta heat-sensitive recording layer is placed as the outermost layer (uppermost layer) of heat-sensitive recording layers in the heat-sensitive recording material of the present invention. The maximum absorption wavelength λmax of the diazo compound or the like used in the magenta heat-sensitive recording layer is preferably 460 nm or less, more preferably from 430 to 460 nm from the standpoint of effect. When the diazo compound or the like has λmax at a longer wavelength than the above-mentioned wavelength range, raw-preservability may decrease in some cases, and when the diazo compound or the like has λmax at a shorter wavelength than the above-mentioned wavelength range, fixing speed may decrease. As the diazo compound or the like which can be used in the magenta heat-sensitive recording layer, diazonium salts of the following general formula (8) are preferable:

General Formula (8)

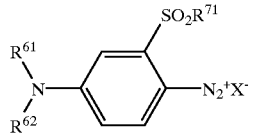

In the general formula (8), $R^{61}$ and $R^{62}$ represent a hydrogen atom, alkyl group or aryl group, and $R^{71}$ represents an alkyl group or aryl group. $X^-$ represents an anion.

In the general formula (8), $R^{61}$, $R^{62}$ and $R^{71}$ represent a hydrogen atom, alkyl group or aryl group, and $X^-$ represents an anion. In the general formula (8), $R^{61}$ and $R^{62}$ will be described later since they are the same as $R^1$and $R^2$ in the following general formula (1). In the general formula (8), the alkyl group represented by $R^{71}$ may have a substituent, and alkyl groups having a total carbon number of 1 to 3 are preferable. As this alkyl group, for example, methyl group, ethyl group, n-propyl group, i-propyl group, n-butyl group, t-butyl group, s-butyl group, i-butyl group, n-pentyl group, 2-pentyl group, 3-pentyl group, i-pentyl group, n-hexyl group, n-octyl group, 2-ethylhexyl group, 3,5,5-trimethylhexyl group, n-dodecyl group, cyclohexyl group, benzyl group, 2-chlorobenzyl group, 2-methylbenzyl group, 3-chlorobenzyl group, 3-methylbenzyl group, 3-methoxybenzyl group, α-methylbenzyl group, allyl group, 2-chloroethyl group, methoxycarbonylmethyl group, methoxycarbonylethyl group and butoxycarbonylethyl group are preferable. The aryl group represented by $R^{71}$ may have a substituent, and aryl groups having a total carbon number of 6 to 30 are preferable. For example, a phenyl group, 4-methylphenyl group, 3-methylphenyl group, 2-methylphenyl group, 4-chlorophenyl group and 2-chlorophenyl group are preferable. As the diazonium salt of the general formula (8), diazonium salts of the following general formula (1) are particularly preferable:

General formula (1)

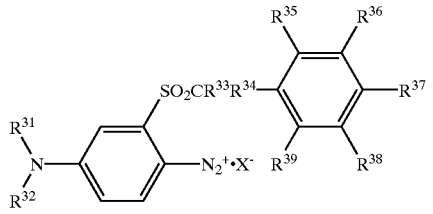

In the general formula (1), $R^{31}$ and $R^{32}$ each independently represent a hydrogen atom, alkyl group or aryl group.

As the above-mentioned alkyl group, alkyl groups having 1 to 20 carbon atoms are preferable, and they may be unsubstituted or substituted. For example, a methyl group, ethyl group, n-propyl group, isopropyl group, n-butyl group, t-butyl group, n-hexyl group, n-octyl group, 2-ethylhexyl group, 3,5,5-trimethylhexyl group, n-decyl group, n-dodecyl group, 2-chloroethyl group, 2-methanesulfonylethyl group, 2-methoxyethyl group, N,N-dibutylcarbamoylmethyl group, 2-ethoxycarbonylethyl group, butoxyxarbonylmethyl group, 2-isopropyloxyethyl group, 2-(2,5-di-t-amylphenoxy)ethyl group, 2-phenoxyethyl group, 1-(4-methoxyphenoxy)-2-propyl group, 1-(2,5-di-t-amylphenoxy)-2-propyl group, allyl group, benzyl group, α-methylbenzyl group, 4-chlorobenzyl group, 2-chlorobenzyl group, 3,4-dichlorobenzyl group, 4-fluorobenzyl group, trichloromethyl group, trifluoromethyl group, 2,2,2-trifluoromethyl group and the like are suitably listed.

As the above-mentioned aryl group, aryl groups having 6 to 30 carbon atoms are preferable, and they may be unsubstituted or have a substituent. For example, a phenyl group, 4-methylphenyl group, 2-chlorophenyl group and the like are listed.

Of them, aryl groups having 6 to 10 carbon atoms are more preferably, and a phenyl group and 4-methylphenyl group are particularly preferable.

When the above-mentioned $R^{31}$ and $R^{32}$ represent an alkyl group in the general formula (1), $R^{31}$ and $R^{32}$ may be mutually connected to form a ring structure for formation of a cyclic group containing a nitrogen atom. As this cyclic group, for example, a pyrrolidino group, piperidino group, morpholino group, 4-octanoylpiperazino group, 4-(2-(2,4-di-t-amylphenoxy))butanoylpiperazino group, 4-(2-(n-octyloxy)-5-t-octylphenyl)sulfonylpiperazino group, hexamethyleneimino group, indolino group and the like are listed, and of them, a pirrolidino group and hexamethyleneimino group are preferable.

Regarding $R^{31}$ and $R^{32}$ in the above-described general formula (1), it is more preferable that at least one is a methyl group.

$R^{33}$ and $R^{34}$ in the general formula (1) each independently represent a hydrogen atom, alkyl group, aryl group or halogen atom. The above-mentioned alkyl group and aryl groups are the same as defined for the above-mentioned $R^{31}$ and $R^{32}$. Regarding $R^{33}$ and $R^{34}$ in the above-described general formula (1), it is more preferable that at least one is a methyl group.

As the above-mentioned halogen atom, a fluorine atom, chlorine atom, bromine atom and iodine atoms are listed, and of them, a fluorine atom and chlorine atom are preferable.

$R^{35}$, $R^{36}$, $R^{37}$, $R^{38}$ and $R^{39}$ in the general formula (1) each independently represent a hydrogen atom, alkyl group, aryl group, halogen atom, alkoxy group, aryloxy group, alkoxycarbonyl group, acyloxy group, carbamoyl group, amide group, cyano group, alkylthio group, arylthio group, alkylsulfonyl group and arylsulfonyl group. At least one of the above-mentioned $R^{35}$ to $R^{39}$ represents a halogen atom.

The above-mentioned alkyl group and aryl group are as defined for the above-mentioned $R^{31}$ and $R^{32}$, and the above-mentioned halogen atom is as defined for the above-mentioned $R^{33}$ and $R^{34}$.

The above-mentioned alkoxy group is preferably an alkoxy group having 1 to 20 carbon atoms, and may be unsubstituted or substituted. For example, a methoxy group, ethoxy group, n-butoxy group, t-butoxy group, hexyloxy group, octyloxy group, 2-ethylhexyloxy group, trifluoromethoxy group, 2-ethoxyethoxy group, 2-chloroethoxy group, 2-phenoxyethoxy group, benzyloxy group, 2-chlorobenzyloxy group, 4-chlorobenzyloxy group, 3,4-dichlorobenzyloxy group, aryloxy-2,4-di-t-amylphenoxyethoxy group, 2,4-di-t-amylphenoxybutoxy group and the like are listed.

Of them, alkoxy groups having 1 to 10 carbon atoms are more preferable, and a methoxyl group, ethoxy group, n-butoxyl group and benzyloxy group are particularly preferable.

The above-mentioned aryloxy group is preferably an aryloxy group having 6 to 20 carbon atoms, and may be unsubstituted or substituted. For example, a phenoxy group, 4-methylphenoxy group, 4-methoxyphenoxy group, 4-chlorophenoxy group, 2-chlorophenoxy group, 2,4-di-t-amylphenoxy group and the like are listed.

Of them, aryloxy groups having 6 to 10 carbon atoms are more preferable, and a phenoxy group, 4-methylphenoxy group and 4-methoxyphenoxy group are particularly preferable.

The above-mentioned alkoxycarbonyl group is preferably an alkoxycarbonyl group having 2 to 20 carbon atoms, and may be unsubstituted or substituted. For example, a methoxycarbonyl group, ethoxycarbonyl group, n-butoxycarbonyl group, 2-ethoxyethoxycarbonyl group and the like are listed.

Of them, alkoxycarbonyl groups having 2 to 10 carbon atoms are more preferable, and a methoxycarbonyl group, ethoxycarbonyl group and n-butoxycarbonyl group are particularly preferable.

The above-mentioned acyloxy group is preferably an acyloxy group having 2 to 20 carbon atoms, and may be unsubstituted or substituted. For example, an acetyloxy group, butanoyloxy group, chloroacetyloxy group, phenoxyacetyloxy group, benzoyloxy group and the like are listed.

Of them, acyloxy groups having 3 to 10 carbon atoms are more preferable, and an acetyloxy group, phenoxyacetyloxy group and benzoyloxy group are particularly preferable.

The above-mentioned carbamoyl group is preferably a carbamoyl group having 1 to 20 carbon atoms, and may be unsubstituted or substituted. For example, an unsubstituted carbamoyl group, N,N-dimethylcarbamoyl group, piperidinocarbonyl group, N,N-di(2-ethylhexyl)carbamoyl group and the like are listed.

Of them, carbamoyl groups having 1 to 10 carbon atoms are more preferable, and an unsubstituted carbamoyl group and piperidinocarbonyl group are particularly preferable.

The above-mentioned amide group is preferably an amide group having 2 to 20 carbon atoms, and may be unsubstituted or substituted. For example, an acetylamino group, butanoylamino group, pivaloylamino group, octanoylamino group, benzoylamino group and the like are listed.

Of them, amide groups having 2 to 10 carbon atoms are more preferable, and an acetylamino group and butanoylamino group are particularly preferable.

The above-mentioned alkylthio group is preferably an alkylthio group having 1 to 20 carbon atoms, and may be unsubstituted or substituted. For example, a methylthio group, ethylthio group, butylthio group, octylthio group, 2-ethylhexylthio group, dodecylthio group, benzylthio group and the like are listed.

Of them, alkylthio groups having 1 to 10 carbon atoms are more preferable, and a methylthio group, ethylthio group, butylthio group and benzylthio group are particularly preferable.

The above-mentioned arylthio group is preferably an arylthio group having 6 to 20 carbon atoms, and may be unsubstituted or substituted. For example, a phenylthio group, 4-chlorophenylthio group, 2-chlorophenylthio group, 4-methylthio group and the like are listed.

Of them, arylthio groups having 6 to 10 carbon atoms are more preferable, and a phenylthio group, and 2-chlorophenylthio group are particularly preferable.

The above-mentioned alkylsulfonyl group is preferably an alkylsulfonyl group having 1 to 20 carbon atoms, and may be unsubstituted or substituted. For example, a methylsulfonyl group, ethylsulfonyl group, butylsulfonyl group, octylsulfonyl group, dodecylsulfonyl group, benzylsulfonyl group and the like are listed.

Of them, alkylsulfonyl groups having 1 to 10 carbon atoms are more preferable, and a methylsulfonyl group, ethylsulfonyl group, butylsulfonyl group and benzylsulfonyl group are particularly preferable.

The above-mentioned arylsulfonyl group is preferably an arylsulfonyl group having 1 to 20 carbon atoms, and may be unsubstituted or substituted. For example, a phenylsulfonyl group, 4-chlorophenylsulfonyl group, 2-chlorophenylsulfonyl group, 4-methylsulfonyl group and the like are listed.

Of them, arylsulfonyl groups having 6 to 10 carbon atoms are more preferable, and a phenylsulfonyl group and 2-chlorophenylsulfonyl group are particularly preferable.

When the above-mentioned groups represented by $R^1$ to $R^9$ in the general formula (1) have a substituent, this substituent may be any diazonium salt of the above-mentioned general formula (1), and general formulae (2) and (6) described below. Namely, a dimer or more multimer of a diazonium salt may be formed.

$X^-$ in the above-mentioned general formula (1) represents an anion. This anion may be an inorganic anion or organic anion.

As the above-mentioned inorganic anion, for example, a hexafluorophosphate ion, fluoroborate ion, chloride ion, sulfate ion and hydrogensulfate ion are suitably listed, and of them, a hexafluorophosphate ion and fluoroborate ion are preferable.

As the above-mentioned organic anion, for example, a polyfluoroalkylsulfonate ion, polyfluoroalkylcarboxylate ion, tetraphenylborate ion, aromatic carboxylate ion, aromatic sulfonate ion and the like are suitably listed, and of them, a polyfluoroalkylsulfonate ion is more preferable.

Of diazonium salts of the above-mentioned general formula (1), diazonium salts of the following general formula (2) are preferable:

General Formula (2)

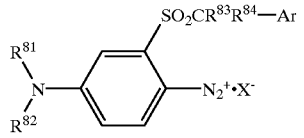

$R^{81}$ and $R^{82}$ in the above-mentioned general formula (2) each independently represent an alkyl group, and this alkyl group is as defined for the above-mentioned $R^{31}$ and $R^{32}$ in the above-mentioned general formula (1). $R^{83}$ and $R^{84}$ each independently represent a hydrogen atom, alkyl group or halogen atom, and this alkyl group is also as defined for the above-mentioned $R^{31}$ and $R^{32}$, and the above-mentioned halogen atom is as defined for the above-mentioned $R^{33}$ and $R^{34}$ in the above-mentioned general formula (1). $X^-$ represents an anion and is as defined in the general formula (1). It is preferable that at least one of the above-mentioned $R^{81}$ and $R^{82}$ and at least one of the above-mentioned $R^{83}$ and $R^{84}$ are a methyl group.

In the above-mentioned general formula (2), Ar represents a moiety of the following general formula (3), (4) or (5):

General formula (3)

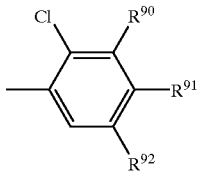

General formula (4)

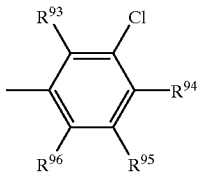

General formula (5)

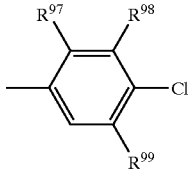

In the above-mentioned general formula (3), $R^{90}$, $R^{91}$ and $R^{92}$ each independently represent a hydrogen atom, alkyl group, aryl group, halogen atom, alkoxy group or aryloxy group. In the above-mentioned general formula (4), $R^{93}$, $R^{94}$, $R^{95}$ and $R^{96}$ represent a hydrogen atom, alkyl group, aryl group, halogen atom, alkoxy group or aryloxy group, and at least one of $R^{93}$ and $R^{96}$ represent a hydrogen atom. In the above-mentioned general formula (5), $R^{97}$, $R^{98}$ and $R^{99}$ represent a hydrogen atom, alkyl group, aryl group, alkoxy group or aryloxy group.

The alkyl group and aryl group in the above-mentioned general formulae (3) to (5) are as defined for $R^{31}$ and $R^{32}$ in the above-mentioned general formula (1), and the above-mentioned halogen atom is as defined for $R^{33}$ and $R^{34}$, and the above-mentioned alkoxy group and aryloxy group are as defined for $R^{35}$ to $R^{39}$ in the above-mentioned general formula (1).

Of diazonium salts of the above-mentioned general formula (2), diazonium salts of the following general formula (6) are more preferable.

General formula (9)

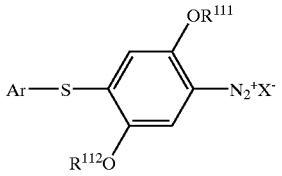

In the above-mentioned general formula (6), $R^{101}$ and $R^{102}$ each independently represent an alkyl group, $X^-$ represents an anion and these alkyl group and anion are as defined for $R^1$, $R^2$ and $X^-$ in the above-mentioned general formula (1). It is preferable that at least one of the above-mentioned $R^{101}$ and $R^{102}$ represent a methyl.

Of diazonium salt compounds which can be used in a magenta heat-sensitive recording layer, diazonium salts of the following general formula (9) are also preferable:

General formula (6)

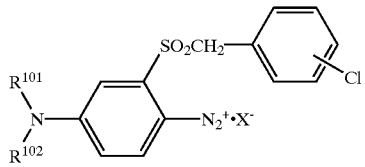

In the general formula (9), Ar represents an aryl group, $R^{111}$ and $R^{112}$ each independently represent a substituted or unsubstituted alkyl group having 1 to 18 carbon atoms or a substituted or unsubstituted aryl group having 6 to 20 carbon atoms. In the general formula (9), $R^{111}$ and $R^{112}$ may be the same and may be different from each other. $X^-$ represents an anion.

Specific examples of the above-mentioned general formulae (1), (2), (6), (8) and (9) include, but are not limited to the following compounds, in the present invention.

A-1

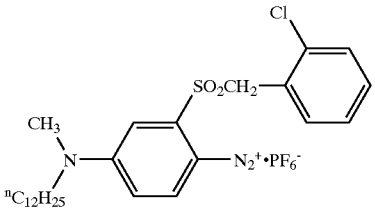

A-2

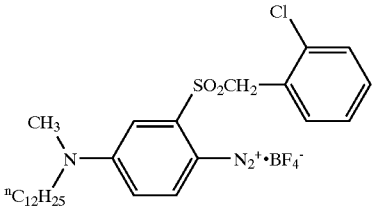

A-3

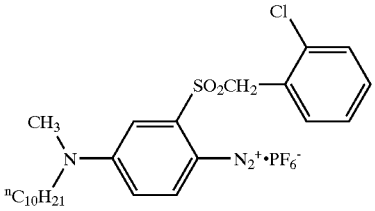

A-4

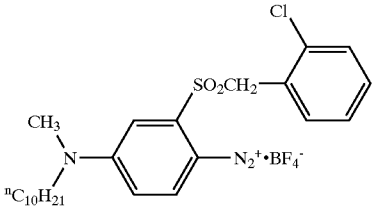

A-5

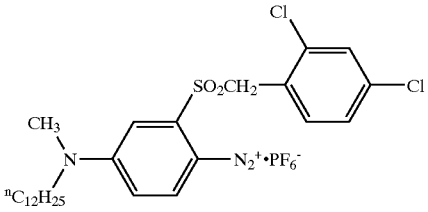

-continued
A-6
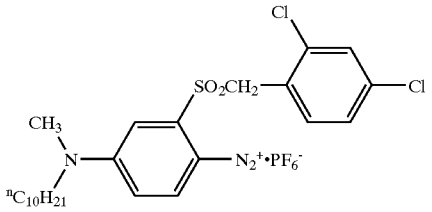
A-7
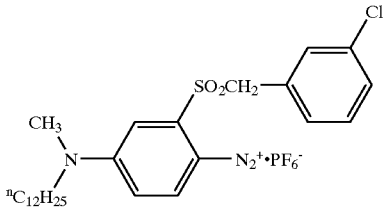
A-8
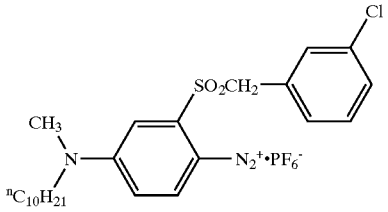
A-9
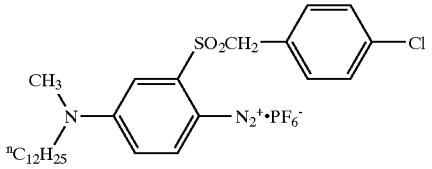
A-10
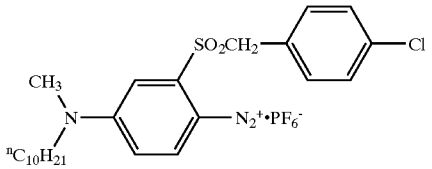
A-11
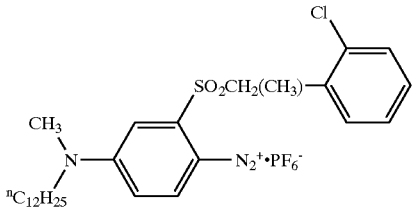
A-12
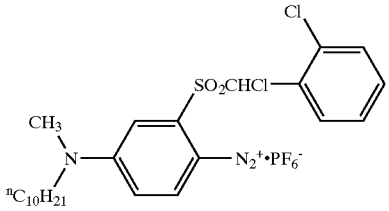

-continued
A-13
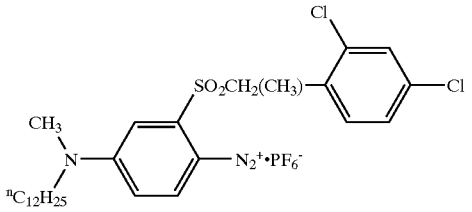
A-14
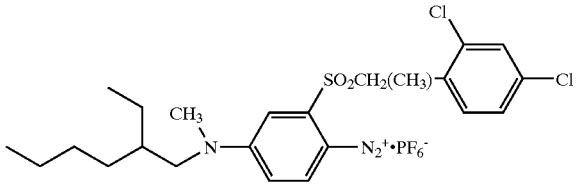
A-15
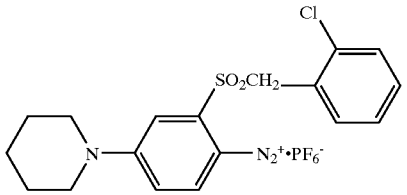
A-16
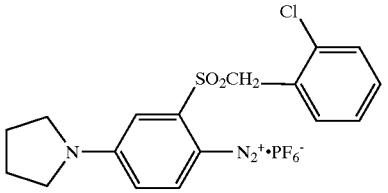
A-17
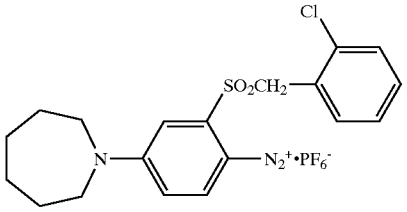
A-18
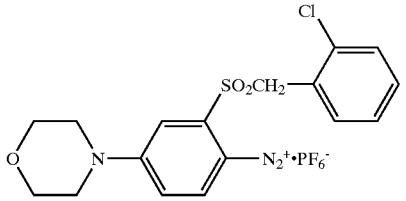
A-19
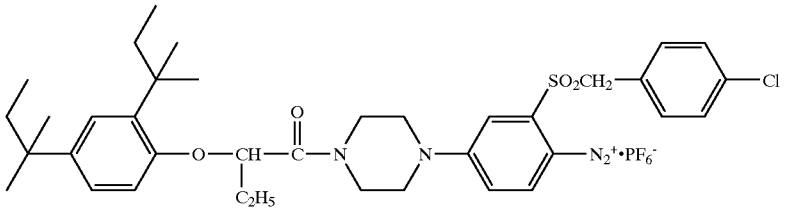

-continued
A-20
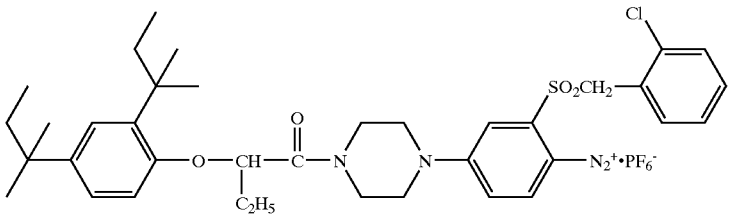
A-21
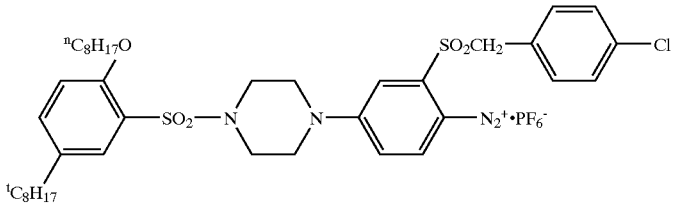
A-22
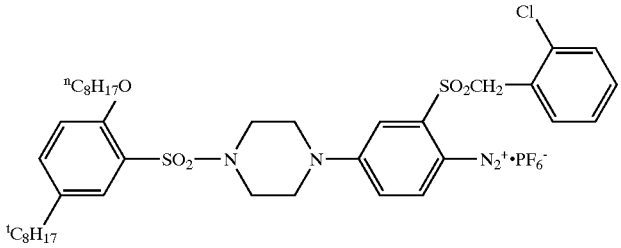
A-23
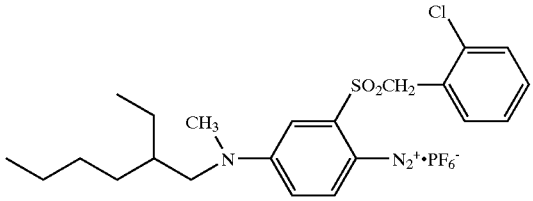
A-24
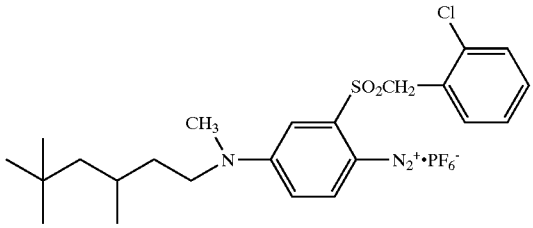
A-25
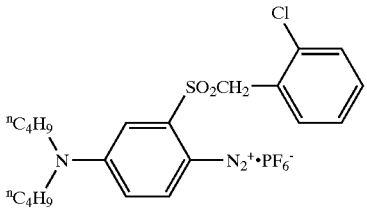
A-26
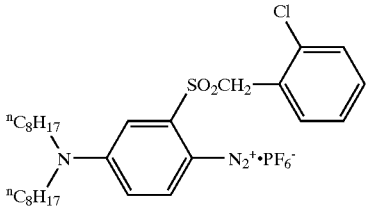

-continued
A-27
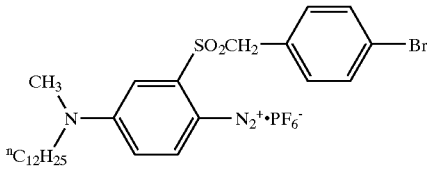
A-28
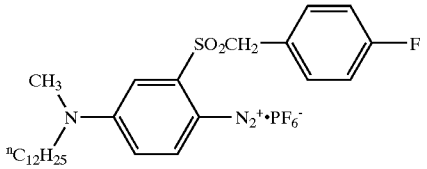
A-29
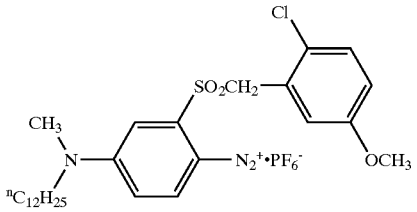
A-30
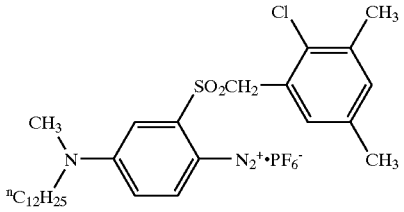
A-31
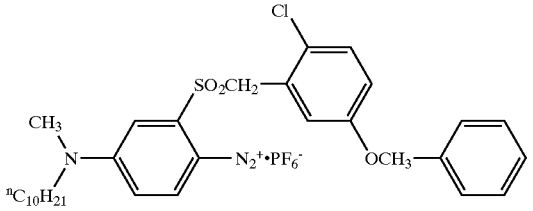
A-32
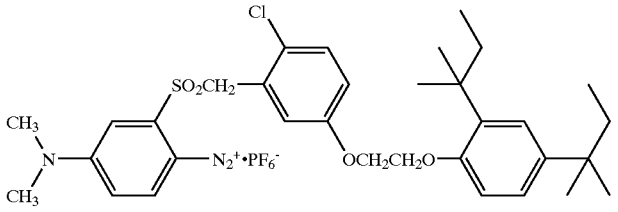
A-33
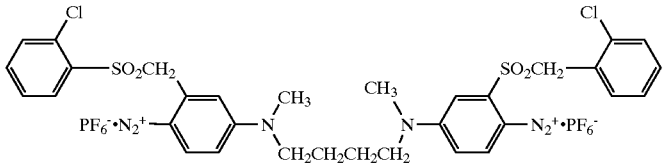
A-34
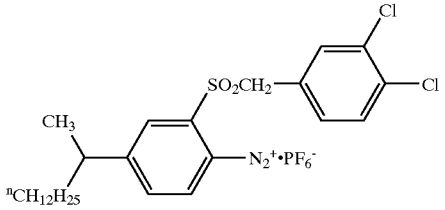

-continued
A-35
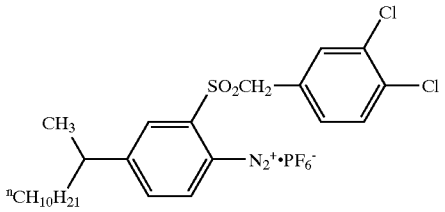
A-36
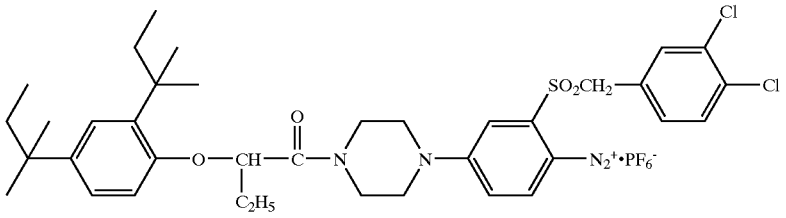
(3)-1
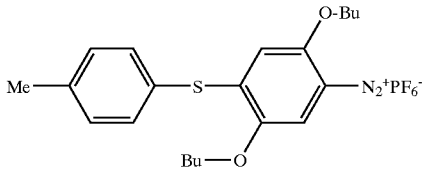
(3)-2
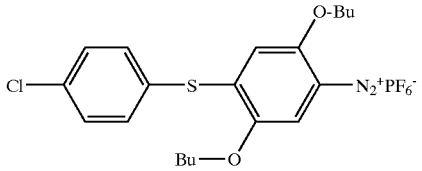
(3)-3
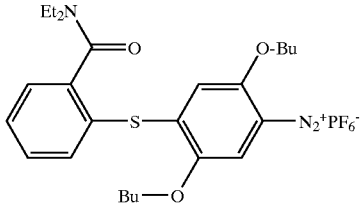
(3)-4
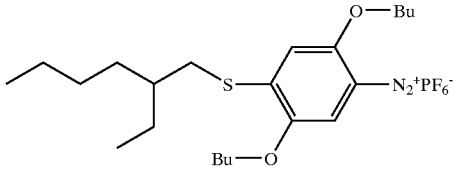
(4)-1
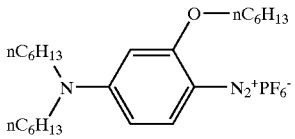
(4)-2
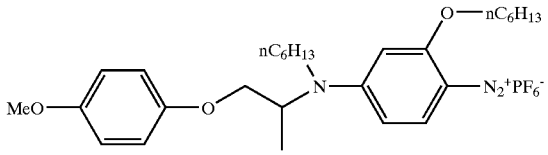

The diazonium salt represented by any of the general formulae (1), (2) and (6) can be produced by known methods. Namely, it can be synthesized by diazotizing corresponding aniline in an acidic solvent using sodium nitrite, nitrosyl sulfuric acid, isoamyl nitrite and the like.

The diazonium salt represented by the general formulae (1), (2) and (6) may be in the form of oil or crystal, and those in the form of crystal at normal temperature are preferable from the standpoint of handling.

These diazonium salts may be used singly or in combination of two or more, or may be used together with known diazonium salts.

When the above-mentioned diazonium salts is used in a photosensitive and heat-sensitive recording layer of a photosensitive and heat-sensitive recording material, the content thereof is preferably from 0.02 to 5 g/m$^2$, more preferably from 0.1 to 4 g/m$^2$, from the standpoint of color development concentration.

For stabilization of a diazonium salt of the present invention, it is also possible to form a complex compound by using zinc chloride, cadmium chloride, tin chloride and the like to stabilize a diazonium salt.

The diazonium salt of the above-mentioned general formulae (1), (2) and (6) develops color by reaction with a coupler described below to give high color development concentration, on the other hand, manifests excellent photodecomposition property in a wavelength range from 380 to 460 nm of a fluorescent lamp and the like and has high speed decomposing property which can complete sufficient fixation even by irradiation with light for a short period of time. Therefore, such a diazonium salt is very useful as a color development component used in a photosensitive and heat-sensitive recording material of light-fixation type.

Next, the coupler (coupling component) used in a magenta heat-sensitive recording material will be described.

As the above-mentioned coupler, any compound can be used providing it couples with a diazo compound in a basic atmosphere and/or a neutral atmosphere to form a coloring matter. So-called tetra-equivalent couplers for halogenated silver photography photosensitive materials can all be used as a coupler. These can be selected depending on the intended magenta hue. For example, so-called active methylene compounds having a methylene group adjacent to a carbonyl group, phenol derivatives, naphthol derivatives and the like are mentioned, and specifically, known couplers exemplified for a yellow heat-sensitive recording layer are mentioned, and used in a range corresponding to the object of the invention.

Of the above-mentioned compounds, compounds of the following general formula (7) or tautomers thereof are particularly preferable, in the present invention.

The coupler of the general formula (7) will be described in detail below.

General Formula (7)

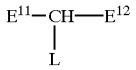

(wherein, $E^{11}$ and $E^{12}$ each independently represent an electron-attractive group, and $E^{11}$ and $E^{12}$ may be connected to form a ring. L represents a substituent which can leave upon coupling with a diazo compound).

The above-mentioned electron-attractive groups represented by $E^{11}$ and $E^{12}$ mean a substituent showing positive Hammett's $\sigma_p$ value, and may be the same and may be different from each other, and examples thereof include suitably acyl groups such as an acetyl group, propionyl group, pivaloyl group, chloroacetyl group, trichloroacetyl group, trifluoroacetyl group, 1-methylcyclopropylcarbonyl group, 1-ethylcyclopropylcarbonyl group, 1-benzylcyclopropylcarbonyl group, benzoyl group, 4-methoxybenzoyl group, thenoyl group and the like; oxycarbonyl groups such as methoxycarbonyl group, ethoxycarbonyl group, 2-methoxyethoxycarbonyl group, 4-methoxyphenoxycarbonyl group and the like; carbamoyl groups such as a carbamoyl group, N,N-dimethylcarbamoyl group, N,N-diethylcarbamoyl group, N-phenylcarbamoyl group, N-[2,4-bis(pentyloxy)phenyl]carbamoyl group, N-[2,4-bis(octyloxy)phenyl]carbamoyl group, morpholinocarbonyl group and the like; alkylsulfonyl groups or arylsulfonyl groups such as a methanesulfonyl group, benzensulfonyl group, toluenesulfonyl group and the like; phosphono groups such as a diethylphosphono group and the like; heterocyclic groups such as a benzooxazol-2-yl group, benzothiazol-2-yl group, 3,4-dihydroquinazolin-4-on-2-yl group, 3,4-dihydroquinazoline-4-sulfon-2-yl group and the like; heterocyclic groups; nitro group; imino group; cyano group.

The electron-attractive groups represented by $E^{11}$ and $E^{12}$ may be connected to form a ring. As the ring formed by $E^{11}$ and $E^{12}$, 5- to 6-membered carbon rings or hetero rings are preferable.

L in the general formula (7) represents a substituent which can leave upon coupling with a diazo compound. As the L, halogen atoms, alkylthio groups optionally having a substituent, arylthio groups optionally having a substituent, alkyl groups optionally having a substituent, alkoxy groups optionally having a substituent, aryloxy groups optionally having a substituent, arylsulfonyloxy groups optionally having a substituent, acyloxy groups optionally having a substituent, benzoyloxy groups optionally having a substituent, dialkylaminocarbonyloxy groups optionally having a substituent, diarylaminocarbonyloxy groups optionally having a substituent, alkoxycarbonyloxy groups optionally having a substituent, aryloxycarbonyloxy groups optionally having a substituent, N-pyrazolyl groups optionally having a substituent, N-imidazolyl groups optionally having a substituent, N-benzotriazolyl groups optionally having a substituent are preferable.

Specific examples of the coupler of the general formula (7) include, but are not limited to the following compounds, in the present invention. Tautomers of couplers shown below are listed as suitable examples.

(C-1)

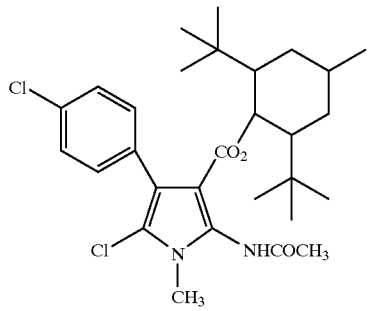

-continued
(C-2)
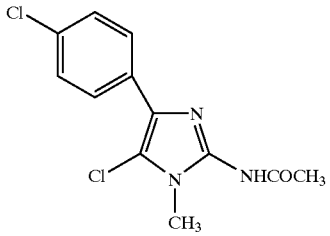
(C-3)
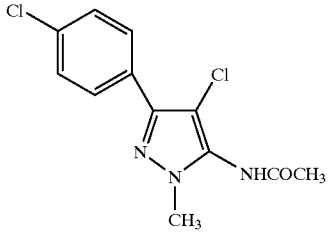
(C-4)
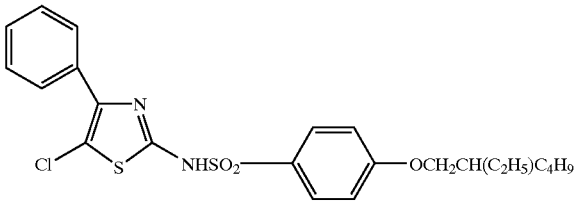
(C-5)
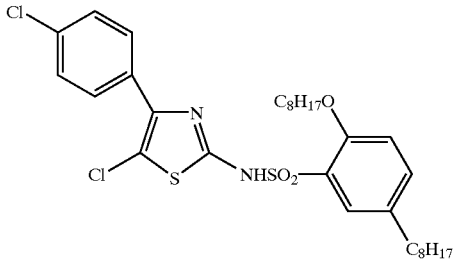
(C-6)
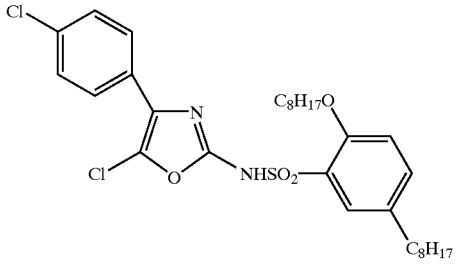
(C-7)
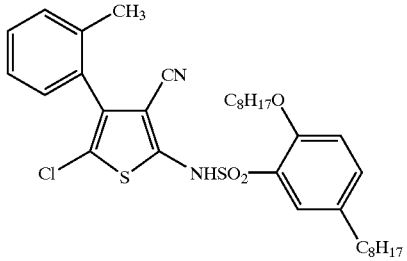
-continued
(C-8)
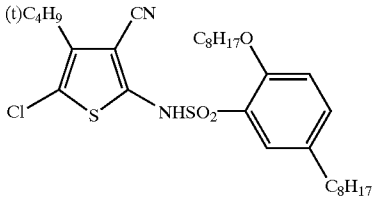
(C-9)
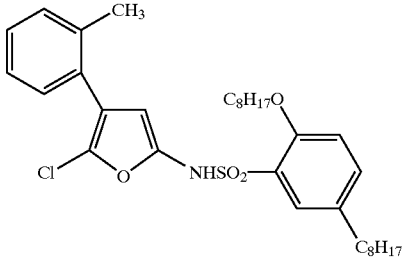
(C-10)
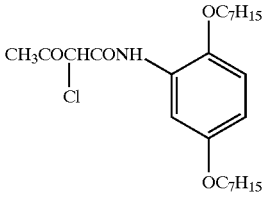
(C-11)
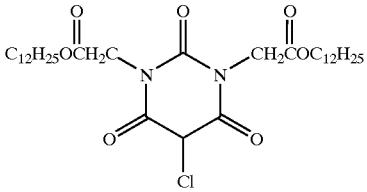
(C-12)
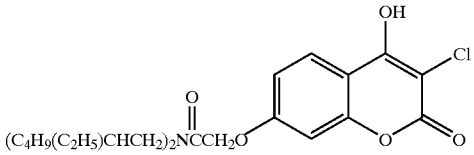
(C-13)
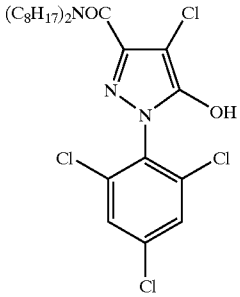
(C-14)
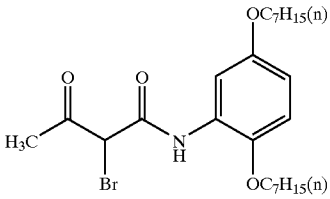

-continued
(C-15)
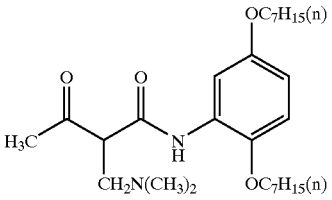
(C-16)
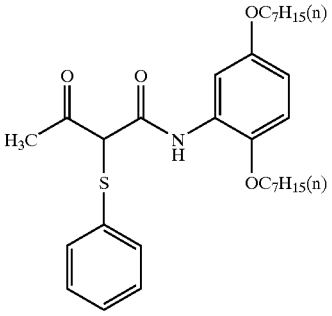
(C-17)
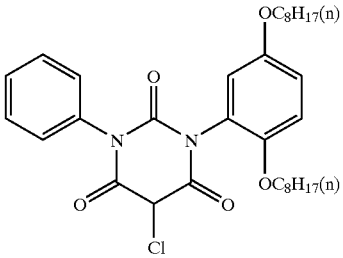
(C-18)
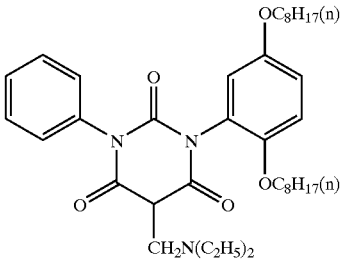
(C-19)
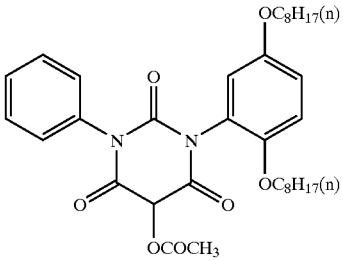
(C-20)
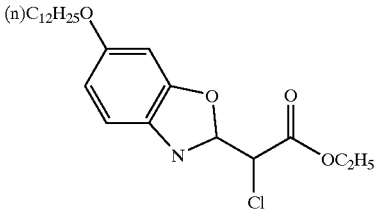
-continued
(C-21)
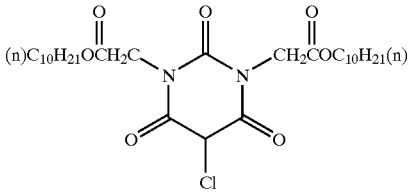
(C-22)
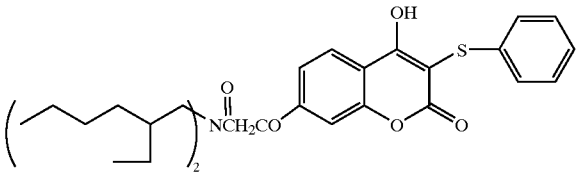
(C-23)
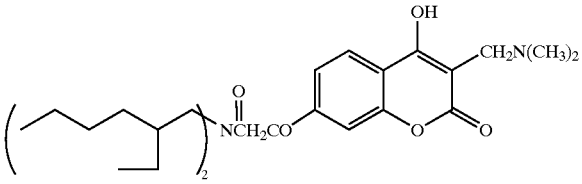
(C-24)
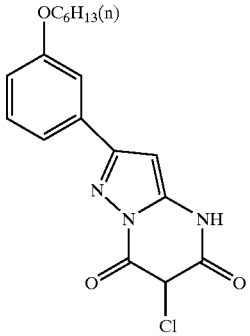
B-1
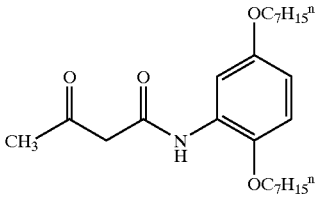
B-2
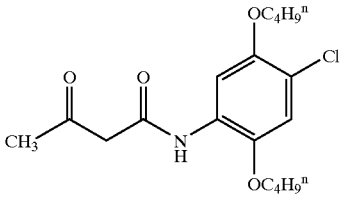
B-3
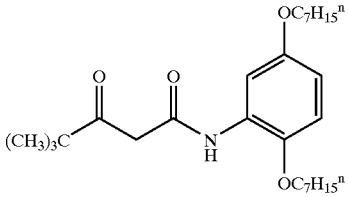

-continued
B-4
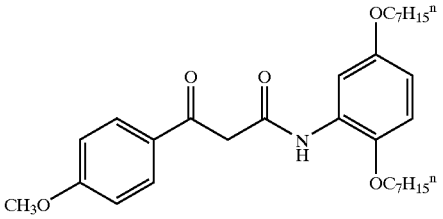
B-5
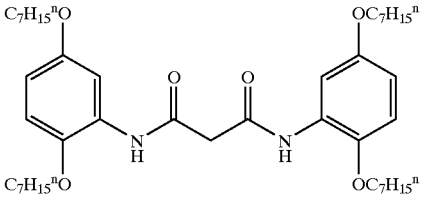
B-6
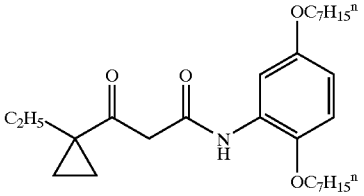
B-7
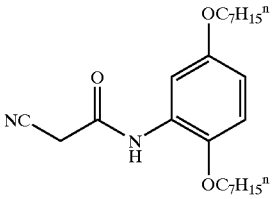
B-8
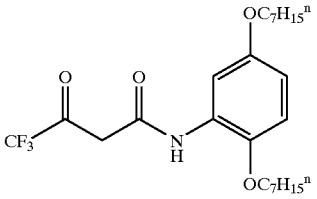
B-9
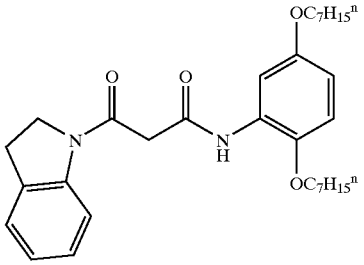
B-10
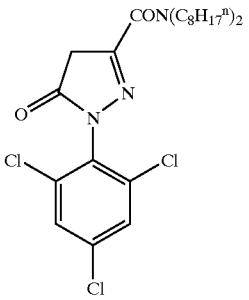
-continued
B-11
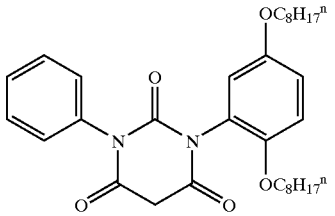
B-12
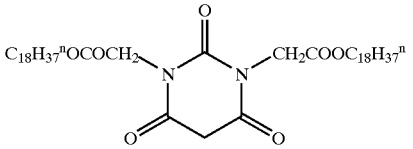
B-13
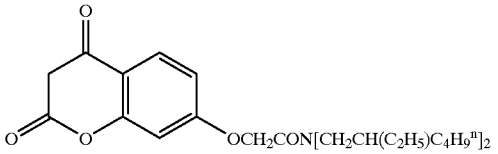
B-14
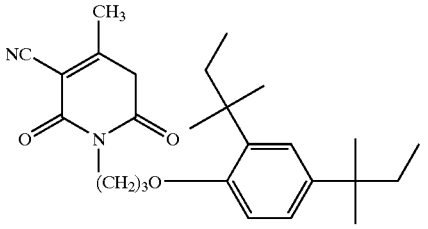
B-15
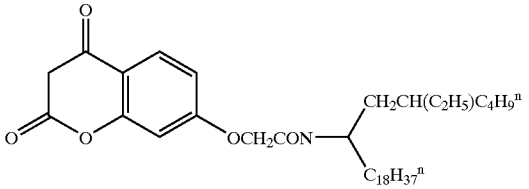
B-16
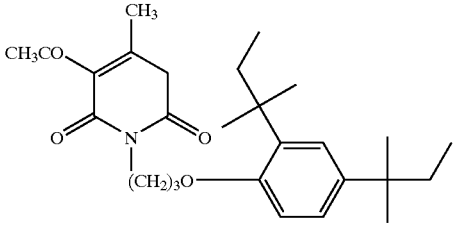
B-17
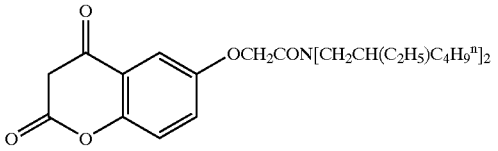
B-18
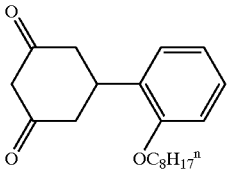

-continued
B-19
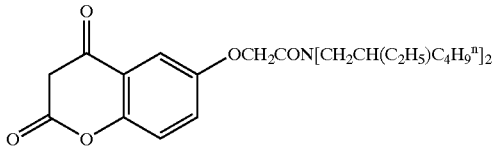
B-20
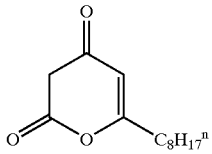
B-21
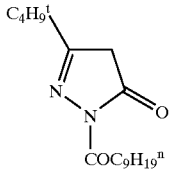
B-22
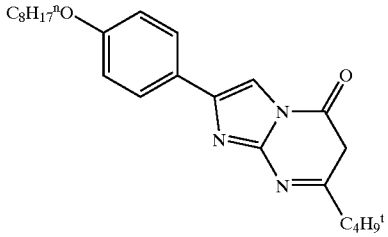
B-23
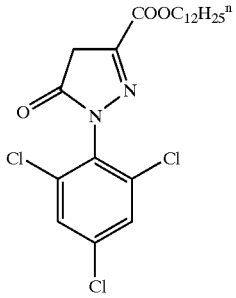
B-24
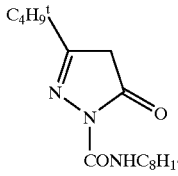
B-25
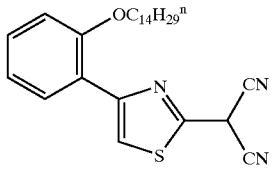
-continued
B-26
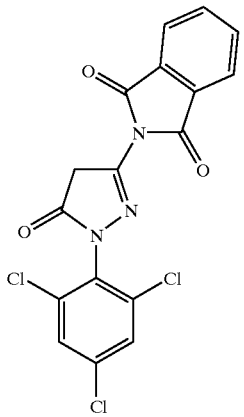
B-27
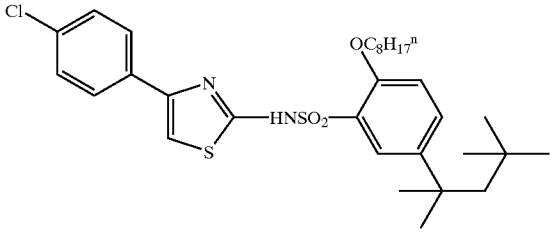
B-28
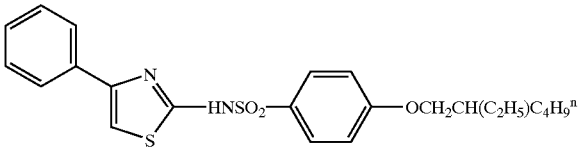
B-29
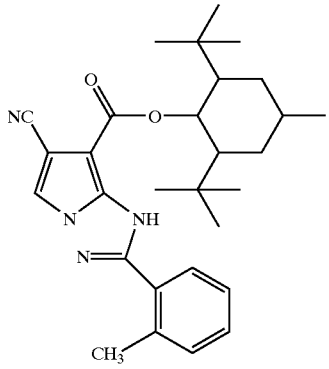
B-30
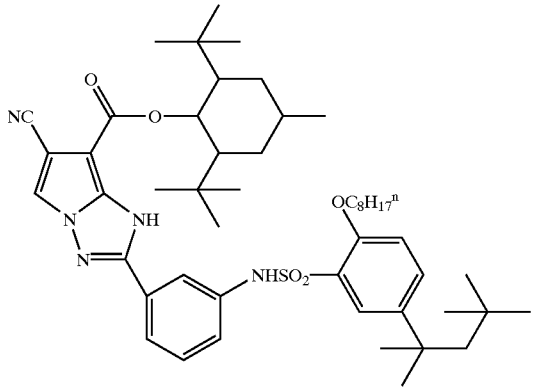

-continued

B-31

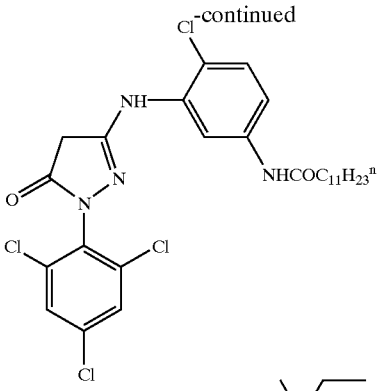

B-32

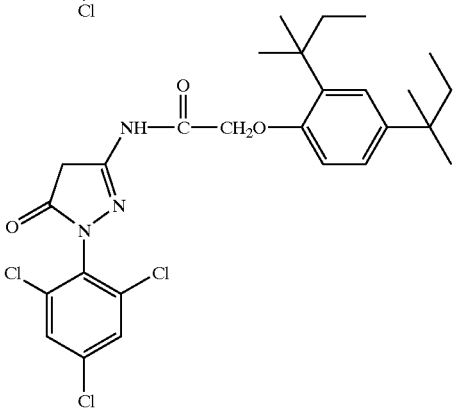

B-33

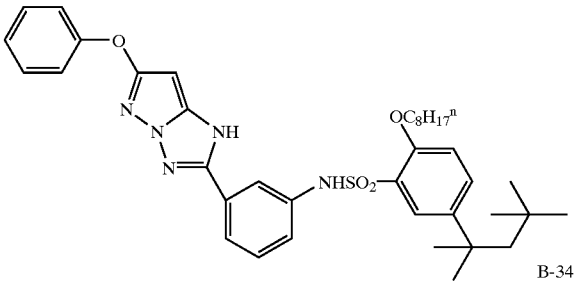

B-34

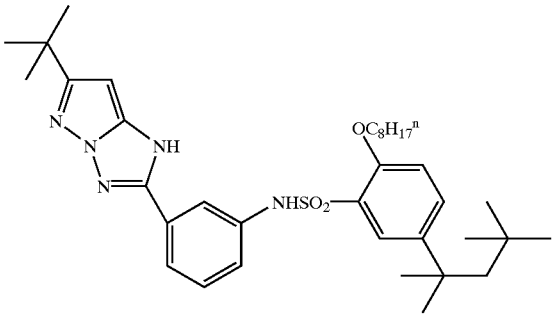

B-35

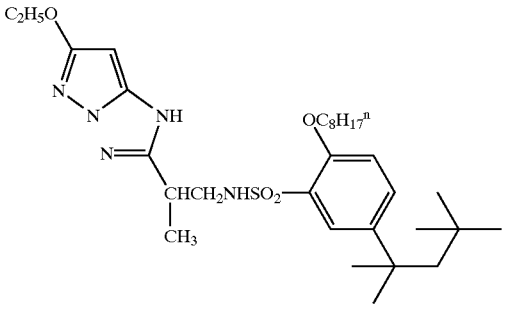

-continued

B-36

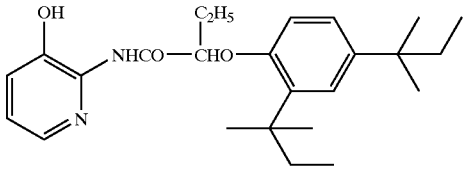

B-37

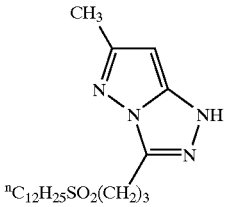

B-38

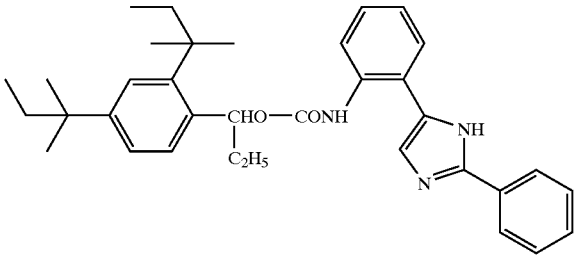

The above-mentioned tautomers of couplers mean those present as isomers of couplers typified by the above-mentioned compounds and having a relation in which structures easily changes mutually between them, and as the coupler used in the present invention, these tautomers are also preferable.

In magenta heat-sensitive recording layer, the total addition amount of all couplers is preferably from 0.5 to 10 mol per mol, and more preferably from 1 to 5 mol per mol from the standpoint of the effect, based on the addition amount of the diazonium salt in the magenta heat-sensitive recording layer.

When the above-mentioned addition amount is less than 0.5 mol per mol based on the addition amount of a diazonium salt, sufficient color-developing property may not be obtained, and when over 10 mol per mol, color-developing property decreased due to thermal efficiency and thickness is also not preferable.

Basic Substance

The above-mentioned basic substance includes also compounds which release an alkali substance by decomposition and the like in heating, in addition to inorganic or organic basic compounds. As typical examples, nitrogen-containing compounds are listed such as organic ammonium salts, organic amines, amides, urea and thiourea and derivatives thereof, thiazoles, pyrroles, pyrimidines, piperazines, guianidines, indoles, imidazoles, imidazolines, triazoles, morpholines piperidines, amidines, formazines, pyridines and the like. Specific examples thereof include tricyclohexylamine, tribenzylamine, octadecylbenzylamine, stearylamine, allylurea, thiourea, methylthiourea, allylthiourea, ethylenethiourea, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-dicyclohexylguanidine, 1,2,3-tricyclohexylguanidine, guanidine trichloroacetate, N,N'-dibenzylpiperazine, 4,4'- dithiomorpholine, morpholinium trichloroacetate, 2-aminobenzothiazole, 2-benzoylhydrazinobenzothiazole and the like. These can be used in combination of two or more.

Thickener

The above-mentioned thickener is preferably an organic compound of lower melting point having an aromatic group and a polar group adequately in the molecule, and benzyl p-benzyloxybenzoate, α-naphthyl benzyl ether, β-naphthyl benzyl ether, phenyl β-naphthoate, phenyl α-hydroxy-β-naphthoate, β-naphthol-(p-chlorobenzyl) ether, 1,4-butanediol phenyl ether, 1,4-butanediol-p-methylphenyl ether, 1,4-butanediol-p-ethylphenyl ether, 1,4-butanediol-m-methylphenyl ether, 1-phenoxy-2-(p-tolyloxy)ethane, 1-phenoxy-2-(p-ethylphenoxy) ethane, 1-phenoxy-2-(p-chlorophenoxy)ethane, p-benzylbiphenyl and the like are listed.

Microcapsules

In the present invention, embodiments for using the above-mentioned diazo compounds and/or diazonium salts, couplers that react with the diazo compounds and the like to develop color upon heating, basic substances, and thickeners are not particularly restricted. Namely, there are (1) a method in which materials are solid-dispersed and used, (2) a method in which materials are emulsion-dispersed and used, (3) a method in which materials are polymer-dispersed and used, (4) a method in which materials are latex-dispersed and used, (5) a method in which materials are microcapsulated and used, and other methods. Of them, the method in which materials are microcapsulated and used is preferable from the stand point of preservability, and particularly, it is preferable that a diazo compound and a diazonium salt are contained in the microcapsules.

As the method of microcapsulation, conventionally known microcapsulation methods can be used. Namely, a color developer, additive and microcapsule wall precursor are dissolved in an organic solvent poorly soluble or insoluble in water, and added into an aqueous solution of a water-soluble polymer and emulsion-dispersed using a homogenizer and the like and heated, to form at oil/water interface a wall film of polymer substance which will be used as a microcapsule wall. Thus, the microcapsules are prepared.

As the above-mentioned organic solvent, auxiliary solvents of lower boiling point such as acetates, methylene chloride, cyclohexanone and the like and/or phosphates, phthalates, arylates, methacrylates, other carboxylates, fatty amides, alkylated biphenyls, alkylated terphenyls, alkylated naphthalenes, diarylethanes, chlorinated paraffins, alcohols, phenols, ethers, monoolefins, epoxys and the like are listed. Specific examples thereof include oils of higher boiling point such as tricresyl phosphate, trioctyl phosphate, octyldiphenyl phosphate, tricyclohexyl phosphate, dibutyl phthalate, dioctyl phthalate, dilauryl phthalate, dicyclohexyl phthalate, butyl olefinate, diethylene glycol benzoate, dioctyl sebacate, dibutyl sebacate, dioctyl adipate, trioctyl trimellitate, acetyltriethyl citrate, octyl maleate, dibutyl maleate, isoamylbiphenyl, chlorinated paraffin, diisopropylnaphthalene, 1,1'-ditolylethane, 2,4-ditertiaryamylphenol, N,N-dibutyl-2-butoxy-5-tertiaryoctylaniline, 2-ethylhexyl hydroxybenzoate, polyethylene glycol and the like. Of them, particularly, alcohols, phosphates, carboxylates, alkylated biphenyls, alkylated terphenyls, alkylated naphthalenes, diarylethane are preferable. Further, a carbonization preventing agent such as hindered phenol, hindered amine and the like may be added to the above-mentioned oil of higher boiling point. As the oil, particularly, those containing an unsaturated fatty acid are desirable, and α-methylstyrene dimer and the like are listed. As the α-methylstyrene dimer, for example, "MSD100", trade name, manufactured by Mitsui Toatsu Chemicals, Inc., and the like are mentioned.

As the water-soluble polymer, water-soluble polymers such as polyvinyl alcohol and the like are used, and emulsion of higher molecular weight having hydrophobicity, latex and the like can also be used together. As the water-soluble polymer, polyvinyl alcohol, silanol-denatured polyvinyl alchol, carboxy-denatured polyvinyl alchol, amino-denatured polyvinyl alchol, itaconic acid-denatured polyvinyl alchol, styrene-maleic anhydride copolymer, butadiene-maleic anhydride copolymer, ethylene-maleic anhydride copolymer, isobutylene-maleic anhydride copolymer, polyacrylamide, polystyrenesulfonic acid, polyvinylpyrrolidone, ethylene-acrylic acid copolymer, gelatin and the like are listed, and of them, particularly, carboxy-denatured polyvinyl alcohol or gelatin is preferable. As the emulsion of higher molecular weight having hydrophobicity or latex, a styrene-butadiene copolymer, carboxy-denatured styrene-butadiene copolymer, acrylonitrile-butadiene copolymer, and the like are listed. Here, conventionally known surfactants and the like may be added if necessary.

As the specific examples of a polymer substance which is used as a wall film of the microcapsules, polyurethane resins, polyurea resins, polyamide resins, polyester resins, polycarbonate resins, aminoaldehyde resins, melamine resins, polystyrene resin, styrene-acrylate copolymer resin, styrene-methacylate copolymer resin, gelatin, polyvinyl alcohol and the like are listed, for example. Of them, polyurethane.polyurea resins are particularly preferable wall materials.

Microcapsules having a wall film made of polyurethane-.polyurea resins are produced by mixing a microcapsule wall precursor such as a polyvalent isocyanate and the like into a core substance to be capsulated, and emulsion-dispersing the mixture in an aqueous solution of a water-soluble polymer such as polyvinyl alcohol, gelatin and the like, and raising the liquid temperature to cause a polymer formation reaction of the oil drop interface.

Parts of specific examples of the polyvalent isocyanate compound will be shown below. For example, isocyanate prepolymers are listed such as diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-diphenylmethane-4,4'-diisocyanate, xylene-1,4-diisocyanate, 4,4'-diphenylpropane diisocyanate, trimethylene diisocyanate, hexamethylene diisocyanate, propylene-1,2-diisocyanate, butylenes-1,2-diisocyanate, cyclohexylene-1,2-diisocyanate, cyclohexylene-1,4-diisocyanate and the like, triisocyanates such as 4,4',4"-triphenylmethane triisocyanate, toluene-2,4,6-triisocyanate and the like, tetraisocyanates such as 4,4'-dimethylphenylmethane-2,2',5,5'-tetraisocyanate and the like, adduct of hexamethylene diisocyanate and trimethylolpropane, adduct of 2,4-tolylene diisocyanate and trimethylolpropane, adduct of xylylene diisocyanate and trimethylolpropane, adduct of tolylene diisocyanate and hexane triol, and the like. If necessary, two or more of them can also be used. Of them, particularly preferable are those having three or more isocyanate groups in the molecule.

In the microcapsulation method, the oils exemplified in emulsion-dispersion can be used as the organic solvent dissolving color developers, additives and microcapsule wall precursors. The same conditions are applied also to the water-soluble polymer.

The particle size of the microcapsule is preferably from 0.1 to 1.0 μm, further preferably from 0.2 to 0.7 μm.

Recording Method

The heat-sensitive recording material of the present invention constitutes a full-color heat-sensitive recording material including three provided heat-sensitive recording layers obtained by combining at least three diazonium salts compounds having different photosensitive wavelengths with couplers developing different hues by reacting with the respective diazonium salt compounds upon heating.

For example, provided on a support are a first heat-sensitive recording layer (yellow heat-sensitive recording layer) containing a diazo compound having a maximum absorption wavelength of 350 nm or less, and the like and a coupler that develops color by reacting with the diazo compound when heated or the like, a second heat-sensitive recording layer (cyan heat-sensitive recording layer) containing a diazo compound having a maximum absorption wavelength of 370±30 nm, and the like and a coupler that develops color by reacting with the diazo compound when heated or the like, and a third heat-sensitive recording layer (magenta heat-sensitive recording layer) containing a diazo compound having a maximum absorption wavelength of 430±30 nm, and the like and a coupler that develops color by reacting with the diazo compound when heated or the like.

In the method of recording this full-color heat-sensitive recording material, first the third heat-sensitive recording layer (magenta heat-sensitive recording layer) is heated, to allow the diazo compound or the like and the coupler contained in this layer to develop color. Next, unreacted diazo compound or the like contained in the third heat-sensitive recording layer are decomposed by irradiation with light of 430±30 nm, then, heat sufficient for color development of the second heat-sensitive recording layer (cyan heat-sensitive recording layer) is applied, to allow the diazo compound or the like and the coupler contained in this layer to develop color. In this stage, though the third heat-sensitive recording layer is also intensively heated simultaneously, color development does not occur since the diazo compound or the like have already been decomposed to lose color-developing ability. Further, the diazo compound or the like contained in the second heat-sensitive recording layer are decomposed by irradiation with light of 370±30 nm, and finally, heat sufficient for color development of the first heat-sensitive recording layer is applied, to cause color development. In this stage, though the third and second heat-sensitive recording layers are also intensively heated simultaneously, color development does not occur since the diazo compounds and the like contained in the third and second heat-sensitive recording layers have already been decomposed to lose color-developing ability.

As the light source used for light decomposition (light-fixation) of the above-mentioned diazo compound or the like, various fluorescent lamps, xenon lamps, mercury lamps and the like are listed, and it is preferable that the emission spectra of these light sources coincide approximately with the absorption spectra of the diazonium salts in the photosensitive heat-sensitive recording materials, from the standpoint of high efficiency fixation.

Particularly, in the present invention, it is particularly preferable to use a light source showing emission center wavelength of 340 to 460 nm of light irradiated.

Also possible is use as a heat development-type heat-sensitive recording material in which image-wise inscription is effected by light and thermal development is effected to manifest images. In this case, the printing and imaging process is conducted by a light source such as a laser or the like instead of the above-mentioned heating apparatus.

Antioxidant

In the present invention, known antioxidants shown below can be used for further improving light resistance, and for example, those described in EP-A No. 310551, GE-A No. 3435443, EP-A No. 310552, JP-A No. 3-121449, EP-A No. 459416, JP-A Nos. 2-262654, 2-71262, 63-163351, U.S. Pat. No. 4,814,262, JP-A Nos. 54-48535, 5-61166, 5-119449, U.S. Pat. No. 4,980,275, JP-A Nos. 63-113536, 62-262047, EP-A No. 223739, EP-A Nos. 309402, 309491 and the like are listed. Specifically, the following compounds are listed.

Q-1

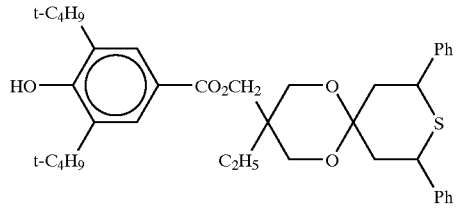

Q-2

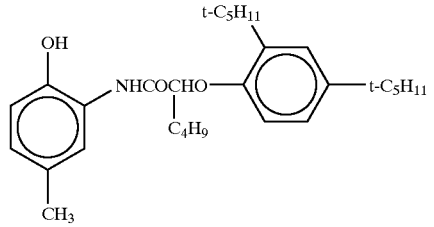

Q-3

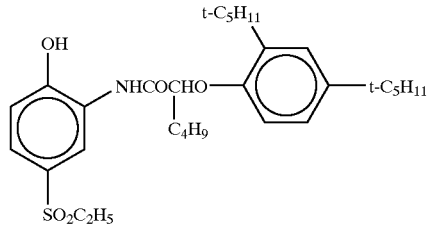

Q-4

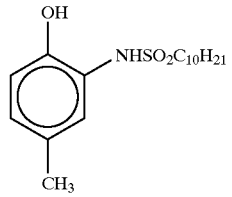

Q-5

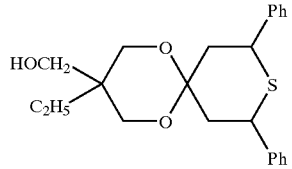

Q-6

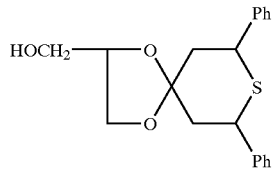

-continued
Q-7
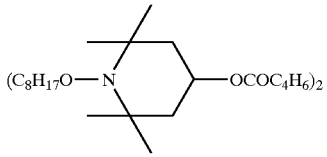
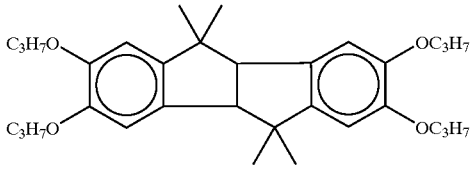
Q-8
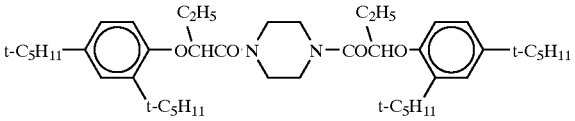
Q-9
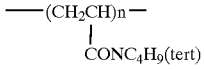
Q-10
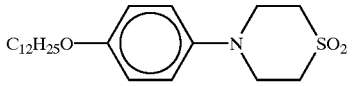
Q-11
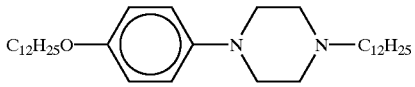
Q-12
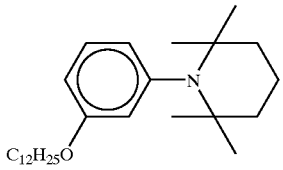
Q-13
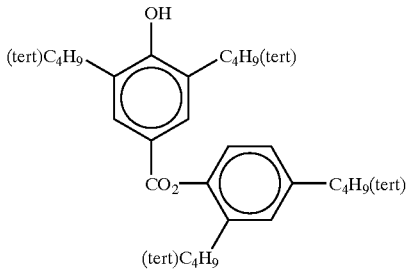
Q-14
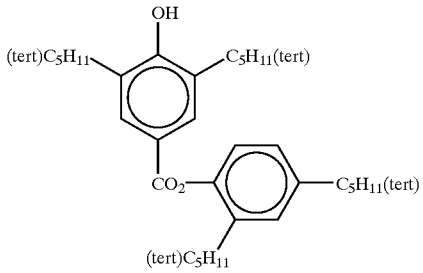
-continued
Q-15
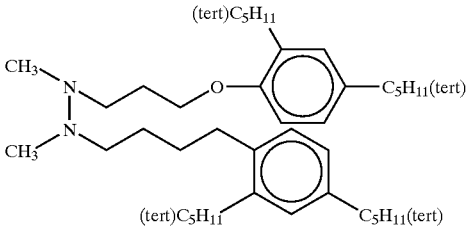
Q-16
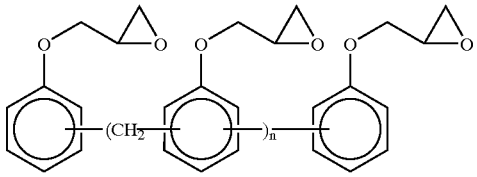
Q-17
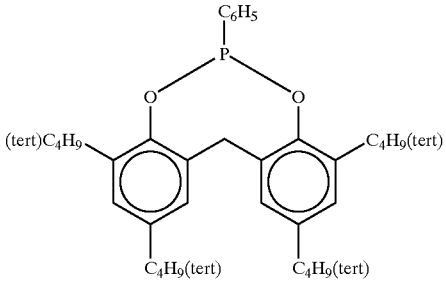
Q-18
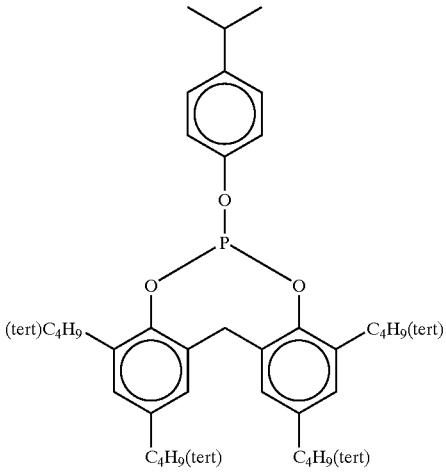
Q-19
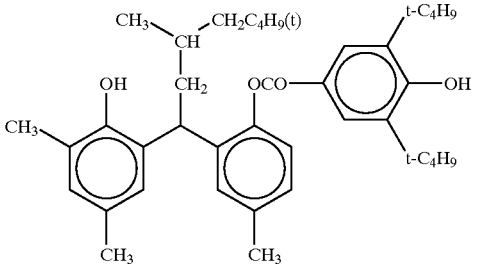

-continued

Q-20

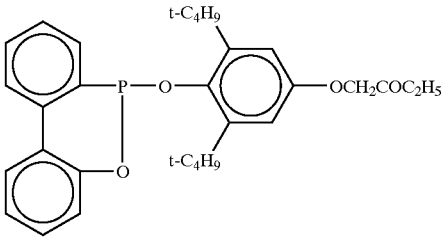

Q-21

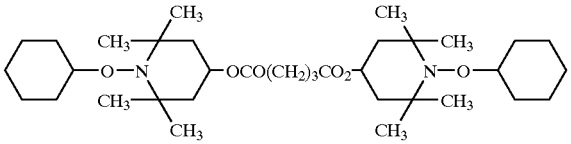

Q-22

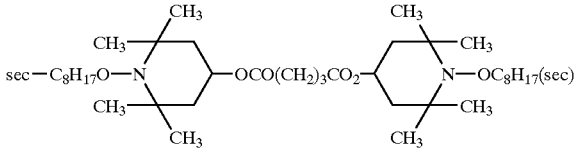

Q-23

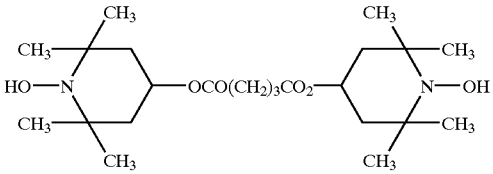

Q-24

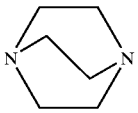

Q-25

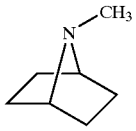

Q-26

$(C_{14}H_{27}OCOCH_2CH_2)_2S$

Q-27

$(C_{18}H_{27}OCOCH_2CH_2)_2S$

Q-28

$(C_{12}H_{25}SCH_2CH_2CO_2CH_2)_4C$

Further, it is also effective to use various additives already known as the heat-sensitive recording material and pressure sensitive recording layer. Of them, as partial examples of the antioxidant, there are listed those described in JP-A Nos. 60-125470, 60-125471, 60-125472, 60-287485, 60-287486, 60-287487, 62-146680, 60-287488, 62-282885, 63-89877, 63-88380, 63-088381, 01-239282, 04-291685, 04-291684, 05-188687, 05-188686, 05-110490, 05-1108437, 05-170361, 63-203372, 63-224989, 63-267594, 63-182484, 60-107384, 60-107383, 61-160287, 61-185483, 61-211079, 63-251282 and 63-051174, JP-B Nos. 48-043294 and 48-033212, and the like.

Specific examples thereof include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanoate, 2,2-bis-4-hydroxyphenylpropane, 1,1-bis-4-hydroxyphenyl-2-ethylhexane, 2-methyl-4-methoxydiphenylamine, 1-methyl-2-phenylindole, and the compounds shown below.

Q-29

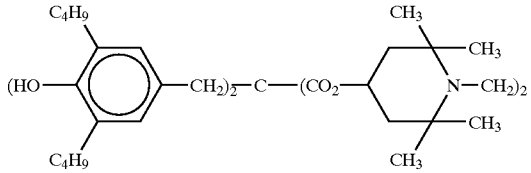

Q-30

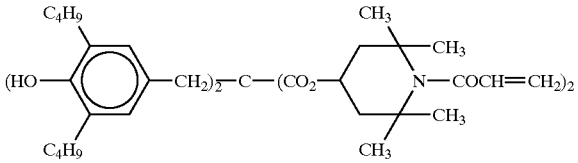

Q-31

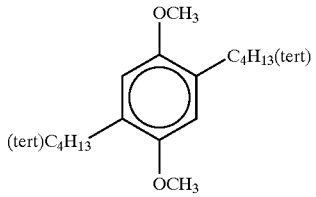

Q-32

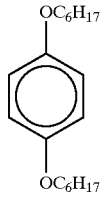

Q-33

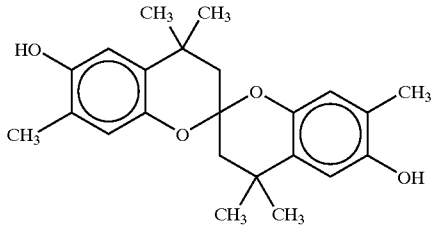

Q-34

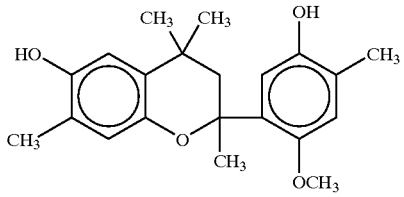

Q-35

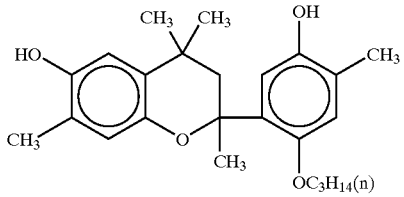

-continued
Q-36
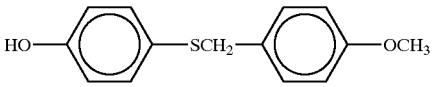
Q-37
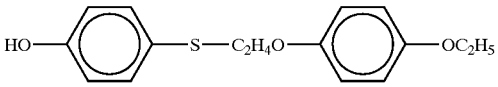
Q-38
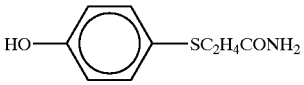
Q-39
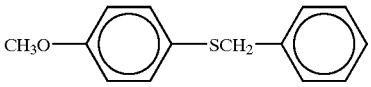
Q-40
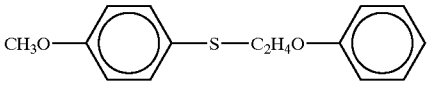
Q-41
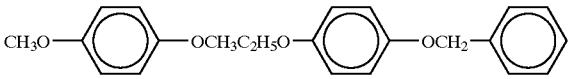
Q-42
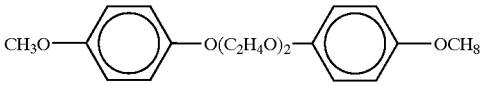
Q-43
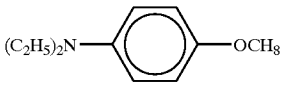
Q-44
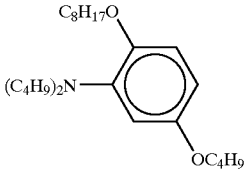
Q-45
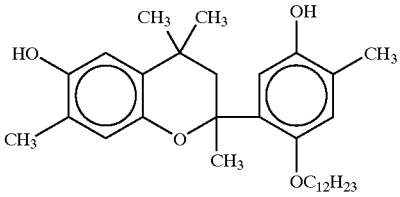
and
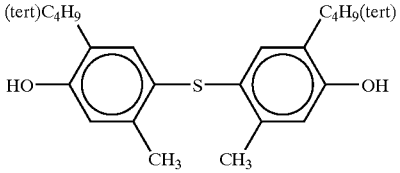
Q-46
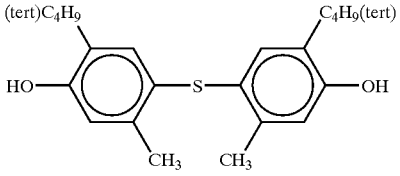
and hydroquinone ether
-continued
Q-47
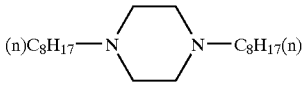
Q-48
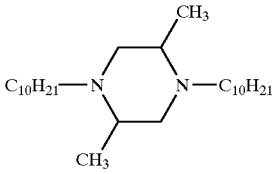
Q-49
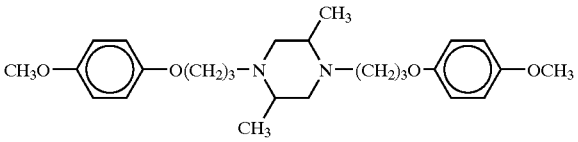
Q-50
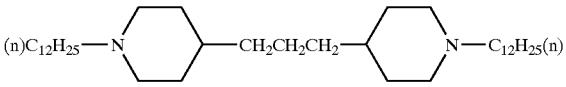
Q-51
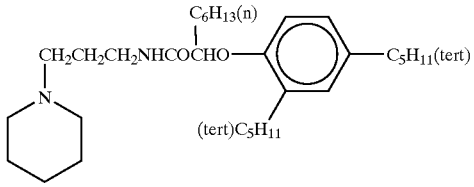
Q-52
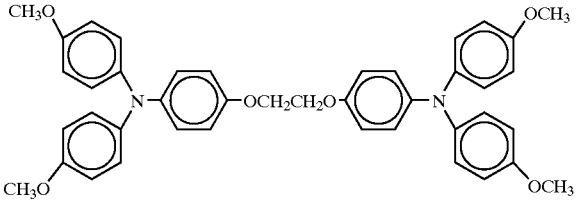
Q053
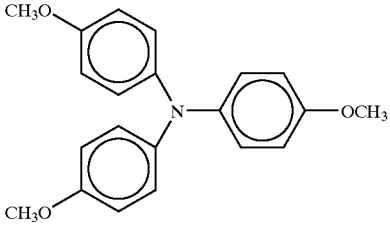
Q-54
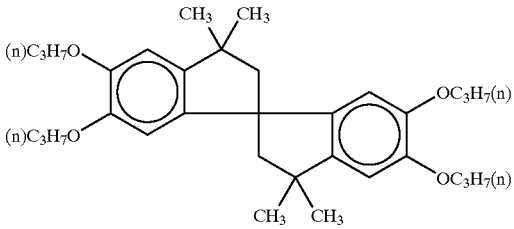

-continued

Q-55

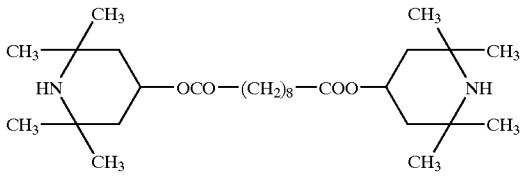

Q-56

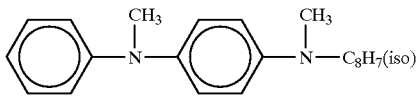

Q-57

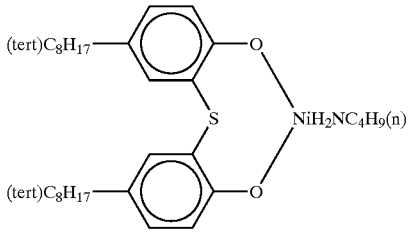

Q-58

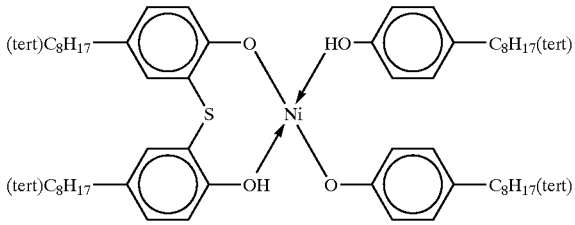

The antioxidants can be added to the heat-sensitive recording layer or intermediate layer, light transmittance-controlling layer or protective layer. When these antioxidants are used in combination, for example, combinations of the specific examples (Q-7), (Q-45), (Q-46) or (Q-10) with (Q-13) are mentioned.

Support

As the support in the present invention, plastic films, paper, plastic resins, provided paper, synthetic paper and the like can be used.

Light Transmittance-controlling Layer

The light transmittance-controlling layer contains a component functioning as a precursor of an ultraviolet absorber, and does not function as an ultraviolet absorber until irradiation with light in a range necessary for fixation. Therefore, light transmittance thereof is high, and when a light-fixation type heat-sensitive recording layer is fixed, wavelengths in a range necessary for fixation are transmitted sufficiently. Further, transmittance of visible light is also high and no problem occurs for fixation of the heat-sensitive recording layer. The properties of the light transmittance-controlling layer can be selected optionally depending on the properties of the light-fixation type heat-sensitive recording layers.

After completion of irradiation with light having a wavelength in a range necessary for fixation by light irradiation of the light-fixation type heat-sensitive recording layers, the precursor of this ultraviolet absorber is set to function as the ultraviolet absorber, by a reaction caused by light or heat or the like. Most of light having a wavelength in a range necessary for fixation of ultraviolet rays is absorbed by the ultraviolet absorber, transmittance decreases, and the light resistance of the heat-sensitive recording material is improved. However, the transmittance of visible rays does not substantially change since an effect of absorbing visible ray is not exerted.

In the present invention, as the compound contained in the light transmittance-controlling layer, for example, compounds described in JP-A No. 9-1928 can be used.

It is preferable to provide at least one light transmittance-controlling layer in a light-fixation type heat-sensitive recording layer, and most desirably, the light transmittance-controlling layer is advantageously formed between a light-fixation type magenta heat-sensitive recording layer and a protective layer which is the outermost layer.

Intermediate Layer

For prevention of color mixing between photosensitive heat-sensitive recording layers, it is also possible to provide an intermediate layer between photosensitive heat-sensitive recording layers. This intermediate layer is preferably made of a water-soluble polymer compound such as gelatin, phthalated gelatin, polyvinyl alcohol, polyvinylpyrrolidone and the like, and may contain various additives appropriately.

When a material having high $O_2$ permeability such as provided paper or the like is used as the support, a primer layer can be provided as an $O_2$ cutting layer to improve light resistance.

It is effective to allow the intermediate layer and primer layer to contain swellable inorganic laminar compounds as described in Japanese Patent Application No. 7-113825, for preventing color mixing and improving light resistance, at smaller thickness.

Protective Layer

In the photosensitive heat-sensitive recording material of the present invention, a protective layer may be provided on a photosensitive heat-sensitive recording layer, if necessary. If necessary, two or more protective layers may be provided.

As the material used in the above-mentioned protective layer, water-soluble polymer compounds such as polyvinyl alcohol, carboxyl-denatured polyvinyl alcohol, vinyl acetate-acrylamide copolymer, silicon-denatured polyvinyl alcohol, starch, modified starch, methylcellulose, carboxymethylcellulose, hydroxymethylcellulose, gelatins, gum Arabic, casein, styrene-maleic acid copolymer hydrolysate, styrene-maleic acid copolymer half ester hydrolysate, isobutylene-maleic anhydride copolymer hydrolysate, polyacrylamide derivatives, polyvinylpyrrolidone, sodium polystyrenesulfonate, sodium alginate and the like, and latexes such as styrene-butadiene rubber latex, acrylonitrile-butadiene rubber latex, methyl acrylate-butadiene rubber latex, vinyl acetate emulsion and the like, and other materials are listed.

The above-mentioned water-soluble polymer compound can also be cross-linked to further improve storage stability. The cross-linking agent can be appropriately selected from known cross-linking agents, and for example, water-soluble initial condensates such as N-methylolurea, N-methylolmelamine, urea-formalin and the like; dialdehyde compounds such as glyoxal, glutaraldehyde and the like; inorganic cross-linking agents such as boric acid, borax and the like; plyamide epichlorohydrin, and the like are listed.

The above-mentioned protective layer can also use further known pigments, metal soaps, waxes, surfactants and the like.

The application amount of the protective layer is preferably from 0.2 to 5 g/m$^2$, more preferably from 0.5 to 2 g/m$^2$ in terms of dried amount. The film thickness is preferably from 0.2 to 5 $\mu$m, more preferably from 0.5 to 2 $\mu$m.

When the protective layer is provided, the protective layer may contain known ultraviolet absorbers and precursors thereof.

The above-mentioned protective layer can be provided by the above-mentioned known application methods, as in the case of formation of a photosensitive heat-sensitive recording layer on a support.

EXAMPLES

The following examples illustrate the present invention more specifically below, but do not limit the scope of the invention.

Example 1

Support Equipped with Primer Layer 40 parts by weight of oxygen-decomposed gelatin (average molecular weight: 10000, PAGI method viscosity: 1.5 mPa·s (15 mP), PAGI method jelly strength: 20 g) was added to 60 parts by weight of ion exchange water and the mixture was dissolved by stirring at 40° C., to prepare a gelatin aqueous solution for primer layer.

Separately, 8 parts by weight of water-swellable synthetic mica (aspect ratio: 1000, trade name: Somashif ME100, manufactured by Co-op Chemical Co., Ltd.) and 92 parts by weight of water were mixed. Then, the mixture was wet-dispersed by a visco-mill, to obtain a mica dispersion having a volume average particle size of 2.0 $\mu$m. To this mica dispersion was added water so that the mica concentration was 5 wt %, and they were mixed uniformly, to prepare a desired mica dispersion.

Next, to 100 parts by weight of the 40 wt % gelatin aqueous solution for primer layer at 40° C. was added 120 parts by weight of water and 556 parts by weight of methanol, and they were mixed sufficiently. Then, 208 parts by weight of the above-mentioned 5 wt % mica dispersion was added, and mixed by stirring sufficiently, to obtain 9.8 parts by weight of a 1.66 wt % polyethylene oxide surfactant. Then, 7.3 parts by weight of ethylene diglycidyl ether was added as a gelatin film hardening agent while keeping the liquid temperature 35° C. to 40° C. to prepare application liquid for primer layer (5.7 wt %).

This application liquid for primer layer was applied on one surface of a support on both surfaces of which a polyethylene film had been provided, so that the application amount of mica was 0.2 g/m$^2$, to form a primer layer.

Preparation of Phthalated Gelatin Solution 32 parts by weight of phthalated gelatin (trade name: MGP gelatin, manufactured by Nibbicollegen K.K.), 0.9143 parts by weight of 1,2-benzothiazolin-3-one (3.5% methanol solution, manufactured by Daito Chemical Industries, Ltd.) and 367.1 parts by weight of ion exchange water were mixed and dissolved at 40° C., to obtain a phthalated gelatin aqueous solution.

Preparation of Gelatin Solution for Emulsion Production 25.5 parts by weight of alkali-treated low ion gelatin (trade name: #750 gelatin, manufactured by Nitta Gelatin Inc.), 0.7286 parts by weight of 1,2-benzothiazolin-3-one (3.5% methanol solution, manufactured by Daito Chemical Industries, Ltd.), 0.153 parts by weight of calcium hydroxide and 143.6 parts by weight of ion exchange water were mixed and dissolved at 50° C., to obtain a gelatin aqueous solution for emulsion production.

Preparation of Diazonium Salt Compound-containing Microcapsule Liquid Preparation of Diazonium Salt-containing Microcapsule Liquid (a)

To 15.0 parts by weight of ethyl acetate was added 3.2 parts by weight of the following diazonium salt (A) (maximum absorption wavelength: 420 nm) and 10.7 parts by weight of diphenyl phthalate, and the mixture was uniformly dissolved. Into the above-mentioned mixture was added 9.7 parts by weight of a mixture of xylylene diisocyanate/trimethylolpropane adduct and xylylene diisocyanate/bisphenol A adduct (trade name: Takenate D110N (50 wt % ethyl acetate solution), manufactured by Takeda Chemical Industries, Ltd.) as a capsule wall material, and they were stirred uniformly to obtain a mixture (I).

Separately, to 65 parts by weight of a 8 wt % phthalated gelatin aqueous solution was added 18.1 parts by weight of ion exchange water and 0.38 parts by weight of SUCRAPH™ AG-8 (nonionic surfactant, 50 wt %, manufactured by Nippon Fine Chemical Co., Ltd.), and further, mixed liquid (I) (solution) of the diazonium salt (A) obtained above was added, and the mixture was emulsion-dispersed at 40° C. by using a homogenizer (manufactured by Nippon Seiki Seisakusho K.K.). To the resulting emulsion was added 10 parts by weight of water, and the mixture was uniformalized. Then, a capsulation reaction was conducted for 3 hours while stirring at 40° C. Then, ion exchange resins (AMBERLITE™ IRA-68 4.6 wt %, AMBERLITE™ IRC-50 9.2 wt %, both manufactured by Organo Corporation) were added, the mixture was further stirred for 1 hour. Then, the ion exchange resins were filtrated off, to this was added 0.7 parts by weight of a 5% hydroquinone aqueous solution and the mixture was stirred. Then, the concentration was controlled so that the solid concentration of the capsule liquid was 24.5%, to obtain diazonium salt-containing microcapsule liquid (a). diazonium salt (A)

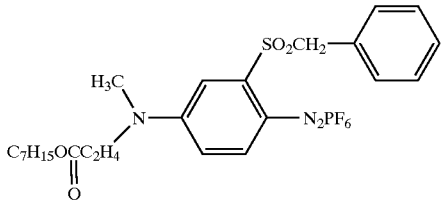

Preparation of Diazonium Salt-containing Microcapsule Liquid (b)

To 15.1 parts by weight of ethyl acetate was added 3.4 parts by weight of the following diazonium salt (B) (maximum absorption wavelength: 365 nm), 5.7 parts by weight of tricresyl phosphate and 5.7 parts by weight of isopropylbiphenyl, 0.2 parts by weight of 2,2-dimethoxy-1,2-diphenylethan-1-on (trade name: Irgacure 651, manufactured by Chiba Speciality Chemicals K.K.) and 0.5 parts by weight of diphenyl-(2,4,6-trimethylbenzoyl)phosphine oxide (trade name: Rucilin TPO, manufactured by BASF Japan Ltd.), and the mixture was uniformly dissolved by heating. Into the above-mentioned mixture was added 14.1 parts by weight of a mixture of xylylene diisocyanate/trimethylolpropane adduct and xylylene diisocyanate/bisphenol A adduct (trade name: Takenate D119N (50 wt % ethyl acetate solution), manufactured by Takeda Chemical Industries, Ltd.) and 0.4 parts by weight of polymethylene-polyphenylpolyisocyanate (trade name: Millionate MR-200, manufactured by Nippon Polyurethane Industry Co., Ltd.) as capsule wall materials, and they were stirred uniformly to obtain a mixture (II).

Separately, to 66.1 parts by weight of a 8 wt % o phthalated gelatin aqueous solution was added 25.2 parts by weight of ion exchange water and 0.4 parts by weight of SUCRAPH™ AG-8 (nonionic surfactant, 50 wt %, manufactured by Nippon Fine Chemical Co., Ltd.), and further, mixed liquid (II) (solution) of the diazonium salt (B) obtained above was added, and the mixture was emulsion-dispersed at 40° C. by using a homogenizer (manufactured by Nippon Seiki Seisakusho K.K.). To the resulting emulsion was added 10 parts by weight of water, and the mixture was uniformalized. Then, a capsulation reaction was conducted for 0.5 hours while stirring at 40° C. Then, the temperature was raised to 50° C., and a capsulation reaction was conducted for 2.5 hours. Then, ion exchange resins (AMBERLITE™ IRA-68 15 wt %, AMBERLITE™ IRC-50 30 wt %, both manufactured by Organo Corporation) were added, the mixture was further stirred for 1 hour. Then, the ion exchange resins were filtrated off, and the concentration was controlled so that the solid concentration of the capsule liquid was 23%, to obtain diazonium salt-containing microcapsule liquid (b). diazonium salt (B)

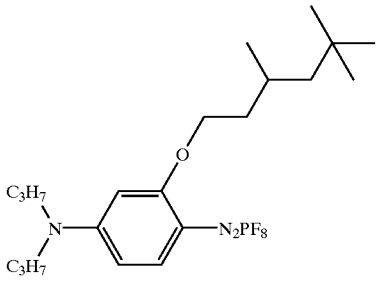

Preparation of Diazonium Salt-containing Microcapsule Liquid (c)

To 15.1 parts by weight of ethyl acetate was added 4.6 parts by weight of the following diazonium salt (C) (maximum absorption wavelength: 350 nm or less), and 10.4 parts by weight of diphenyl phthalate, and the mixture was uniformly dissolved by heating. Into the above-mentioned mixture was added 6.1 parts by weight of xylylene diisocyanate/trimethylolpropane adduct (trade name: Takenate D110N (75 wt % ethyl acetate solution), manufactured by Takeda Chemical Industries, Ltd.) and 2.4 parts by weight of polymethylenepolyphenylpolyisocyanate (trade name: Millionate MR-200, manufactured by Nippon Polyurethane Industry Co., Ltd.) as capsule wall materials, and they were stirred uniformly to obtain a mixture (III).

Separately, to 62.7 parts by weight of the above-mentioned phthalated gelatin aqueous solution was added 13.8 parts by weight of ion exchange water and 0.41 parts by weight of SUCRAPH™ AG-8 (nonionic surfactant, 50 wt %, manufactured by Nippon Fine Chemical Co., Ltd.), and further, mixed liquid (III) (solution) of the diazonium salt (C) obtained above was added, and the mixture was emulsion-dispersed at 40° C. by using a homogenizer (manufactured by Nippon Seiki Seisakusho K.K.). To the resulting emulsion was added 70 parts by weight of water, and the mixture was uniformalized. Then, a capsulation reaction was conducted for 1.0 hour while stirring at 40° C. Then, the temperature was raised to 60° C., and a capsulation reaction was conducted for 2.0 hours. Then, ion exchange resins (AMBERLITE™ IRA-68 7.5 parts by weight, AMBERLITE™ IRC-50 15 parts by weight, both manufactured by Organo Corporation) were added, the mixture was further stirred for 1 hour. Then, the ion exchange resins were filtrated off, and the concentration was controlled so that the solid concentration of the capsule liquid was 20%, to obtain diazonium salt-containing microcapsule liquid (c).

Diazonium Salt (C)

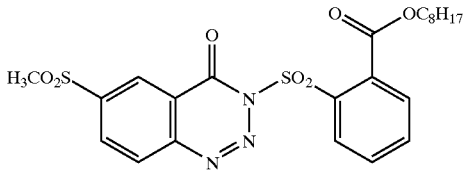

Preparation of Coupler Dispersed Emulsion Preparation of Coupler Dispersed Emulsion (d)

Into 31.9 parts by weight of ethyl acetate was dissolved 5.2 parts by weight of the following coupler (D), 3.3 parts by weight of triphenylguanidine (manufactured by Hodogaya Chemical Co., Ltd.), 20 parts by weight of 4,4'-(m-phenylenediisopropylidene)diphenol (trade name: bisphenol M (manufactured by Mitsui Petrochemical Industries, Ltd.), 13.3 parts by weight of 4-(2-ethyl-1-hexyloxy)benzenesulfonic amide (manufactured by Manac Incorporated), 6.8 parts by weight of 4-n-pentyloxybenzenesulfinic amide (manufactured by Manac Incorporated), 1.6 parts by weight of 3,3,3',3'-tetramethyl-5,5',6,6'-tetra(1-propyloxy)-1,1'-spirobisindane (manufactured by Sankyo Chemical Industries, Ltd.), 6.8 parts by weight of tricresyl phosphate, and 4.2 parts by weight of calcium dodecylbenzenesulfonate (trade name: Pyonin A-4 1-C 70% methanol solution, manufactured by Takemoto Oil&Fat Co., Ltd.), to obtain a mixture (IV).

Separately, to 158.1 parts by weight of the above-mentioned gelatin aqueous solution for emulsion production was added 137.5 parts by weight of ion exchange water, and further, mixed liquid (IV) of the coupler obtained above was added, and the mixture was emulsion-dispersed by using a homogenizer (manufactured by Nippon Seiki Seisakusho K.K.). The resulting coupler dispersed emulsion was heated under reduced pressure to remove ethyl acetate. Then, the concentration was controlled so that the solid concentration was 20%, to obtain a coupler dispersion (d).

Coupler (D)

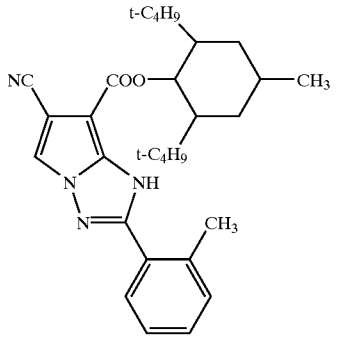

Preparation of Coupler Dispersed Emulsion (e)

Into 37.3 parts by weight of ethyl acetate was dissolved 4.47 parts by weight of the following coupler (E), 1.87 parts by weight of triphenylguanidine (manufactured by Hodogaya Chemical Co., Ltd.), 4.39 parts by weight of 4,4'-(m-phenylenediisopropylidene)diphenol (trade name: bisphenol M (manufactured by Mitsui Petrochemical Industries, Ltd.), 1.4 parts by weight of α-tocopherol, 5.84 parts by weight of tricresyl phosphate, and 1.63 parts by weight of calcium dodecylbenzenesulfonate (trade name: Pyonin A-41-C 70% methanol solution, manufactured by Takemoto Oil&Fat Co., Ltd.), to obtain a mixture (V).

Separately, to 49.3 parts by weight of the above-mentioned gelatin aqueous solution for emulsion production was added 45.5 parts by weight of ion exchange water, and further, mixed liquid (V) of the coupler obtained above was added, and the mixture was emulsion-dispersed by using a homogenizer (manufactured by Nippon Seiki Seisakusho K.K.). The resulting coupler compound dispersed emulsion was heated under reduced pressure to remove ethyl acetate. Then, the concentration was controlled so that the solid concentration was 20%, to obtain a coupler dispersion (e).

Coupler (E)

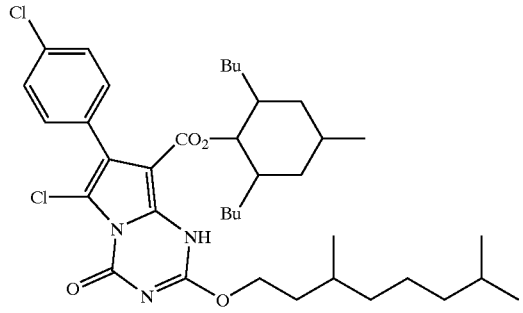

Preparation of Coupler Dispersed Emulsion (f)

Into 49 parts by weight of ethyl acetate was dissolved 6.0 parts by weight of the following coupler (F), 1.9 parts by weight of triphenylguanidine (manufactured by Hodogaya Chemical Co., Ltd.), 11.5 parts by weight of tricresyl phosphate, and 0.8 parts by weight of calcium dodecylbenzenesulfonate (trade name: Pyonin A-41-C 70% methanol solution, manufactured by Takemoto Oil&Fat Co., Ltd.), to obtain a mixture (VI).

Separately, to 77 parts by weight of the above-mentioned gelatin aqueous solution for emulsion production was added 104 parts by weight of ion exchange water. Further, mixed liquid (VI) of the coupler obtained above was added, and the mixture was emulsion-dispersed by using a homogenizer (manufactured by Nippon Seiki Seisakusho K.K.). The resulting coupler dispersed emulsion was heated under reduced pressure to remove ethyl acetate. Then, the concentration was controlled so that the solid concentration was 17.5%, to obtain a coupler dispersion (f). coupler (F)

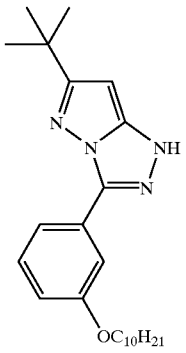

Preparation of Application Liquid for Heat-sensitive Recording Layer Preparation of Application Liquid (G) for Magenta Heat-sensitive Recording Layer The above-mentioned diazonium salt-containing microcapsule liquid (a) and the above-mentioned coupler dispersed emulsion (d) were mixed so that the molar ratio of the contained coupler compound/diazo compound was 2/1. Further, a polystyrenesulfonic acid (partially potassium hydroxide neutralization type) aqueous solution (5 wt %) was mixed in a ratio of 0.2 parts by weight based on 10 parts by weight of the above-mentioned diazonium salt-containing microcapsule liquid (a), to obtain application liquid (G) for magenta heat-sensitive recording layer.

Preparation of application liquid (H) for cyan heat-sensitive recording layer

The above-mentioned diazonium salt-containing microcapsule liquid (b) and the above-mentioned coupler dispersed emulsion (e) were mixed so that the molar ratio of the contained coupler compound/diazo compound was 3/1. Further, a polystyrenesulfonic acid (partially potassium hydroxide neutralization type) aqueous solution (5 wt %) was mixed in a ratio of 0.1385 parts by weight based on 10 parts by weight of the above-mentioned diazonium salt-containing microcapsule liquid (b), and water was mixed in a ratio of 3.65 parts by weight based on 10 parts by weight of the above-mentioned diazonium salt-containing microcapsule liquid (b), to obtain application liquid (H) for cyan heat-sensitive recording layer.

Preparation of Application Liquid (I) for Yellow Heat-sensitive Recording Layer

The above-mentioned diazonium salt-containing microcapsule liquid (c) and the above-mentioned coupler dispersed emulsion (f) were mixed so that the molar ratio of the contained coupler compound/diazo compound was 3/1. Further, water was mixed in a ratio of 0.86 parts by weight based on 10 parts by weight of the above-mentioned diazonium salt-containing microcapsule liquid (c). Further, 0.166 parts by weight of fluorescent brightener (trade name: Keikol BXNL (28 wt %), manufactured by Nippon Soda Co., Ltd.) containing a 4,4'-bistriazinylaminostilbene-2,2'-disulfonic acid derivative was mixed, to obtain application liquid (I) for yellow heat-sensitive recording layer.

Preparation of Application Liquid for Intermediate Layer 10.0 parts by weight of 15 wt % alkali-treated low ion gelatin (trade name: #750 gelatin, manufactured by Nitta Gelatin Inc.), 0.05 parts by weight of sodium 4-[(4-nonylphenoxy)-tri(oxyethylene)]butylsulfonate (manufactured by Sankyo Chemical Industries, Ltd., 2.0 wt % aqueous solution), 1.5 parts by weight of boric acid (4.0 wt % aqueous solution), 0.19 parts by weight of a polystyrenesulfonic acid (partially potassium hydroxide neutralization type) aqueous solution (5 wt %), 4.53 parts by weight of a mixed aqueous solution (4 wt %)(manufactured by Wako Pure Chemical Industries, Ltd.) of N,N'-ethylene-bis (vinylsulfonylacetamide), N,N'-trimethylene-bis (vinylsulfonylacetamide) and sodium citrate, and 0.67 parts by weight of ion exchange water were mixed, to obtain application liquid for intermediate layer.

Preparation of Application Liquid for Light Transmittance-controlling Layer

Preparation of Ultraviolet Absorber Precursor Microcapsule Liquid

Into 71 parts by weight of ethyl acetate was dissolved 14.5 parts by weight of [2-allyl-6-(2H-benzotriazol-2-yl)-4-t-octylphenyl]benzenesulfonate, 5.0 parts by weight of 2,5-bis(t-octyl)hydroquinone, 1.9 parts by weight of tricresyl phosphate, 5.7 parts by weight of an α-methylene dimer (trade name: MSD-100, manufactured by Mitsui Chemical Co., Ltd.), and 0.45 parts by weight of calcium dodecylbenzeneuslfonate (trade name: Pyonin A-41-C (70% methanol solution), manufactured by Takemoto Oil&Fat Co., Ltd.), and they were dissolved uniformly. Into the above-mentioned mixture was added 54.7 parts by weight of a xylylene diisocyanate/trimethylolpropane adduct (trade name: Takenate D110N (75 wt % ethyl acetate solution), manufactured by Takeda Chemical Industries, Ltd.) as a capsule wall material, and they were stirred uniformly to obtain an ultraviolet absorber precursor mixture (VII).

Separately, to 52 parts by weight of itaconic acid-denatured polyvinyl alcohol (trade name: KL-318, manufactured by Kuraray Co., Ltd.) was mixed 8.9 parts by weight of a 30 wt % phosphoric acid aqueous solution and 532.6 parts by weight of ion exchange water, to prepare a PVA aqueous solution for ultraviolet absorber precursor microcapsule liquid.

To 516.06 parts by weight of the above-mentioned PVA aqueous solution for ultraviolet absorber precursor microcapsule liquid was added the above-mentioned ultraviolet absorber precursor mixture (VII), and they were emulsion-dispersed at 20° C. using homogenizer (manufactured by Nippon Seiki Seisakusho K.K.). To the resulting emulsion was added 254.1 parts by weight of ion exchange water and the mixture was uniformalized. Then, a capsulation reaction was conducted for 3 hours while stirring at 40° C. Then, 94.3 parts by weight of an ion exchange resin (AMBERLITE™ MB-3, manufactured by Organo Corporation) was added, the mixture was further stirred for 1 hour. Then, the ion exchange resin was filtrated off, and the concentration was controlled so that the solid concentration of the capsule liquid was 13.5%. The resulting microcapsule had a particle size of 0.30 μm. To 859.1 parts by weight of this capsule liquid was mixed 2.416 parts by weight of carboxy-modified styrenebutadiene latex (trade name: SN-307, (48 wt % aqueous solution), manufactured by Sumitomo Norgatac) and 39.5 parts by weight of ion exchange water, to obtain ultraviolet absorber precursor microcapsule liquid.

Preparation of Application Liquid for Light Transmittance-controlling Layer 1000 parts by weight of the above-mentioned ultraviolet absorber precursor microcapsule liquid, 5.2 parts by weight of potassium N-(perfluoro-1-octanesulfonyl)-N-propylaminoacetate (trade name: Megafak F-120, manufactured by Dainippon Ink and Chemicals, Incorporated)(5 wt % aqueous solution), 7.75 parts by weight of a 4 wt % sodium hydroxide aqueous solution and 73.39 parts by weight of sodium (4-nonylphenoxytrioxyethylene) butylsulfonate (manufactured by Sankyo Chemical Industries, Ltd., 2.0 wt % aqueous solution) were mixed, to obtain application liquid for light transmittance-controlling layer.

Preparation of Application Liquid for Protective Layer

Preparation of Polyvinyl Alcohol Solution for Protective Layer 160 parts by weight of a vinyl alcohol-alkylvinyl ether copolymer (trade name: EP-130, manufactured by Denki Kagaku Kogyo K.K.), 8.74 parts by weight of a mixture (trade name: Neoscore CM-57 (54 wt % aqueous solution), manufactured by Toho Chemical Industry Co., Ltd.) of a sodium alkylsulfonate and a polyoxyethylene alkyl ether phosphate, and 3832 parts by weight of ion exchange water were mixed, and the mixture was dissolved at 90° C. for 1 hour, to obtain a uniform polyvinyl alcohol solution for protective layer.

Preparation of Pigment Dispersion for Protective Layer

Into 8 parts by weight of barium sulfate (trade name: BF-21F, barium sulfate content 93% or more, manufactured by Sakai Chemical Industry Co., Ltd.) was mixed 0.2 parts by weight of an anionic special polycarboxylic acid type polymer activating agent (trade name: Poise 532A (40 wt % aqueous solution), manufactured by Kao Corp.) and 11.8 parts by weight of ion exchange water, and they were dispersed by a Dynau mill to prepare pigment dispersion for protective layer. The particle size of this dispersion was measured (conducted with LA-910 (trade name), manufactured by Horiba, Ltd.), to find a median diameter of 0.30 μm or less.

Preparation of Mat Agent Dispersion for Protective Layer

Into 220 parts by weight of wheat starch (trade name: Komugi Denpun S, manufactured by Shinshin Shokuryo Kogyo) was mixed 3.81 parts by weight of water dispersion of 1-2 benzisothiazoline 3 one (trade name: PROXEL B.D, I.C.I. K.K.) and 1976.19 parts by weight of ion exchange water, and they were dispersed uniformly, to obtain a mat agent dispersion for protective layer.

Preparation of Application Blend Liquid for Protective Layer

Into 1000 parts by weight of the above-mentioned polyvinyl alcohol solution for protective layer was mixed 40 parts by weight of potassium N-(perfluoro-1-octanesulfonyl)-N-propylaminoacetate (trade name: Megafak F-120, manufactured by Dainippon Ink and Chemicals, Incorporated)(5 wt % aqueous solution), 50 parts by weight of sodium (4-nonylphenoxytrioxyethylene)butylsulfonate (manufactured by Sankyo Chemical Industries, Ltd., 2.0 wt % aqueous solution), 49.87 parts by weight of the above-mentioned pigment dispersion for protective layer, 16.65 parts by weight of the above-mentioned mat agent dispersion for protective layer and a zinc stearate dispersion (trade name: Hydrin F115, 20.5 wt % aqueous solution, manufactured by Chukyo Yushi K.K.), uniformly, to obtain application blend liquid for protective layer.

Application of Application Liquid for Heat-sensitive Recording Layer

On the surface of the primer layer of the above-mentioned support, 7 layers, namely, the above-mentioned application liquid (I) for yellow heat-sensitive recording layer, the above-mentioned application liquid for intermediate layer, the above-mentioned application liquid (H) for cyan heat-sensitive recording layer, the above-mentioned application liquid for intermediate layer, the above-mentioned application liquid (G) for magenta heat-sensitive recording layer, the above-mentioned application liquid for light transmittance-controlling layer and the above-mentioned application liquid for protective layer were applied continuously from the bottom in this order, and dried continuously under conditions of 30° C. and a relative humidity of 30% and of 40° C. and a relative humidity of 30% to obtain a full-color heat-sensitive recording material for Example 1.

In this procedure, applications were conducted so that the application amount of the above-mentioned application liquid (I) for yellow heat-sensitive recording layer was 4.5 $g/m^2$ in terms of solid amount, the application amount of the above-mentioned application liquid (H) for cyan heat-sensitive recording layer was 6.7 $g/m^2$ in terms of solid amount likewise, and the application amount of the above-mentioned application liquid (G) for magenta heat-sensitive recording layer was 4.71 $g/m^2$ in terms of solid amount likewise.

Further, applications were conducted so that the application amount of the above-mentioned application liquid for intermediate layer was 3.25 $g/m^2$ in terms of solid amount, the application amount of the above-mentioned application liquid for light transmittance-controlling layer was 2.35 $g/m^2$ in terms of solid amount, and the application amount of the above-mentioned protective layer was 1.39 $g/m^2$ in terms of solid amount, respectively.

Example 2

A heat-sensitive recording material of Example 2 was obtained in the same manner as in Example 1 except that the application liquids for heat-sensitive recording layer in Example 1 were applied so that the application amount of the application liquid (I) for yellow heat-sensitive recording layer was 5.40 g/m$^2$, the application amount of the cyan heat-sensitive recording layer was 8.04 g/m$^2$, and the application amount of the magenta heat-sensitive recording material (G) was 5.65 g/m$^2$.

Comparative Example 1

Support Equipped with Primer Layer

Wood pulp composed of 100 parts by weight of LBKP was crushed by a double disk refiner to a Canadian freeness of 300 ml. 0.5 parts by weight of epoxidated behenic amide, 1.0 part by weight of anion polyacrylamide, 0.1 part by weight of polyamidepolyamineepichlorohydrin and 0.5 parts by weight of cation polyacrylamide were added, all based on bone-dry weight, and base paper of 100 g/m$^2$ was produced by a long net paper making machine. Polyvinyl alcohol was used for surface sizing at a bone-dry weight of 1.0 g/m$^2$, and a density of 1.0 was attained by calender treatment.

Corona discharge treatment was conducted on the wire surface (rear surface) side of the above-mentioned base paper. Then, a high density polyethylene was coated by using a melt extruder to give a resin thickness of 30 $\mu$m, to form a resin layer composed of a mat surface (this surface is called "rear surface"). Corona discharge treatment was conducted on the polyethylene coated surface on this rear surface. Then, aluminum oxide (manufactured by Nissan Chemical Industries, Ltd., trade name: Aluminasol 100)/silicon dioxide (manufactured by Nissan Chemical Industries, Ltd., trade name: Snowtex O)=½ (by weight) were dispersed in water as antistatic agents, and applied on the corona-treated surface so that the weight after dry was 0.2 g/m$^2$ (this is called rear PE provided product).

Further, corona discharge treatment was conducted on the felt surface (front surface) of the base paper, and a low density polyethylene containing 10% by weight of titanium dioxide and a trace amount of ultramarine was melt-extrusion coated by using a melt extruder so that the resin thickness was 40 $\mu$m, to form a resin layer composed of a gloss surface (this surface is called "front surface"). Corona discharge treatment was conducted on the polyethylene coated surface on the front surface. Then, the following gelatin primer was applied at a dry weight of 0.2 g/m$^2$.

Preparation of Gelatin Primer Layer Liquid 40 parts by weight of enzymolyzed gelatin (average molecular weight: 10000, PAGI method viscosity: 1.5 mPa·s (15 mP), PAGI method jelly strength: 20 g) was added to 60 parts by weight of ion exchange water, and they were dissolved by stirring at 40° C., to prepare a gelatin aqueous solution for primer layer.

Separately, 8 parts by weight of water-swellable synthetic mica (aspect ratio: 1000, trade name: Somashif ME100, manufactured by Co-op Chemical Co., Ltd.) and 92 parts by weight of water were mixed, then, the mixture was wet-dispersed by a visco-mill, to obtain a mica dispersion having a volume average particle size of 2.0 $\mu$m. To this mica dispersion was added water so that the mica concentration was 5 wt %, and they were mixed uniformly, to prepare a desired mica dispersion.

To 100 parts by weight of the 40 wt % gelatin aqueous solution of 40° C. was added 120 parts by weight of water and 556 parts by weight of methanol, and they were mixed sufficiently. Then, 208 parts by weight of the above-mentioned 5 wt % mica dispersion was added, and mixed by stirring sufficiently, to obtain 9.8 parts by weight of a 1.66 wt % polyethylene oxide surfactant. Then, 7.3 parts by weight of ethylene diglycidyl ether was added as a gelatin film hardening agent to prepare application liquid for primer layer (5.7 wt %).

This application liquid for primer layer was applied on the front surface of the support, on both surfaces of which a polyethylene film had been provided, so that the application amount of mica was 0.2 g/m$^2$, to form a primer layer.

Preparation of Cyan Heat-sensitive Recording Layer Liquid

Preparation of Electron-donating Dye Precursor-containing Capsule Liquid (j)

5 parts by weight of 3-(o-methyl-p-dimethylaminophenyl)-3-(1'-ethyl-2'-methylindol-3-yl) phthalide (electron-donating dye precursor) was dissolved in 20 parts by weight of ethyl acetate. Then, to this was added 20 parts by weight of isopropylbiphenyl (higher boiling point solvent), and the mixture was heated and uniformly mixed.

To the resulting solution was added 20 parts by weight of 1/3 adduct of xylylene diisocyanate/trimethylolpropane, and the mixture was stirred uniformly, to give an electron-donating colorless dye precursor solution.

Separately, to 54 parts by weight of a 6 wt % aqueous solution of phthalated gelatin was added 2 parts by weight of a 2 wt % aqueous solution of sodium dodecylsulfonate to prepare a solution. To this was added the above-mentioned electron-donating colorless dye precursor solution, and the mixture was emulsion-dispersed using a homogenizer, to obtain an emulsified dispersion. To the resulting emulsified dispersion was added 69 parts by weight of water, they were uniformly mixed. Then, the mixture was heated to 50° C. while stirring, and a microcapsulation reaction was conducted for 3 hours, to prepare an electron-donating colorless dye precursor-containing microcapsule liquid (j). The microcapsules had an average particle size of 1.6 $\mu$m.

Preparation of Electron-accepting Compound Dispersion (k)

30 parts by weight of 4,4'-(p-phenylenediisopropylidene) diphenol (trade name: Bisphenol P, manufactured by Mitsui Toatsu Chemical Industries, Ltd.) was added as an electron-accepting compound to 150 parts by weight of a 4 wt % aqueous solution of gelatin, and they were dispersed in a ball mill for 24 hours, to obtain an electron-accepting compound dispersion (k). The average particle size of the above-mentioned electron-accepting compound in this electron-accepting compound dispersion (k) was 1.2 $\mu$m.

Preparation of Cyan Heat-Sensitive Recording Layer Application Liquid

The above-mentioned electron-donating colorless dye precursor-containing capsule liquid (k) and the above-mentioned electron-accepting compound dispersion (k) were mixed at a ratio of electron-donating colorless dye precursor/electron-accepting compound dispersion of 1/10. Further, sodium dodecylbenzenesulfonate was added so that the application amount of a cyan heat-sensitive recording layer formed by applying the above-mentioned cyan heat-sensitive recording layer application liquid was 0.1 g/m$^2$, to prepare the intended application liquid for heat-sensitive recording layer.

Preparation of Magenta Heat-sensitive Recording Layer Liquid 2.0 parts by weight of a diazonium salt (L) of the following structural formula (decomposed by light having a wavelength of 365 nm) was dissolved in 20 parts by weight of ethyl acetate. Then, 20 parts by weight of isopropylbiphenyl and 0.4 parts by weight of diphenyl-(2,4,6-trimethylbenzoyl)phosphine oxide (trade name: Rucilin TPO, manufactured by BASF Japan Ltd.) were added further, and they were uniformly mixed with heating. To the resulting solution was added 15 parts by weight of a 1/3 adduct of xylylene diisocyanate/trimethylolpropane (capsule wall material), and they were mixed uniformly to obtain a solution of a diazonium salt.

The resulting solution of a diazonium salt was added to a solution prepared by mixing 54 parts by weight of a 6 wt % aqueous solution of phthalated gelatin and 2 parts by weight of a 2 wt % aqueous solution of sodium dodecylsulfonate, and they were emulsion-dispersed by using a homogenizer. To the resulting emulsified dispersion was added 68 parts by weight of water and mixed uniformly, and stirred while heating at 40° C. A capsulation reaction was conducted for 3 hours to obtain a capsule solution so that the capsules had an average particle size of 1.2 μm. Then, the liquid temperature was lowered to 35° C., and ion exchange resins (AMBERLITE™ IRA-68 6.5 parts by weight, AMBERLITE™ IRC-50 13 parts by weight, both manufactured by Organo Corporation) were added, and they were stirred further for 1 hour. The ion exchange resins were filtered off to obtain the intended diazonium salt microcapsule (1).

diazonium salt (L)

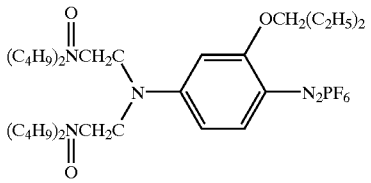

Preparation of Coupler Emulsion (m)

2.0 parts by weight of a coupler (M) of the following structural formula, 2.0 parts by weight of 1,2,3-triphenylguanidine, 2.0 parts by weight of 1,1-(p-hydroxyphenyl)-2-ethylhexane, 4.0 parts by weight of 4,4'-(m-phenylene diisopropylidene)diphenol and 0.6 parts by weight of 3,3,3',3'-tetramethyl-5,6',6,6'-tetra(1-propyloxy)-1,1'-spirobisindane were dissolved in 10 parts by weight of ethyl acetate. The resulting solution was added into an aqueous solution prepared by mixing 20 parts by weight of a 6 wt % aqueous solution of gelatin and 2 parts by weight of a 2 wt % aqueous solution of sodium dodecylsulfonate, and they were emulsion-dispersed by using a homogenizer for 10 minutes, to obtain coupler emulsion (m).

Coupler (M)

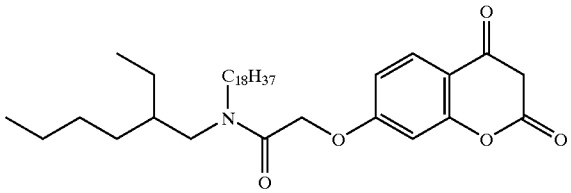

Preparation of Application Liquid for Magenta Heat-sensitive Recording Layer

To the above-prepared diazonium salt-containing capsule liquid (1) was added SBR latex (manufactured by Sumitomo Norgatac, trade name: SN-307) in an amount of 40% by weight based on capsule solid content. Then, this coupler emulsion (m) was mixed with the diazonium salt-containing capsule liquid (1) at a weight ratio of 3/2, to prepare application liquid for magenta layer.

Preparation of Diazonium Salt Microcapsule Liquid (n)

3.5 parts by weight of the following diazonium salt (N1) and 0.9 parts by weight of the following diazonium salt (N2) having the decomposition maximum absorption wavelength at 420 nm were dissolved as the diazonium salt in 16.4 parts by weight of ethyl acetate. Further, 9.8 parts by weight of isopropylbiphenyl which is a higher boiling point solvent and 0.4 parts by weight of diphenyl-(2,4,6-trimethylbenzoyl)phosphine oxide (trade name: Rucilin TPO, manufactured by BASF Japan Ltd.) were added, and they mixed uniformly while heating. 4.5 parts by weight of xylylene diisocyanate/trimethylolpropane adduct (75 wt % ethyl acetate solution, trade name: Takenate D110N, manufactured by Takeda Chemical Industries, Ltd.) and 4.2 parts by weight of a 30 wt % solution of xylylene diisocyanate/bisphenol A adduct in ethyl acetate were further added as capsule wall materials to this solution, and they were stirred uniformly.

Separately, 77 parts by weight of a 6 wt % gelatin aqueous solution to which 0.36 parts by weight of SUCRAPH™ AG-8 (nonionic surfactant, 50 wt %, manufactured by Nippon Fine Chemical Co., Ltd.) had been added was prepared. To this was added the above-mentioned diazonium salt solution, and they were emulsion-dispersed by a homogenizer. To the resulting aqueous solution was added 20 parts by weight of water, the mixture was uniformalized. Then, a capsulation reaction was conducted for 3 hours while stirring at 40° C. Then, the temperature was lowered to 35° C., and ion exchange resins (AMBERLITE™ IRA-68 6.5 parts by weight, AMBERLITE™ IRC-50 13 parts by weight, both manufactured by Organo Corporation) were added, the mixture was further stirred for 1 hour. Then, the ion exchange resins were filtrated off. Then, 0.4 parts by weight of a 1 wt % hydroquinone aqueous solution was added based on 10 parts by weight of the capsule and they were stirred, to obtain the intended diazonium salt microcapsule liquid (n). The capsules had an average particle size of 0.91 μm.

diazonium salt (N1)

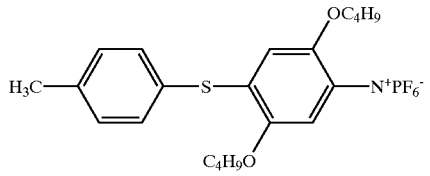

diazonium salt (N2)

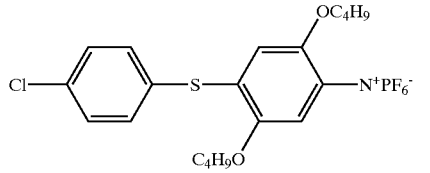

Preparation of Coupler Emulsion (o)

2.4 parts by weight of the following coupler (O), 2.5 parts by weight triphenylguanidine, 2.5 parts by weight of 1,1-(p-hydroxyphenyl)-2-ethylhexane, 3.6 parts by weight of 4,4'-(m-phenylene diisopropylidene)diphenol, 3.2 parts by weight of 2-ethylhexyl-4-hydroxybenzoate and 0.8 parts by weight of 3,3,3',3'-tetramethyl-5,5',6,6'-tetra(1-propyloxy)-1,1'-spirobisindane were dissolved in 8.0 parts by weight of ethyl acetate, and to this was added 1.0 part by weight of Pyonin A41C (manufactured by Takemoto Oil&Fat Co., Ltd.). Then, they were mixed uniformly while heating. Separately, this was added into 75 parts by weight of a 10 wt % aqueous solution of gelatin (trade name: #750 gelatin, manufactured by Nitta Gelatin), and they were emulsion-dispersed by a homogenizer. The remaining ethyl acetate was evaporated from this emulsion to obtain the intended coupler emulsion (o).

Coupler (O)

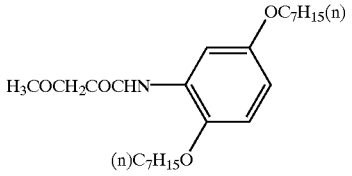

Preparation of Application Liquid for Yellow Heat-sensitive Recording Layer

The above-prepared diazonium salt capsule liquid (n), coupler emulsion (o) and styrene-butadiene rubber (trade name: SN-307, manufactured by Sumitomo Norgatac) were mixed so that the ratio of the diazonium salt to coupler was 1/3.2 and the weight of the styrenebutadiene rubber was equivalent to the weight of gelatin, to prepare the intended application liquid.

Preparation of Application Liquid for Intermediate Layer

To 100 parts by weight of a 10 wt % aqueous solution of 10% gelatin (trade name: #750 gelatin, manufactured by Nitta Gelatin Inc.) was added 2 parts by weight of 2% sodium (4-nonylphenoxytrioxyethylene)butylsulfoante to prepare application liquid for intermediate layer.

Preparation of Application Liquid for Light Transmittance-controlling Layer

Preparation of Ultraviolet Absorber Precursor Microcapsule Liquid

Into 30 parts by weight of ethyl acetate was dissolved 10 parts by weight of [2-allyl-6-(2H-benzotriazol-2-yl)-4-t-octylphenyl]benzenesulfonate, 3 parts by weight of 2,5-di-t-octyl-hydroquinone, 2 parts by weight of tricresyl phosphate and 4 parts by weight of an α-methystyrene dimer. 20 parts by weight of a xylylene diisocyanate/trimethanolpropane adduct (75 wt % ethyl acetate solution, manufactured by Takeda Chemical Industries, Ltd., trade name: Takenate D110N) was further added as a capsule wall material to this solution and the mixture was stirred uniformly.

Separately, 200 parts by weight of a 8% aqueous solution of itaconic acid-denatured polyvinyl alcohol (manufactured by Kuraray Co., Ltd.: trade name: KL-318,) was prepared. To this was added the above-mentioned ultraviolet absorber precursor solution, and the mixture was emulsion-dispersed by a homogenizer. To the resulting emulsion was added 120 parts by weight of water and the mixture was uniformalized, then heated to 40° C. while stirring, and a capsulation reaction was effected for 3 hours. Then, 7.0 parts by weight of an ion exchange resin (AMBERLITE™ MB-B, manufactured by Organo Corporation) was added, and the mixture was further stirred for 1 hour, to obtain the intended ultraviolet absorber precursor microcapsule liquid. The microcapsules had an average particle size of 0.3 μm.

Preparation of Application Liquid for Light Transmittance-controlling Layer

To 100 parts by weight of the above-mentioned ultraviolet absorber precursor microcapsule liquid was added 10 parts by weight of a 2% sodium [4-nonylphenoxytrioxyethylene] butylsulfonate, to prepare application liquid for light transmittance-controlling layer.

Preparation of Application Liquid for Protective Layer 100 parts by weight of a 7 wt % aqueous solution of a vinyl alcohol-alkylvinyl ether copolymer (trade name: EP-130, manufactured by Denki Kagaku Kogyo K.K.), 50 parts by weight of water, 10 parts by weight of a 20 wt % dispersion of barium sulfate (trade name: BF-21F, manufactured by Sakai Chemical Industry Co., Ltd.), 5 parts by weight of a 2.0 wt % aqueous solution of sodium (4-nonylphenoxytrioxyethylene)butylsulfonate, and 5 parts by weight of a 5.0 wt % aqueous solution of potassium N-(perfluoro-1-octanesulfonyl)-N-propylaminoacetate were mixed, to prepare application liquid for protective layer.

Production of Comparative Heat-sensitive Recording Material

On the surface of the primer layer of the above-mentioned support equipped with a primer layer, a cyan heat-sensitive recording layer liquid, intermediate layer liquid, magenta heat-sensitive recording layer liquid, intermediate layer liquid, yellow heat-sensitive recording layer liquid, light transmittance-controlling liquid and protective layer liquid were multi-applied in this order from the support side, to obtain a full-color heat-sensitive recording material of Comparative Example 1. The application amounts of these layers were 7.12 g, 3.28 g, 8.33 g, 3.13 g, 8.06 g, 2.50 g and 1.23 g, respectively, per 1 $m^2$ in the same order from the cyan heat-sensitive recording layer liquid.

Comparative Example 2

A heat-sensitive recording material of Comparative Example 2 was obtained in the same manner as in Example 1 except that an application liquid obtained by changing the electron-donating colorless dye precursor in the application liquid for yellow heat-sensitive recording layer in Comparative Example 1 to a compound of the following structural formula replaced the application liquid (I) for yellow heat-sensitive recording layer in Example 1.

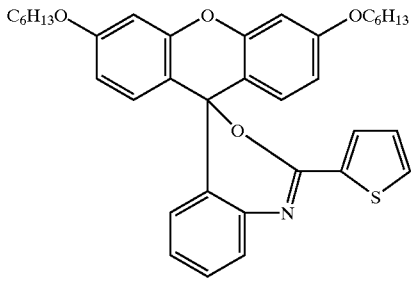

Evaluation

The heat-sensitive recording materials in Examples 1 to 2 and Comparative Examples 1 to 2 obtained above were evaluated by the following methods. The results are shown in Table 1. Regarding the heat-sensitive recording layer, a first heat-sensitive recording layer, a second heat-sensitive recording layer and a third heat-sensitive recording layer exist from the protective layer side.

Measurement of Black Development Saturated Concentration

Using a thermal head for a heat-sensitive printer (manufactured by TDK K.K., trade name: LV3116, resistance 2533 Ω), current is applied so that printing energy is 120 mJ/$mm^2$, to cause color development with heating. At this energy, all layers develop color, resulting in black color. The visual concentration of this was measured by X-rite310, and the value was black saturated concentration.

Curl after Printing

Under conditions of 5° C. and a relative humidity of 30%, black development was performed at paper size of 43×120 mm and print size of 38×100 mm, and the curled value along the longitudinal direction 1 hour after color development was measured.

Second Layer Fixation Time

Printing was effected so that the concentration of a first heat-sensitive recording layer (heat-sensitive recording layer on the outermost layer) was 1.0, and the first heat-sensitive recording layer was fixed, then, a second heat-sensitive recording layer was fixed by irradiation with light by a 40 W fluorescent lamp having the center wavelength at 365 nm. The irradiation time for obtaining a color development concentration of the second heat-sensitive recording layer of 0.1 when printing was effected by the above-mentioned printer so as to give 100 mJ/mm$^2$, was the fixation time.

Image Preservability

After light-fixation of a first and second heat-sensitive recording layers, a third heat-sensitive recording layer was allowed to develop color so that the color development concentration was 1.0±0.1. Then, the color development concentration was measured, and was measured again after being left for 10 days under conditions of 70° C. and a relative humidity of 60% was measured, and the color development concentration remaining ratio was calculated according to the following formula.

Color development concentration remaining ratio (%)=(color development concentration after leaving)/(color development concentration before leaving)×100

TABLE 1

| | Total application amount (g/m$^2$) | Black development saturated concentration | Curl (mm) | Second layer fixation time (sec.) | Image preserving ability (%) |
|---|---|---|---|---|---|
| Example 1 | 26.15 | 2.1 | 8 | 8 | 95 |
| Example 2 | 29.33 | 2.3 | 12 | 10 | 96 |
| Comparative Example 1 | 33.65 | 2.0 | 25 | 12 | 80 |
| Comparative Example 2 | 28.77 | 2.1 | 25 | 8 | 72 |

As is understood from Table 1, the heat-sensitive recording material of Example 1 had small layer application amount (thickness is small), and was excellent in all of black development saturated concentration, curl, fixation time and image preservability. Further, the heat-sensitive recording material of Example 2 was excellent in black development saturated concentration since the layer application amount was larger as compared with Example 1, and curl, fixation time and image preservability thereof were excellent though they were somewhat inferior as compared with Example 1.

However, the heat-sensitive recording material of Comparative Example 1 in which cyan, magenta and yellow were provided from the support side in this order and a leuco dye was used in the cyan heat-sensitive recording layer was remarkably inferior in curl and image preservability. Further, the heat-sensitive recording material of Comparative Example 2 in which yellow, cyan and magenta were provided in this order also as in Examples 1 and 2 and a leuco dye was used in the yellow heat-sensitive recording layer was apparently poor in curl and image preservability though fixation time was excellent.

As described above, according to the present invention, heat-sensitive recording materials excellent in image stability, handling property, color development and fixation speed can be provided.

What is claimed is:

1. A full-color heat-sensitive recording material comprising:

a support;

a heat-sensitive recording layer that color-develops to yellow, provided on said support;

a heat-sensitive recording layer that color-develops to cyan, provided on said heat-sensitive recording layer that color-develops to yellow; and a heat-sensitive recording layer that color-develops to magenta, provided on said heat-sensitive recording layer that color-develops to cyan, wherein each of said heat-sensitive recording layers includes:

at least one of a diazo compound and a diazonium salt; and a coupler compound that reacts with said at least one of a diazo compound and a diazonium salt for developing color.

2. The recording material of claim 1, wherein said at least one of a diazo compound and a diazonium salt in said heat-sensitive recording layer that color-develops to yellow comprises a diazo compound of the following general formula (I):

General formula (I)

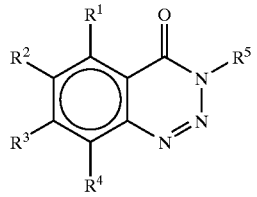

in which: $R^1$, $R^2$, $R^3$ and $R^4$ each independently represent a group selected from the group consisting of a hydrogen atom, halogen atoms, alkyl groups, aryl groups, —$OR^{51}$, —$SR^{51}$, —$COOR^{51}$, —$CONR^{51}R^{52}$, —$SO_2R^{51}$,—$SO_2NR^{51}R^{52}$, —$COR^{51}$, —$NR^{51}R^{52}$, a nitro group and a cyano group; $R^{51}$ and $R^{52}$ each independently represent a group selected from the group consisting of a hydrogen atom, alkyl groups, aryl groups and acyl groups; $R^5$ represents a group selected from the group consisting of a hydrogen atom, alkyl groups, aryl groups, —$COOR^{53}$, —$CONR^{53}R^{54}$, —$SO_2R^{53}$, —$SO_2NR^{53}R^{54}$ and —$COR^{53}$; and $R^{53}$ and $R^{54}$ each independently represent a group selected from the group consisting of a hydrogen atom, alkyl groups, aryl groups and acyl groups.

3. The recording material of claim 1, wherein said heat-sensitive recording layer that color-develops to cyan comprises at least one of diazonium salts of the following general formulae (A) to (C):

General formula (A)

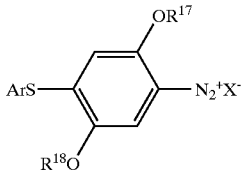

General formula (B)

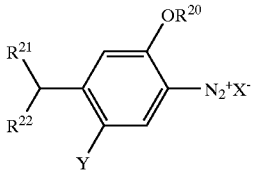

General formula (C)

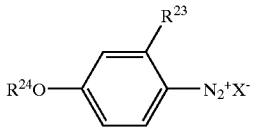

wherein: $X^-$ represents an anion;

in the general formula (A), Ar represents a substituted or unsubstituted aryl group, $R^{17}$ and $R^{18}$ each independently represent a substituted or unsubstituted alkyl group or a substituted or unsubstituted aryl group, and $R^{17}$ and $R^{18}$ may be the same and may be different from each other;

in the general formula (B), $R^{20}$, $R^{21}$ and $R^{22}$ each independently represent a substituted or unsubstituted alkyl group or a substituted or unsubstituted aryl group, $R^{20}$, $R^{21}$ and $R^{22}$ may be the same and may be different from each other, Y represents a hydrogen atom or $OR^{19}$, and $R^{19}$ represents a substituted or unsubstituted alkyl group or a substituted or unsubstituted aryl group; and in the general formula (C), $R^{23}$ and $R^{24}$ each independently represent a substituted or unsubstituted alkyl group or a substituted or unsubstituted aryl group, and $R^{23}$ and $R^{24}$ may be the same and may be different from each other.

4. The recording material of claim 1, wherein said at least one of a diazo compound and a diazonium salt in said heat-sensitive recording layer that color-develops to magenta comprises a diazo compound of the following general formula (1):

General formula (1)

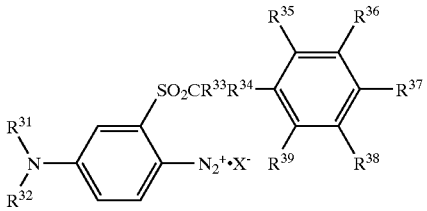

in which: $R^{31}$ and $R^{32}$ each independently represent a hydrogen atom, alkyl group or aryl group; $R^{33}$ and $R^{34}$ each independently represent a hydrogen atom, alkyl group, aryl group or halogen atom; $R^{35}$, $R^{36}$, $R^{37}$, $R^{38}$ and $R^{39}$ each independently represent a hydrogen atom, alkyl group, aryl group, halogen atom, alkoxy group, aryloxy group, alkoxycarbonyl group, acyloxy group, carbamoyl group, amide group, cyano group, alkylthio group, arylthio group, alkylsulfonyl group, arylsulfonyl group; at least one of $R^{35}$, $R^{36}$, $R^{37}$, $R^{38}$ and $R^{39}$ represents a halogen atom; and $X^-$ represents an anion.

5. A full-color heat-sensitive recording material comprising:

a support;

a heat-sensitive recording layer that color-develops to yellow, provided on said support;

a heat-sensitive recording layer that color-develops to cyan, provided on said heat-sensitive recording layer that color-develops to yellow; and a heat-sensitive recording layer that color-develops to magenta, provided on said heat-sensitive recording layer that color-develops to cyan, wherein each of said heat-sensitive recording layers includes: at least one of a diazo compound and a diazonium salt; and a coupler compound that reacts with said at least one of a diazo compound and a diazonium salt for developing color, said at least one of a diazo compound and a diazonium salt in said heat-sensitive recording layer that color-develops to yellow including a diazo compound of the following general formula (I):

General formula (I)

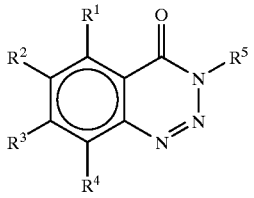

in which: $R^1$, $R^2$, $R^3$ and $R^4$ each independently represent a group selected from the group consisting of a hydrogen atom, halogen atoms, alkyl groups, aryl groups, $—OR^{51}$, $—SR^{51}$, $—COOR^{51}$, $—CONR^{51}R^{52}$, $—SO_2R^{51}$, $—SO_2NR^{51}R^{52}$, $—COR^{51}$, $—NR^{51}R^{52}$, a nitro group and a cyano group; $R^{51}$ and $R^{52}$ each independently represent a group selected from the group consisting of a hydrogen atom, alkyl groups, aryl groups and acyl groups; $R^5$ represents a group selected from the group consisting of a hydrogen atom, alkyl groups, aryl groups, $—COOR^{53}$, $—CONR^{53}R^{54}$, $—SO_2R^{53}$, $—SO_2NR^{53}R^{54}$ and $—COR^{53}$; and $R^{53}$ and $R^{54}$ each independently represent a group selected from the group consisting of a hydrogen atom, alkyl groups, aryl groups and acyl groups, said heat-sensitive recording layer that color-develops to cyan including at least one of diazonium salts of the following general formulae (A) to (C):

General formula (A)

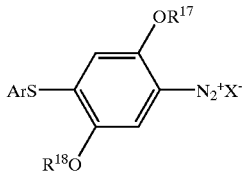

-continued

General formula (B)

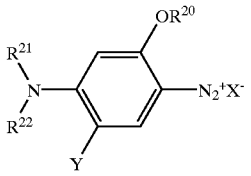

General formula (C)

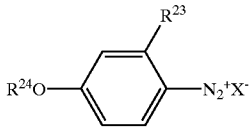

wherein: $X^-$ represents an anion; in the general formula (A), Ar represents a substituted or unsubstituted aryl group, $R^{17}$ and $R^{18}$ each independently represent a substituted or unsubstituted alkyl group or a substituted or unsubstituted aryl group, and $R^{17}$ and $R^{18}$ may be the same and may be different from each other; in the general formula (B), $R^{20}$, $R^{21}$ and $R^{22}$ each independently represent a substituted or unsubstituted alkyl group or a substituted or unsubstituted aryl group, $R^{20}$, $R^{21}$ and $R^{22}$ may be the same and may be different from each other, Y represents a hydrogen atom or $OR^{19}$, and $R^{19}$ represents a substituted or unsubstituted alkyl group or a substituted or unsubstituted aryl group; and in the general formula (C), $R^{23}$ and $R^{24}$ each independently represent a substituted or unsubstituted alkyl group or a substituted or unsubstituted aryl group, and $R^{23}$ and $R^{24}$ may be the same and may be different from each other, and said at least one of a diazo compound and a diazonium salt in said heat-sensitive recording layer that color-develops to magenta including a diazo compound of the following general formula (I):

General formula (1)

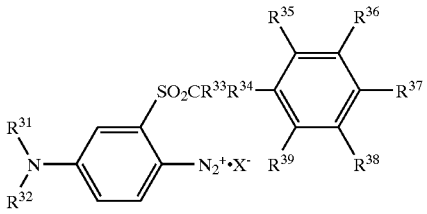

in which: $R^{31}$ and $R^{32}$ each independently represent a hydrogen atom, alkyl group or aryl group; $R^{33}$ and $R^{34}$ each independently represent a hydrogen atom, alkyl group, aryl group or halogen atom; $R^{35}$, $R^{36}$, $R^{37}$, $R^{38}$ and $R^{39}$ each independently represent a hydrogen atom, alkyl group, aryl group, halogen atom, alkoxy group, aryloxy group, alkoxycarbonyl group, acyloxy group, carbamoyl group, amide group, cyano group, alkylthio group, arylthio group, alkylsulfonyl group, arylsulfonyl group; at least one of $R^{35}$, $R^{36}$, $R^{37}$, $R^{38}$ and $R^{39}$ represents a halogen atom; and $X^-$ represents an anion.

6. The recording material of claim 2, wherein said heat-sensitive recording layer that color-develops to yellow further comprises an aromatic hydrocarbon of the following general formula (II):

General formula (II)

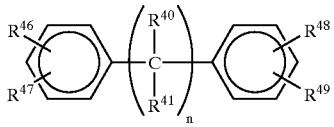

in which: $R^{46}$, $R^{47}$, $R^{48}$, $R^{49}$, $R^{40}$, and $R^{41}$ each independently represent a hydrogen atom or alkyl group; n represents an integer from 0 to 3; the pairs $R^{46}$ and $R^{47}$, $R^{48}$ and $R^{49}$, and $R^{40}$ and $R^{41}$ may be mutually connected to form a ring; alkyl groups represented by $R^{46}$, $R^{47}$, $R^{48}$, $R^{49}$, $R^{40}$, and $R^{41}$ may be linear and may be branched, and may include an unsaturated bond; and $R^{46}$, $R^{47}$, $R^{48}$, and $R^{49}$ may each be substituted to any available position on a corresponding benzene ring of the general formula (II).

7. The recording material of claim 5, wherein said heat-sensitive recording layer that color-develops to yellow further comprises an aromatic hydrocarbon of the following general formula (II):

General formula (II)

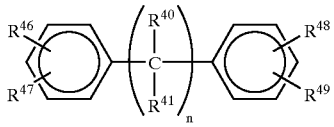

in which: $R^{46}$, $R^{47}$, $R^{48}$, $R^{49}$, $R^{40}$, and $R^{41}$ each independently represent a hydrogen atom or alkyl group; n represents an integer from 0 to 3; the pairs $R^{46}$ and $R^{47}$, $R^{48}$ and $R^{49}$, and $R^{40}$ and $R^{41}$ may be mutually connected to form a ring; alkyl groups represented by $R^{46}$, $R^{47}$, $R^{48}$, $R^{49}$, $R^{40}$, and $R^{41}$ may be linear and may be branched, and may include an unsaturated bond; and $R^{46}$, $R^{47}$, $R^{48}$, and $R^{49}$ may each be substituted to any available position on a corresponding benzene ring of the general formula (II).

8. The recording material of claim 2, wherein said coupler compound in said heat-sensitive recording layer that color-develops to yellow comprises a coupler of the following general formula (III):

$$E^1—CH_2—E^2 \qquad \text{General Formula (III)}$$

in which: $E^1$ and $E^2$ each independently represent electron-attractive groups including a substituent having a positive Hammett's $\sigma_p$ value; $E^1$ and $E^2$ may be the same and may be different from each other; and $E^1$ and $E^2$ may be bonded to form a ring.

9. The recording material of claim 5, wherein said coupler compound in said heat-sensitive recording layer that color-develops to yellow comprises a coupler of the following general formula (III):

$$E^1—CH_2—E^2 \qquad \text{General Formula (III)}$$

in which: $E^1$ and $E^2$ each independently represent electron-attractive groups including a substituent having a positive Hammett's $\sigma_p$ value; $E^1$ and $E^2$ may be the same and may be different from each other; and $E^1$ and $E^2$ may be bonded to form a ring.

10. The recording material of claim 3, wherein said coupler compound in said heat-sensitive recording layer that color-develops to cyan comprises at least one of a compound of the following general formula (D), a compound of the following general formula (E) and a compound of the following general formula (F):

General formula (D)

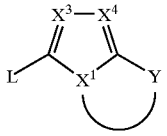

General formula (E)

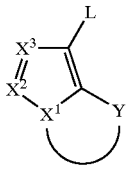

General formula (F)

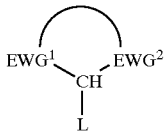

in which general formulae (D) to (F): $X^1$, $X^2$, $X^3$ and $X^4$ each independently represent an atomic group suitable for forming a 5-membered aromatic hetero ring; Y represents an amino group, substituted amino group, hydroxyl group, alkoxy group, or optionally substituted alkyl group; L represents a substituent capable of leaving when the coupler compound couples with the at least one of a diazo compound and a diazonium salt in said heat-sensitive recording layer that color-develops to cyan; $EWG^1$ and $EWG^2$ each independently represent an electron-attractive group; and the pairs $X^1$ and Y, and $EWG^1$ and $EWG^2$ may be mutually connected to form a heteroring.

11. The recording material of claim 5, wherein said coupler compound in said heat-sensitive recording layer that color-develops to cyan comprises at least one of a compound of the following general formula (D), a compound of the following general formula (E) and a compound of the following general formula (F):

General formula (D)

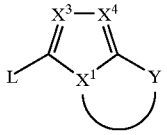

General formula (E)

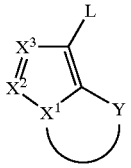

General formula (F)

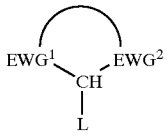

in which general formulae (D) to (F): $X^1$, $X^2$, $X^3$ and $X^4$ each independently represent an atomic group suitable for forming a 5-membered aromatic hetero ring; Y represents an amino group, substituted amino group, hydroxyl group, alkoxy group, or optionally substituted alkyl group; L represents a substituent capable of leaving when the coupler compound couples with said at least one of a diazo compound and a diazonium salt in said heat-sensitive recording layer that color-develops to cyan; $EWG^1$ and $EWG^2$ each independently represent an electron-attractive group; and the pairs $X^1$ and Y, and $EWG^1$ and $EWG^2$ may be mutually connected to form a heteroring.

12. The recording material of claim 4, wherein said diazonium salt of the general formula (1) comprises a diazonium salt represented by the following general formula (2):

General formula (2)

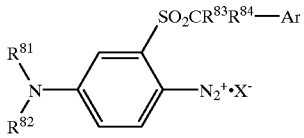

in which: $R^{81}$ and $R^{82}$ each independently represent an alkyl group; $R^{83}$ and $R^{84}$ each independently represent a hydrogen atom, alkyl group or halogen atom; $X^-$ represents an anion; and Ar represents a moiety represented by one of the following general formulae (3), (4) and (5):

General formula (3)

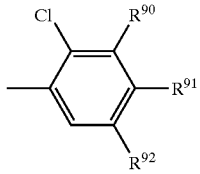

General formula (4)

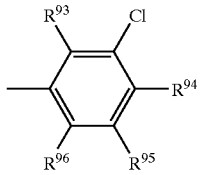

General formula (5)

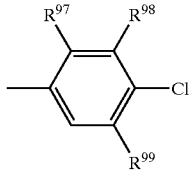

wherein: in the general formula (3), $R^{90}$, $R^{91}$ and $R^{92}$ each independently represent a hydrogen atom, alkyl group, aryl group, halogen atom, alkoxy group or aryloxy group; in the general formula (4), $R^{93}$, $R^{94}$, $R^{95}$ and $R^{96}$ each independently represent a hydrogen atom, alkyl group, aryl group, halogen atom, alkoxy group or aryloxy group, and at least one of $R^{93}$ and $R^{96}$ represents a hydrogen atom; and in the general formula (5), $R^{97}$, $R^{98}$ and $R^{99}$ each independently represent a hydrogen atom, alkyl group, aryl group, alkoxy group or aryloxy group.

13. The recording material of claim 5, wherein said diazonium salt of the general formula (1) comprises a diazonium salt represented by the following general formula (2):

General formula (2)

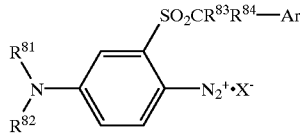

in which: $R^{81}$ and $R^{82}$ each independently represent an alkyl group; $R^{83}$ and $R^{84}$ each independently represent a hydrogen atom, alkyl group or halogen atom; $X^-$ represents an anion; and Ar represents a moiety represented by one of the following general formulae (3), (4) and (5):

General formula (3)

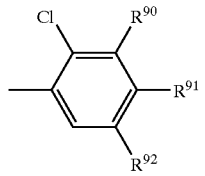

General formula (4)

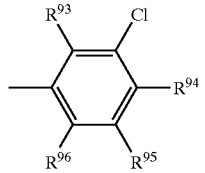

General formula (5)

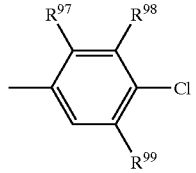

wherein: in the general formula (3), $R^{90}$, $R^{91}$ and $R^{92}$ each independently represent a hydrogen atom, alkyl group, aryl group, halogen atom, alkoxy group or aryloxy group; in the general formula (4), $R^{93}$, $R^{94}$, $R^{95}$ and $R^{96}$ each independently represent a hydrogen atom, alkyl group, aryl group, halogen atom, alkoxy group or aryloxy group, and at least one of $R^{93}$ and $R^{96}$ represents a hydrogen atom; and in the general formula (5), $R^{97}$, $R^{98}$ and $R^{99}$ each independently represent a hydrogen atom, alkyl group, aryl group, alkoxy group or aryloxy group.

14. The recording material of claim 12, wherein said diazonium salt of the formula (2) comprises a diazonium salt represented by the following general formula (6):

General formula (6)

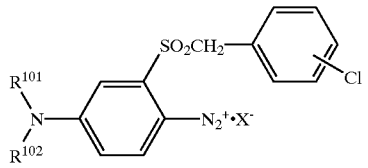

in which: $R^{101}$ and $R^{102}$ each independently represent an alkyl group; and $X^-$ represents an anion.

15. The recording material of claim 13, wherein said diazonium salt of the formula (2) comprises a diazonium salt represented by the following general formula (6):

General formula (6)

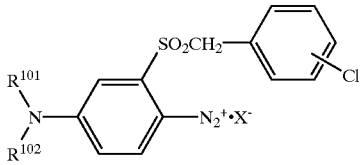

in which: $R^{101}$ and $R^{102}$ each independently represent an alkyl group; and $X^-$ represents an anion.

16. The recording material of claim 12, wherein said at least one of a diazo compound and a diazonium salt in said heat-sensitive recording layer that color-develops to yellow comprises a diazonium salt represented by the following general formula (9):

General formula (9)

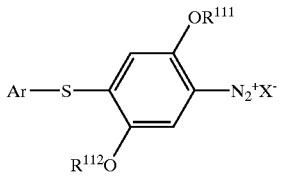

in which: Ar represents an aryl group; $R^{111}$ and $R^{112}$ each independently represent a substituted or unsubstituted alkyl group having from 1 to 18 carbon atoms or a substituted or unsubstituted aryl group having from 6 to 20 carbon atoms; $R^{111}$ and $R^{112}$ may be the same and may be different from each other; and $X^-$ represents an acid anion.

17. The recording material of claim 13, wherein said diazonium salt of the general formula (A) comprises a diazonium salt represented by the following general formula (9):

General formula (9)

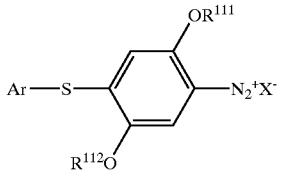

in which: Ar represents an aryl group; $R^{111}$ and $R^{112}$ each independently represent a substituted or unsubstituted alkyl group having from 1 to 18 carbon atoms or a substituted or unsubstituted aryl group having from 6 to 20 carbon atoms; $R^{111}$ and $R^{112}$ may be the same and may be different from each other; and $X^-$ represents an acid anion.

18. The recording material of claim 4, wherein said coupler compound in said heat-sensitive recording layer that color-develops to magenta comprises a coupler of the following general formula (7):

General formula (7)

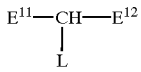

in which: $E^{11}$ and $E^{12}$ each independently represent an electron-attractive group; $E^{11}$ and $E^{12}$ may be connected to form a ring; and L represents a substituent capable of leaving when the coupler compound couples with the at least one of a diazo compound and a diazonium salt in said heat-sensitive recording layer that color-develops to magenta.

19. The recording material of claim 5, wherein said coupler compound in said heat-sensitive recording layer that color-develops to magenta comprises a coupler of the following general formula (7):

General formula (7)

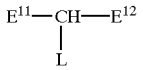

in which: $E^{11}$ and $E^{12}$ each independently represent an electron-attractive group; $E^{11}$ and $E^{12}$ may be connected to form a ring; and L represents a substituent capable of leaving when the coupler compound couples with the at least one of a diazo compound and a diazonium salt in said heat-sensitive recording layer that color-develops to magenta.

* * * * *